US006667140B2

(12) United States Patent
Tosaka et al.

(10) Patent No.: US 6,667,140 B2
(45) Date of Patent: Dec. 23, 2003

(54) TONER AND IMAGE FORMING METHOD

(75) Inventors: Emi Tosaka, Shizuoka-ken (JP); Motoya Fukushima, Mishima (JP); Manabu Ohno, Numazu (JP); Yasushi Katsuta, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/942,570

(22) Filed: Aug. 31, 2001

(65) Prior Publication Data

US 2002/0058193 A1 May 16, 2002

(30) Foreign Application Priority Data

Sep. 1, 2000 (JP) ..... 2000-266063
Aug. 29, 2001 (JP) ..... 2001-259247

(51) Int. Cl.[7] ..... G03G 9/09
(52) U.S. Cl. ..... 430/108.23; 430/124; 430/125
(58) Field of Search ..... 430/108.23, 108.21, 430/120, 124, 125, 126

(56) References Cited

U.S. PATENT DOCUMENTS

| | | | | |
|---|---|---|---|---|
| 2,297,691 A | | 10/1942 | Carlson | |
| 3,666,363 A | | 5/1972 | Tanaka et al. | |
| 4,071,361 A | | 1/1978 | Marushima | |
| 4,777,105 A | | 10/1988 | Macholdt et al. | |
| 5,243,032 A | * | 9/1993 | Rieper | 534/581 |
| 5,262,264 A | | 11/1993 | Shimizu et al. | |

FOREIGN PATENT DOCUMENTS

| | | |
|---|---|---|
| EP | 0110771 | 6/1984 |
| JP | 10231 | 7/1961 |
| JP | 46951 | 12/1974 |
| JP | 3304 | 1/1977 |
| JP | 3305 | 1/1977 |
| JP | 26574 | 2/1980 |
| JP | 42383 | 10/1980 |
| JP | 13945 | 4/1981 |
| JP | 52574 | 11/1982 |
| JP | 53856 | 3/1984 |
| JP | 57256 | 4/1984 |
| JP | 61842 | 4/1985 |
| JP | 217366 | 10/1985 |
| JP | 252360 | 12/1985 |
| JP | 252361 | 12/1985 |
| JP | 94062 | 5/1986 |
| JP | 138259 | 6/1986 |
| JP | 273554 | 12/1986 |
| JP | 14166 | 1/1987 |
| JP | 291666 | 12/1987 |
| JP | 149669 | 6/1988 |
| JP | 109359 | 4/1989 |
| JP | 22477 | 9/1989 |
| JP | 13968 | 1/1990 |
| JP | 79860 | 3/1990 |
| JP | 210459 | 8/1990 |
| JP | 28789 | 2/1991 |
| JP | 50559 | 3/1991 |
| JP | 65596 | 3/1992 |
| JP | 147152 | 5/1992 |
| JP | 100465 | 4/1993 |
| JP | 35221 | 2/1994 |
| JP | 52625 | 2/1999 |
| JP | 272014 | 10/1999 |
| JP | 2000-18144 | 1/2000 |

OTHER PUBLICATIONS

R. Grant & C. Grant, eds, *Grant & Hackh's Chemical Dictionary*, 5th Edition, McGraw–Hill Book Company (NY) (1987), p. 560.*

Japanese Patent Office Machine–Assisted Translation of JP 11–272014 (pub 10/99), Oct. 1999.*

Polymer Handbook, 2$^{nd}$ Ed., published by Wiley–Interscience, "The Glass Transition Temperatures of Polymers," (1971) (III–179)—(III–192).

Isganitis et al., Color Developer Composition, Xerox Disclosure Journal, vol. 8, No. 4, XP–002233591 (1983).

Patent Abstract of Japan, vol. 10, No. 271 (P–497) 1986 for JP61–093456A.

Patent Abstract of Japan, vol. 13, No. 251 (P–885) for JP01–54462 (1989).

* cited by examiner

*Primary Examiner*—Janis L. Dote
(74) *Attorney, Agent, or Firm*—Fitzpatrick, Cella, Harper & Scinto

(57) ABSTRACT

A color toner (magenta toner) showing not only color image forming performances such as color reproducibility, gradation characteristic, light-fastness, full-color image forming characteristic and a chargeability but also excellent in matching with various members of an electrophotographic apparatus is produced from a binder resin, a wax component and a specific monoazo pigment composition. The monoazo pigment composition is characterized by a principal monoazo pigment of a specific structure and specified amounts of a β-naphthol derivative and an aromatic amine, usable as materials for synthesizing the monoazo pigment.

26 Claims, 11 Drawing Sheets

TONER AND IMAGE FORMING METHOD

FIELD OF THE INVENTION AND RELATED ART

The present invention relates to a toner for use in an image forming method, such as electrophotography, electrostatic recording and toner jetting, and an image forming method using such a toner.

Hitherto, various electrophotographic image forming methods have been proposed, e.g., in U.S. Pat. Nos. 2,297,691; 3,666,363; and 4,071,361. Generally, in these methods, an electrical latent image is formed on a photosensitive member using a photoconductor material by various means and then developed with a toner to form a toner image. The toner image is transferred onto a transfer material such as paper, as desired, directly or indirectly, and fixed onto the transfer material, e.g., by heating, pressing or heating and pressing or with solvent vapor. Further, in the case of including such a step of transferring toner image, a step of removing the transfer residual toner onto the photosensitive member is generally included, and the above-mentioned steps are repeated for subsequent image forming cycles.

Particularly, in full-color image formation, electrostatic latent images and generally developed with a magenta toner, a cyan toner, a yellow toner and a black toner to form respective color toner images in superposition to reproduce multicolor images.

Further, in recent years, apparatus utilizing electrophotography have been used not only as copying machines for reproducing originals but also for printers for computers, personal copiers for individual users and facsimile apparatus using plain paper, thus being rapidly developed and various requirements being posed thereon. Also for copying machines, development to a higher functionality is being effected by digital image forming technique. Particularly, extensive development has been made regarding size reduction, higher speed and color image formation by the image forming apparatus, and further higher reliability and resolution are being strongly desired. For example, the required resolution which was at a level of 200–300 dpi (dots per inch) has been enhanced to 400–1200 dpi, and further to a level of 2400 dpi.

In contrast with such demands, it has been a general trend that image forming apparatus are designed to be composed of simpler parts and elements. As a result, further higher functionality is required of a toner, it is a present state that a better image forming apparatus cannot be accomplished without realization of further improved toner performances.

For example, in recent years, as a transfer device for electrostatically transferring a toner image on an (electrostatic latent) image-bearing member or an intermediate transfer member onto a transfer material, a so-called contact or abutting transfer device including a roller-shaped transfer member supplied with a voltage from an external supply and abutted against the image-bearing member or intermediate transfer member via the transfer material is being increasingly used from the viewpoints of size reduction of the enter image forming apparatus and prevention of ozone generation.

For such an abutting transfer device, the sphering of a toner particle shape is effective for providing an improved transferability and enhancing the durability against mechanical stress exerted by the device, but on the other hand, this results in smaller specific surface area and volume of toner particles, so that the dispersibility of a colorant inside the toner particles seriously affects the transferability and matching with the transfer device of the toner particle.

Further, in a conventional electrophotographic image forming apparatus, a corona discharger utilizing corona shower generated by applying a high DC voltage of 6–8 kV to a metal wire has been frequently used as a non-contact charging means for uniformly charging a surface of an image-bearing member such as a photosensitive drum as a member to be charged. Such a non-contact charging means is very effective as a means for uniformly charging the image-bearing member surface to a desired potential but leaves problems regarding size reduction of image forming apparatus, use of lower-voltage power supply, prevention of ozone generation, and longer life of photosensitive drum and charging device. For this reason, in recent years, a so-called contact charging means using a charging member contacting the image-bearing member and supplied with a prescribed voltage to charge the image-bearing member has been widely commercialized.

The charging member or charge-supply member used in such contact charging means may assume various forms inclusive of rollers, blades, brushes and magnetic brushes. Among these, an electroconductive roller-form charging member (hereinafter sometimes referred to as a "charging roller") has been preferably used from the viewpoint of charging stability.

The surface charging of a member to be charged by the contact charging means may be effected by (1) direct charge injection from the charging member to the member to be charged, or (2) minute discharge caused between the charging member and the member to be charged. For the former charging mechanism, the image-bearing member as a member to be charged has to be provided with a surface charge injection layer (chargeable layer), and for the latter mechanism, it is necessary to apply a bias voltage in excess of a discharge threshold voltage to the charging member.

In the case where the latter mechanism is used for providing a photosensitive member surface potential Vd (dark-part potential) required in latent image formation in an electrophotographic image forming method according to a DC-charging scheme of using a DC voltage component alone for application to the charging member, it is necessary to apply a DC voltage corresponding to the sum of Vd and Vth to the charging member such as a charging roller.

On the other hand, an AC-charging scheme of applying a bias voltage obtained by superposing an AC voltage component of at least 2×Vth with a DC voltage corresponding to a desired Vd is also known as disclosed in JP-A 63-149668. This is an excellent charging scheme for obtaining a charged state of the charged member which is less affected by environmental conditions by utilizing a smoothing effect of the AC voltage for charging the charged member to a potential Vd which is a central value of the AC voltage applied to the charged member. This charging scheme has left room for improvement regarding a size reduction of voltage supply and a longer life of photosensitive drum as the charged member.

For the above-mentioned contact charging means, it is necessary to provide an appropriate degree of intimate contact between the charging member and the charged member. Accordingly, the charging roller for example controls its abutting state against the charged member by having a resistance layer imparted with a moderate elasticity on an electro-conductive support, thereby aiming at an improved charge uniformity on the charged member and prevention of charge leakage due to pinholes or damages on the charged member. However, it is difficult to maintain such a good contact state between the charging member and the charged member, thus being liable to result in image defects due to charging failure which has been left as a problem to be solved. For example, if transfer residual toner remaining on the photosensitive drum surface is attached to the charging roller surface, the roller surface resistivity is locally increased to fail in uniform charging of the photosensitive drum surface, thus resulting in image defects, such as image fog, image density irregularity and streak image defects in worse cases.

The above-mentioned problems become pronounced in the case of using a small diameter photosensitive drum for which improvements in cleaning of transfer residual toner and intimate contact between the charging member and the drum as the charged member are difficult, or in the case of using a higher process speed, and have provided technical obstacles against the use of smaller image forming apparatus, and a lower voltage supply, a higher image quality and a higher durability. Moreover, these problems are pronounced in the DC-charging scheme showing less smoothing effect compared with the AC-charging scheme and are liable to be pronounced in a low temperature/low humidity environment.

On the other hand, in a fixing device for fixing a toner image onto a transfer material, there has been generally used a heat fixing means comprising a pair of heating roller as a rotatory heating member and a pressure roller as a rotatory pressing member (which may be inclusively called fixing roller(s)), and the heat fixing means requires an instantaneously generated large quantity of heat and a high pressing force for realizing a high-speed image formation. This is liable to be accompanied with difficulties, such as a larger size fixing device and longer start-up preheating time. In view of these points, a toner used in such an image forming apparatus should desirably show a high sharp-melting characteristic when heated. Such a toner can have not a low-temperature fixability but also a good color mixability in full-color image formation, thus providing a broader color reproducibility range of fixed images.

However, such a toner having a higher affinity with a fixing roller is liable to cause an offset phenomenon, i.e., transfer of the toner onto the fixing roller surface at the time of fixation, which is liable to be caused remarkably at the time of full-color image formation.

In order to obviate the above difficulties, it has been practiced to form a fixing roller surface of a material such as silicone rubber or a fluorine-containing resin showing good releasability with respect to the toner so as to prevent the toner attachment onto the fixing roller surface and, in addition thereto, to apply an offset-prevention liquid for the surface of preventing the offset phenomenon and also the deterioration of the fixing roller surface.

The above method is very effective for preventing the offset phenomenon but is accompanied with difficulties such that (1) the inclusion of a device for applying the offset-preventing liquid results in complication of the fixing device, thus obstructing the designing of a small-size and inexpensive image forming apparatus; (2) the applied offset-preventing liquid sinks in the fixing roller, thus being liable to induce peeling between the respective layers constituting the fixing roller and shorten the life of the fixing roller consequently; (3) the offset-prevention liquid attached to the fixed image provides a sticky touch to the fixed image and results in a lowering in transparency of the fixed image when a transparent film is used as the transfer film for an overhead projector (OHP), thus obstructing the reproduction of a desired roller; and (4) the offset-preventing liquid is liable to soil the interior of the image forming apparatus.

On the other hand, the transfer materials used in such image forming apparatus are also diversified inclusive of, e.g., papers having different basis weights and different starting materials and fillers. Among these transfer materials, some are liable to cause separation of the ingredients. The diversity of transfer materials seriously affects the fixing device, thus obstructing the smaller size and longer life of a fixing device.

Further, in some cases, some soiling substance originated from a transfer material forms a lump together with a toner, which sticks to the fixing roller, thus lowering the performance of the fixing device and impairing the product image quality due to peeling thereof.

More specifically, regenerated paper formed from regenerated pulp obtained from once-used paper after ink removable is being increasingly used from the ecological viewpoint. However, regenerated paper is liable to contain various impurities, of which the control is necessary for use in image forming apparatus as described above as proposed in JP-A 3-28789, JP-A 4-65596, JP-A 4-147152, JP-A 5-100465 and JP-A 6-35221.

Regenerated paper for general office use contains more than 70% of regenerated pulp from used paper of newspaper, and the content thereof is assumed to further increase, thus being liable to result in the above-mentioned difficulties. Further, in the case where the heating roller is equipped with a cleaning member for removing the fixing residual toner from its surface or a separation member for preventing the winding of the transfer material, it has been confirmed that the fixing roller surface is damaged with scars or abrasion or the functions of the cleaning member and the separation member are remarkably lowered due to medium-quality pulp fiber contained in paper dust liberated from regenerated paper from medium quality used-paper, such as that of newspaper or magazines. The above difficulties are liable to be serious in the case of using a fixing device using no or only a small amount of offset-preventing liquid.

As noted above, however, the application of an offset-preventing liquid onto a fixing roller surface of a fixing device is accompanied with several problems in spite of effectiveness thereof.

In view of the requirements of a smaller size and a smaller weight for image forming apparatus and quality of fixed images in recent years, it is preferred to remove even an auxiliary means for applying an offset-preventing liquid.

Under such circumstances, it is essential to develop a toner showing improved performances in heat-pressure fixation; and some proposals have been made for that purpose.

For example, many proposals have been made to add a wax component, such as low-molecular weight polyethylene or polypropylene, in a toner, based on the concept of supplying an offset-preventing liquid from inside the toner at the time of heating. In this case, in order to exhibit a sufficient effect, such a wax component has to be added in a large amount to the toner, and other difficulties, such as filming on the photosensitive member and soiling of the toner-carrying member, such as a particulate carrier or a sleeve, are liable to occur, thus causing image deterioration.

On the other hand, in the case of adding a small amount of such a wax component, it becomes necessary to equip a device for supplying some offset-preventing liquid or an auxiliary cleaning member, such as a takeup roll-type cleaning web or cleaning pad. Particularly, in the case of full-color image formation, the problem of inferior transparency or haze of the fixed image of the fixed image on a transparency film as a transfer material has not been solved.

Thus, while the inclusion of a wax component has been proposed in, e.g., JP-B 52-3304, JP-B 52-3305, JP-A 57-52574, JP-A 60-217366, JP-A 60-252360, JP-A 60-252361, JP-A 61-94062, JP-A 61-138259, JP-A 61-273554, JP-A 62-14166, JP-A 1-109359, JP-A 2-79860 and JP-A 3-50559, it has been difficult to achieve the high degree of improvement in performances required of a toner, by such proposal of wax component alone and sufficient matching with image forming apparatus adopting the heat-pressure fixing system has not been realized yet.

On the other hand, the use of various pigments and dyes as colorants is known in order to provide an improved color reproducibility of color toner images.

Particularly, a magenta toner is not only important for reproducing a red color to which human visual sensitivity is higher in combination with a yellow toner but also required to exhibit excellent developing performance in order to reproduce delicate tints of human skin colors. Further, a magenta toner is also required to show a good reproducibility of a secondary color of blue which is frequently used as a business color, in combination with a cyan toner.

Hitherto, for providing a magenta toner, it has been known to use quinacridone colorants, thioindigo colorants, xanthene colorants, monoazo colorants, perylene colorants, and diketopyrrolopyrole colorants, singly or in combination of two or more species.

For example, toners containing 2,9-dimethylquinacridone pigment (JP-B 49-46951), thioindigo pigment (JP-A 55-26574), xanthene dye (JP-A 59-57256), monoazo pigment (JP-A 11-272014), diketopyrrolopyrole pigment (JP-A 2-210459) and anthraquinone pigment (JP-B 55-42383), have been proposed respectively.

However, such colorants as mentioned above do not necessarily satisfy all requirements for providing a magenta toner. Particularly, many colorants for a magenta toner have poor dispersibility so that the dispersed particles thereof are liable to scatter incident light to result in lower transparency of fixed image and lower color reproducibility. Further, most of them have left room for improvement regarding toner tints, light-fastness, chargeability and matching with image forming apparatus.

JP-A 1-224777 has proposed the co-use of quinacridone organic pigment and xanthene dye, and JP-A 2-13968 has proposed the co-use of quinacridone and methine colorants, for providing clearer magenta color toners and improved chargeability and light-fastness of toners while preventing dyeing of a fixing roller such as a silicone rubber roller. Further, JP-A 62-291666 (corr. to U.S. Pat. No. 4,777,105) has proposed the use of quinacridone pigment in a mixture crystal state.

Further, JP-A 2000-18114 has proposed a toner using a color-adjusted pigment produced from dimethylquinacridone and a red pigment showing a negative chargeability or weak chargeability.

On the other hand, JP-A 11-52625 has proposed the co-use of a red pigment classified under C.I. Pigment Red 48, and a quinacridone pigment showing a b* value of −5 or below according to the L*a*b* colorimetric system in a mixing proportion of 2–30 wt. % with respect to the total pigments so as to provide a good magenta color toner while improving the chargeability and light-fastness of the toner and the thermal resistance of the fixing roller.

However, any of the toners containing the above-mentioned colorants have almost failed to pay consideration to influence of the colorants onto the abutting transfer performance and heat-pressure fixing performance. Particularly, no consideration has been paid to the case of using regenerated paper containing more than 70% of regenerated pulp as a transfer material, the case of color image formation requiring simultaneous fixation of plural toner layers or the case of using a fixing device wherein no or only a small amount of offset-preventing liquid is applied onto a fixing roller.

As described above, no toner can be said to be sufficient after overall consideration in connection with a colorant of system designing including the transfer scheme using the abutment transfer mode and the heat-pressure fixing scheme.

SUMMARY OF THE INVENTION

A generic object of the present invention is to provide a toner having solved the above-mentioned problems of the prior art.

A more specific object of the present invention is to provide a magenta toner excellent in color reproducibility, gradation characteristic, light-fastness and chargeability.

Another object of the present invention is to provide a magenta toner capable of forming a high resolution and high-definition fixed image.

Another object of the present invention is to provide a magenta toner capable of forming non-sticky high-quality full-color images at an excellent color reproducibility.

Another object of the present invention is to provide a magenta toner capable of forming a fixed image at an excellent-transparence on a transparency film.

Another object of the present invention is to provide an image forming method using a magenta toner as described above.

A further object of the present invention is to provide an image forming method capable of forming fixed images at a good fixing state on various qualities of transfer materials even by using a heat-pressure fixing means where only a small amount of or no offset-preventing liquid is applied onto a fixing member.

According to the present invention, there is provided a toner, comprising: at least a binder resin, a colorant and a wax component;

wherein the colorant comprises a monoazo pigment composition comprising a monoazo pigment represented by Formula (1) below, a β-naphthol derivative represented by Formula (2) below and an aromatic amine represented by Formula (3) below, the monoazo pigment composition is contained in a proportion of 1–20 wt. parts per 100 wt. parts of the binder resin, and the β-naphthol derivative and the aromatic amine are contained in proportions of 500–50,000 ppm and at most 200 ppm, respectively, based on the monoazo pigment composition;

Formula (1):

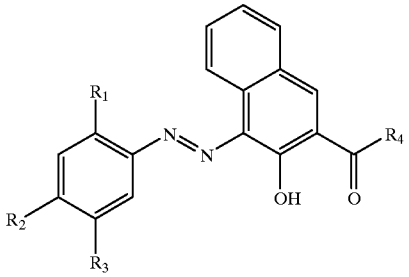

wherein R1–R3 independently denote a substituent selected from the group consisting of hydrogen, halogen, alkyl, alkoxy, nitro, anilido and sulfamoyl; R4 denotes a substitutent selected from the group consisting of —OH, —$NH_2$,

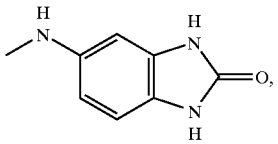

and

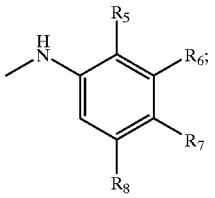

and R5–R8 independently denote a substituent selected from the group consisting of hydrogen, halogen, alkyl, alkoxy and nitro;

Formula (2):

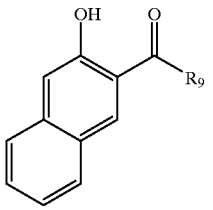

wherein R9 denotes a substituent selected from the same group as for R4,

Formula (3):

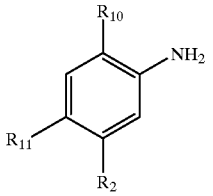

wherein R10–R12 independently denote a substituent selected from the same group as for R1–R3.

According to the present invention, there is also provided an image forming method, comprising:

(a) a charging step of charging an image-bearing member by means of a charging member supplied with a voltage form an external voltage supply, (b) a latent image forming step of forming an electrostatic image on the charged image-bearing member, (c) a developing step of developing the electrostatic image with the above-mentioned toner carried on a developer-carrying member to form a toner image on the image-bearing member, (d) a transfer step of transferring the toner image on the image-bearing member onto a transfer material via or without via an intermediate transfer member, (e) a cleaning step of removing transfer residual toner remaining on the image-bearing member, and (f) a fixing step of fixing the toner image onto the transfer material under application of heat and pressure from heat-pressure means.

In an embodiment of the present invention, in the above transfer step (d), a transfer member is abutted against the image-bearing member or the intermediate transfer member via the transfer material.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
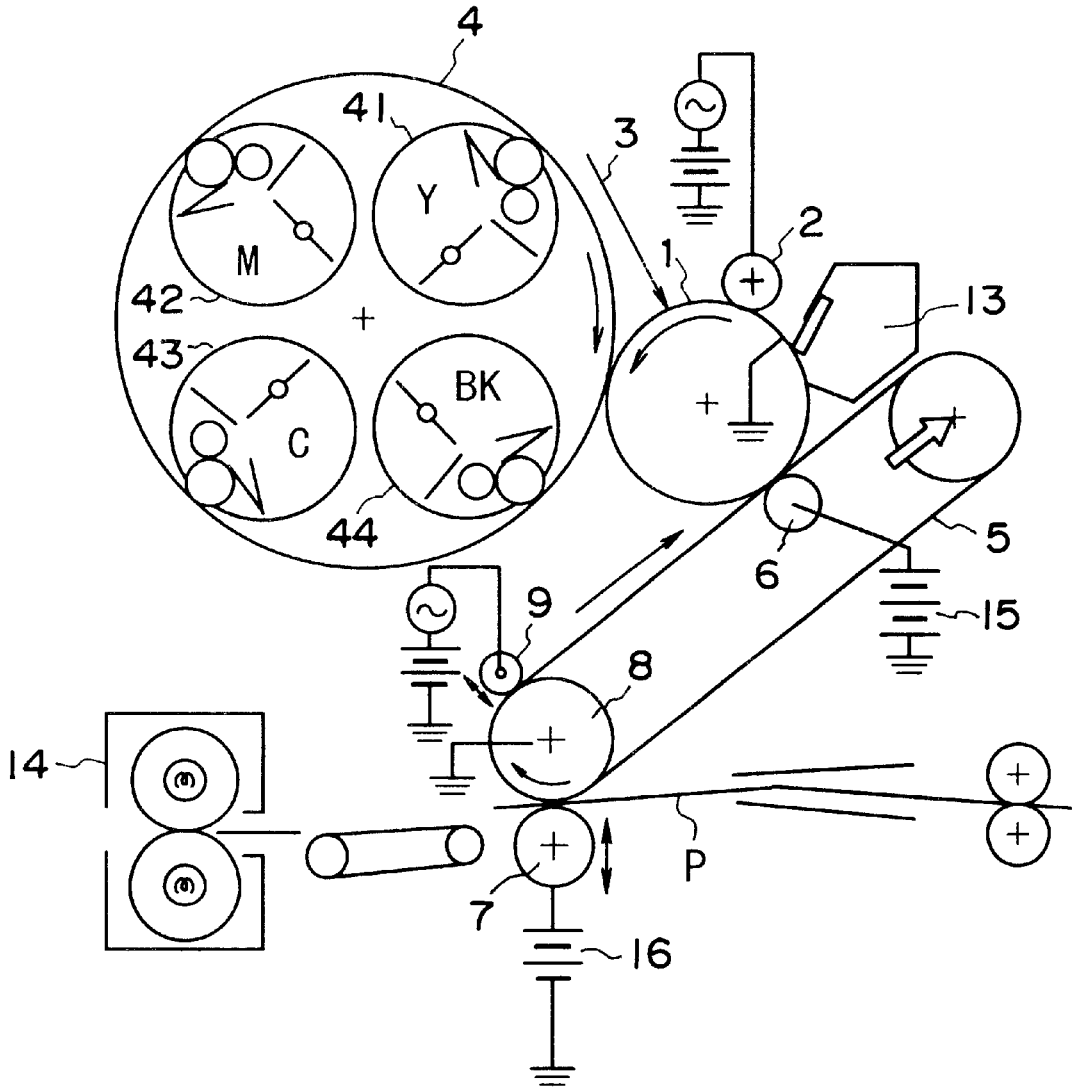
FIGS. 1 and 2 are respectively a schematic illustration of an example of full-color image forming apparatus suitable for practicing an embodiment of the image forming method according to the invention.

As a result of our study, it has been found possible to improve toner performances, inclusive of fixability, developing performance, tints, lightfastness and chargeability in good balance, and further provide improved matching with image forming apparatus, by accurately select and formulate colorants in a toner.

According to our knowledge, various performances of a toner can be remarkably improved if a specific β-naphthol derivative and a specific aromatic amine are co-present together with a specific monoazo pigment. While the reason therefor has not been clarified as yet, it is considered that the co-presence of specific amounts of the β-naphthol derivative and aromatic amine improves the surface state of the monoazo pigment particles, thereby synergistically improving the dispersibility in toner particles and contribution to chargeability of the monoazo pigment.

As the monoazo pigment, those having a structure represented by Formula (1) above are selected, and it is preferred to use one or more species in combination selected from C.I. Pigment Red 5, C.I. Pigment Red 31, C.I. Pigment Red 146, C.I. Pigment Red 147, C.I. Pigment Red 150, C.I. Pigment Red 176, C.I. Pigment Red 184 and C.I. Pigment Red 269 (according to Color Index, 4th Edition) in view of dispersibility in toner particles and the tint and chargeability of the resultant toner.

Among the above, C.I. Pigment Red 5, C.I. Pigment Red 31, C.I. Pigment Red 150, C.I. Pigment Red 176 and C.I. Pigment Red 269 are further preferred, and C.I. Pigment Red 150 and C.I. Pigment Red 269 are particularly preferred.

The monoazo pigment C.I. Pigment Red 269 is represented by the formula below:

C.I. Pigment Red 269

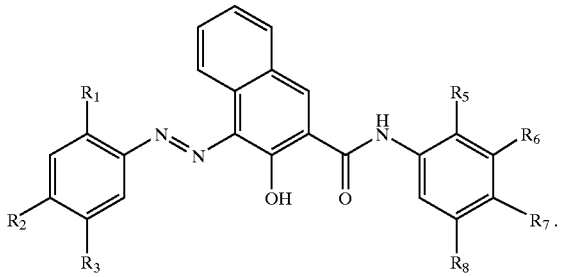

$R_1 = OCH_3$
$R_2 = H$
$R_3 = CONHC_6H_5$
$R_5 = OCH_3$
$R_6 = H$
$R_7 = H$
$R_8 = Cl$

The monoazo pigment C.I. Pigment Red 150 is represented by the formula below:

C.I. Pigment Red 150

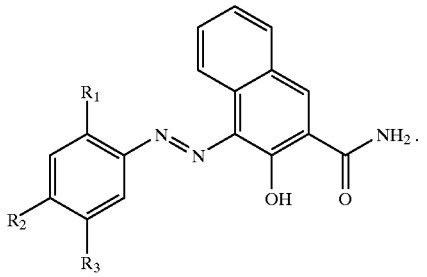

-continued $R_1 = OCH_3$
$R_2 = H$
$R_3 = CONHC_6H_5$

The monoazo pigment C.I. Pigment Red 176 is represented by the formula below:

C.I. Pigment Red 176

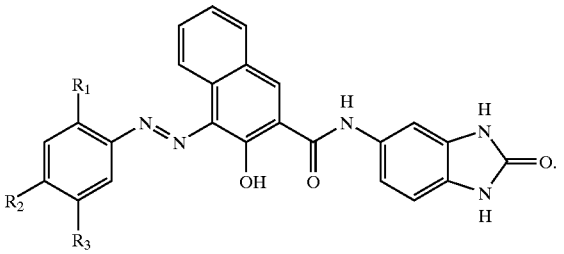

$R_1 = OCH_3$
$R_2 = H$
$R_3 = CONHC_6H_5$

The monoazo pigment C.I. Pigment Red 31 is represented by the formula below:

C.I. Pigment Red 31

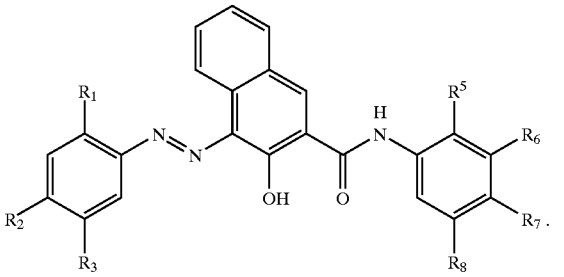

$R_1 = OCH_3$
$R_2 = H$
$R_3 = CONHC_6H_5$
$R_5 = H$
$R_6 = H$
$R_7 = H$
$R_8 = NO_2$

The monoazo pigment C.I. Red 5 is represented by a formula below:

C.I. Pigment Red 5

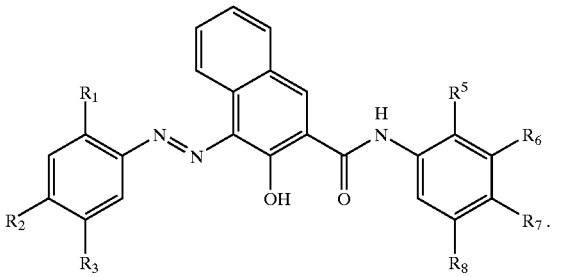

-continued $R_1 = OCH_3$
$R_2 = H$
$R_3 = SO_2N(C_2H_5)_2$
$R_5 = OCH_3$
$R_6 = H$
$R_7 = OCH_3$
$R_8 = Cl$ The content of the β-parallel derivative used together with the monoazo pigment is 500–50,000 ppm, preferably 500–30,000 ppm, more preferably 1,000–30,000 ppm, by weight of the monoazo pigment composition.

If the content of the β-naphthol derivative is below 500 ppm, the β-naphthol addition effects of improving the surface state of the monoazo pigment particles and improving the dispersibility and chargeability cannot be sufficiently developed. In excess of 50,000 ppm, the β-naphthol derivative per se is liable to adversely affect the tint and chargeability of the toner, thus causing inferior color reproducibility, fog and also lower resolution of the resultant images, so that it becomes difficult to obtain high-definition images. Further, the toner performances are liable to be effected by environmental conditions, and it becomes difficult to achieve the matching with the image forming method.

The content of the aromatic amine is at most 200 ppm, preferably 10–200 ppm, more preferably 10–100 ppm, further preferably 10–50 ppm, by weight of the monoazo pigment composition. If the content of the aromatic amine exceeds 200 ppm, the chargeability and the transferability of the resultant toner are lowered, thus being liable to result in fog and soiling of images. It becomes also difficult to achieve the matching with the image forming method.

The monoazo pigment composition is added to the toner in a proportion of 1–20 wt. parts, preferably 3–10 wt. parts, per 100 wt. parts of the binder resin. Below 1 wt. part, it becomes difficult to sufficiently achieve the function thereof as the colorant. On the other hand, in excess of 20 wt. parts, the colorant is excessively present in the toner particles, thus causing reagglomeration of the colorant. As a result, the fixability and chargeability of the toner, and also the transparency for OHP use, are adversely affected, and it becomes also difficult to achieve the matching with the image forming apparatus.

The contents of the β-naphthol derivative and the aromatic amine may be measured according to a known method, e.g., as follows.

100 mg of a sample monoazo pigment composition is accurately weighed into an Erlenmeyer flask, and 10 ml of chloroform is added thereto, followed by 2 hours of dispersion by means of an ultrasonic washing device ("BRANSON 5210", made by Yamato Kagaku K.K.), thereby producing a dispersion in chloroform. The dispersion is filtrated under sucking through a filter having an opening of 0.45 μm, and the residue on the filter is further rinsed with chloroform to obtain a solution of chloroform-soluble matter. Then, the chloroform solution is placed in a 50 ml-volumetric flask and diluted with chloroform up to a total volume of 50 ml to obtain a sample solution. The quantities of β-naphthol derivative and aromatic amine in the sample solution are measured by liquid chromatography under conditions described below. The quantitative measurement is repeated 5 times to provide averages thereof for calculating the respective contents in the sample monoazo pigment.

Apparatus: High-speed chromatography 'SERIES 1100", (made by Hewlett-Packard Corp.)

Column: "INERTSIL SIL 150A: 4.6 mm×150 mm" (made by GL Science Co.)

Sample volume: 50 μl

Detector: UV-Vis (250 mm)

Eluent: chloroform

Flow rate: 0.7 ml/min

Temperature: 25° C.

Calibration curve: Prepared based on quantitative analysis by using objective β-napthol derivative and aromatic amine.

The determination of the β-naphthol derivative and aromatic amine in a monoazo pigment composition contained in a toner may be effected by performing the above-mentioned measurement method by using an appropriate amount of the toner as a sample or by using the monoazo pigment composition after separation thereof from the toner by an appropriate method.

The above-mentioned effects of addition of the β-naphthol derivative and the aromatic amine are particularly pronounced, especially when the toner is used in an image forming method including a reversal development scheme using a negatively chargeable toner. Particularly, owing to quick controllability of toner charge state in a minute discharge region, it is possible to maintain a good state of matching with an image forming apparatus including image forming means utilizing minute discharge at a contact portion between a charging member supplied with a bias voltage and a member-to-be charged, e.g., contact charging means and abutting transfer means, cleaning means for recovering transfer residual toner remaining on an intermediate transfer member or a transfer material-carrying member, or developing and cleaning means for recovering transfer residual toner remaining on an image-bearing member in a developing step.

The control of the β-naphthol derivative and aromatic amine contents may be effected by, e.g., (1) a method of directly incorporating the necessary amounts of these compounds at the time of toner preparation, or (2) a method of causing the prescribed amounts of β-naphthol derivative and aromatic amine to remain in a monoazo pigment composition at the time of production of the monoazo pigment composition and adding the produced monoazo pigment composition as a colorant at the time of toner preparation. The latter method (2) is particularly advantageous since the β-naphthol derivative and aromatic amine are retained at a strong interaction with the monoazo pigment particle surfaces, so that the monoazo pigment particles are dispersed in the toner particles in a better dispersion state to improve various performances, such as the fixability, of the resultant toner.

In order to cause the prescribed amounts of β-naphthol derivative and aromatic amine in a monoazo pigment composition at the time of production of the monoazo pigment composition, it is necessary to strictly control the conditions in the steps of synthesis and purification of the pigment in appropriate combination.

The monoazo pigment composition used in the present invention may be synthesized through steps of forming a hydrochloric acid salt of an aromatic amine, converting the salt into a diazonium salt with sodium nitrite and subjecting the diazonium salt to coupling with a β-naphthol derivative.

In the case of controlling the prescribed contents of the β-naphthol derivative and aromatic amine, the residual content of the β-naphthol derivative depends on the reaction yield of the coupling, so that the content of the β-naphthol derivative can be controlled by controlling the ratio of the β-naphthol derivative and aromatic amine.

On the other hand, the residual content of an aromatic amine is affected not only by the reaction yield of the coupling but also by the reaction yield of conversion of the aromatic amine into the hydrochloric acid salt and then into diazonium salt.

At present, the residual aromatic amine content in a similar monoazo pigment composition commercially produced as a toner ingredient is at a level substantially exceeding 200 ppm. As a result of our study, it has been clarified that this is substantially attributable to a phenomenon that during a process of converting an aromatic amine into a hydrochloric acid salt thereof, the starting aromatic amine is taken into the hydrochloric acid salt crystal particles which are gradually precipitated in the reaction liquid with the progress of the reaction.

If yet-unreacted aromatic amine is taken in the hydrochloric acid salt in the step of forming the hydrochloric acid salt, it becomes very difficult to control the aromatic diamine content in the resultant pigment composition by a method of controlling a ratio of starting materials in the coupling step or a method of controlling the purification step.

On the other hand, in the case of using a very low concentration of reaction liquid for obviating the precipitation of the hydrochloric salt, it is difficult to ensure a commercially feasible level of productivity.

As a result of our further study, however, it has been found possible to suppress the seizure or taking-in of the yet-unreacted aromatic amine in the hydrochloric acid salt crystal particles by reducing the crystal particle size of the aromatic amine hydrochloric acid salt through successive change of methods of adding the starting materials into the reaction vessel and stirring conditions for controlling the rate of precipitation of the aromatic amine hydrochloric acid salt and the time of aging the hydrochloric acid salt, thus being able to control the residual aromatic amine content in the monoazo pigment composition in appropriate combination with the control of a pigment purification step described hereinbelow.

On the other hand, the control of the pigment purification step for controlling the prescribed residual contents of β-naphthol derivative and aromatic amine may be performed by controlling the pH and/or the amount of washing water for purifying the pigment.

For the purpose of the present invention, an alkaline region is preferred for removing the β-naphthol derivative and an acidic region is preferred for removing the aromatic amine. Accordingly, the monoazo pigment composition with the prescribed residual contents of β-naphthol derivative and aromatic diamine may be accomplished by alternative washing in an alkaline region and in an acidic region, followed by washing with a sufficient amount of water. However, the control of the residual aromatic amine content may be effectively achieved through combination with the above-mentioned optimization of the hydrochloric acid salt formation step.

It is a preferred embodiment of the present invention to use the above-mentioned monoazo pigment composition in combination with a quinacridone pigment composition represented by Formula (9) shown below:

Formula (9):

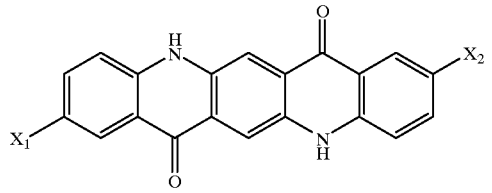

wherein $X_1$ and $X_2$ independently denote a substituent selected from the group consisting of hydrogen, halogen, alkyl and alkoxy.

Particularly, the remarkable improvement in the above-mentioned toner performances can be achieved if the monoazo pigment composition and the quinacridone pigment composition are contained in the toner in a weight ratio of the monoazo pigment composition: the quinacridone pigment composition=75:25–25:75.

Quinacridone pigment compositions generally exhibit very strong agglomeratability, and many of them are difficult to uniformly disperse in a toner. However, if such a quinacridone pigment composition is used in combination with the monoazo pigment composition used in the present invention in the above-mentioned ratio, the re-agglomeration thereof in the toner particles can be suppressed. More specifically, by the co-presence of the monoazo pigment composition and the quinacridone pigment composition having similar primary particle structures in toner particles, the re-agglomeration of the quinacridone pigment composition particles can be suppressed. Further, due to the co-presence effect due to interaction of the two pigment composition, the monoazo pigment composition and the quinacridone pigment composition are caused to be present closer to each other to form a relatively loose re-agglomeration state between the two pigment compositions, thereby realizing a state where the inherent performances of the pigment compositions are fully exhibited to provide toner particles with desirable color and chargeability and minimize the adverse influence on the fixability and the image forming apparatus according to our assumption.

As the quinacridone pigment composition, it is preferred to use C.I. Pigment Red 122, C.I. Pigment Red 202 or C.I. Pigment Violet (according to Color Index, 4th ED.). When used in combination with the monoazo pigment composition, these pigments can exhibit enhanced dispersibility in toner particles to improve the tint, chargeability and lightfastness of the resultant toner.

In the case of using both a monoazo pigment composition and a quinacridone pigment composition in combination, it is preferred to use 1–20 wt. parts, more preferably 3–10 wt. parts, as a total amount of the both pigment compositions per 100 wt. parts of the binder resin.

The monoazo and/or quinacridone pigment composition may have been treated in a known manner with a surface-treating agent or a rosin compound. Particularly, the treatment with a rosin compound is effective for preventing the reagglomeration to improve the dispersion thereof in the toner particles and provide a preferable state for chargeability of the resultant toner.

Examples of the rosin compound preferably used for treating the monoazo and/or quinacridone pigment composition may include: natural rosins, such as tall oil rosin, gum rosin and rod rosin; modified rosins, such as hydrogenated rosin, disproportionated rosin and polymerized rosin; synthetic rosin, such as styrene-acryl rosin; and alkali metal salts and ester derivatives of the above rosins.

It is particularly preferred to use a rosin compound selected from rosin acids, such as abietic acid, neoabietic acid, dehydro-abietic acid, dihydroabietic acid, pimaric acid, levo-pimaric acid and puistric acid, and alkali metal salts and esters of these rosin acids.

The treatment of a pigment composition with a rosin compound as mentioned above may be performed, e.g., by (1) dry blending of the rosin compound and the pigment composition, optionally followed by heat-treatment as by melt-kneading, or (2) by adding an alkaline solution of a rosin compound into a reaction liquid for producing the pigment composition, followed by infusibilization of the rosin compound by adding a salt of laking metal such as calcium, barium, strontium or manganese, to surface coat the pigment particles.

Such a rosin compound may be added in an amount providing a rosin compound content of 1–40 wt. %, preferably 5–30 wt. %, more preferably 10–20 wt. %, in the resultant pigment composition, so as to better exhibit the above-mentioned effects of the rosin treatment.

Examples of the toner binder resin used in the present invention may include those generally used, inclusive of styrene-(meth)acrylate copolymer, polyester resin, epoxy resin and styrene-butadiene copolymer.

Toner particles constituting the toner of the present invention may be formed directly through polymerization of a polymerizable monomer composition including a monomer, the pigment composition and a wax component. Examples of the monomer for providing the binder resin may include: styrene monomers, such as styrene, o- (m- or p-)methylstyrene, and m- (or p-)ethylstyrene; (meth)acrylate ester monomers, such as methyl (meth)acrylate, ethyl (meth) acrylate, propyl (meth)acrylate, butyl (meth)acrylate, octyl (meth)acrylate, dodecyl (meth)acrylate, stearyl (meth) acrylate, behenyl (meth)acrylate, 2-ethylhexyl (meth) acrylate, dimethylaminoethyl (meth)acrylate and diethylaminoethyl (meth)acrylate; butadiene, isoprene, cyclohexene, (meth)acrylonitrile, and acrylamide. These monomers may be used singly or in combination of two or more species so as to provide a theoretical glass transition temperature (Tg) of 40–75° C. according to "Polymer Hardbook, 2nd Ed. III", pp. 139–192 (published from John Wiley & Sons. Inc.). If Tg is below 40° C., the resultant toner is liable to have problems regarding the storage stability and continuous image forming performances. On the other hand, if Tg exceeds 75° C., the resultant toner is liable to have a higher fixing temperature, thus being liable to cause inferior fixability and color reproducibility.

In the present invention, it is preferred to use a crosslinking agent at the time of synthesizing the binder resin in order to provide toner particles with improved mechanical properties and color reproducibility.

Examples of bi-functional crosslinking agent usable for providing the toner of the present invention may include: divinylbenzene, bis(4-acryloxy-polyethoxyphenyl)propane; and diacrylates, such as ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycol #200, #400 and #600, dipropylene glycol diacrylate, polypropylene glycol diacrylate, and polyester-type diacrylate (e.g., "MANDA" made by Nippon Kayaku K.K.); and dimethacrylates corresponding to the above diacrylates.

Examples of polyfunctional crosslinking agent may include: polyacrylates, such as pentaerythritol triacrylate, trimethylolethane triacrylate, trimethylolpropane triacrylate, tetramethylolmethane tetraacrylate, and oligoester acrylates; polymethacrylates corresponding to the above polyacrylates; 2,2-bis(4-methacryloxy-polyethoxyphenyl)-propane, diallyl phthalate, triallyl cyanurate, triallyl isocyanurate, and triallyl trimellitate.

Such a crosslinking may preferably be used in a proportion of 0.05–10 wt. parts, more preferably 0.1–5 wt. parts, per 100 wt. parts of the monomer for synthesizing the binder resin.

In the present invention, it is also possible to use a polar resin, such as a polyester resin or a polycarbonate resin in addition to the above-mentioned binder resin. By adding such a polar resin in the toner, it is possible to realize a better dispersion state of the monoazo pigment composition (and also the quinacridone pigment composition) in the toner particles.

For example, in the case of producing toner particles directly by suspension polymerization, by adding such a polar resin in a period of from a dispersion step to the polymerization step, the polar resin may be controlled to form a thin layer thereof at the toner particle surfaces or provide a concentration gradient from the core to the surface of the toner particles depending on the balance of polarity given by the polymerizable monomer composition and the aqueous dispersion medium. In this instance, if a polar resin interacting with the monoazo pigment composition (and the quinacridone pigment composition) is used, it becomes possible to provide a desirable state of presence of the monoazo pigment composition (and the quinacridone pigment composition). It is preferred to use a polar resin exhibiting an acid value of 1–40 mgKOH/g.

Such a polar resin may preferably be added in an amount of 1–25 wt. parts, more preferably 2–15 wt. parts, per 100 wt. parts of the binder resin. Below 1 wt. part, the state of presence of the polar resin in the toner particles is liable to be non-uniform. On the other hand, in excess of 25 wt. parts, a rather thick layer of the polar resin is formed at toner particle surfaces. In both cases, it becomes difficult to control the state of presence of the monoazo pigment composition (and the quinacridone pigment composition) in the toner particle, thus being liable to fail in sufficiently attaining the functions of the pigment composition.

Such polar resins may be used singly or in combination of two or more species. For example, it is possible to simultaneously use two or more species of reactive polyester resins, two or more species of vinyl polymers or polymers of utterly different species, such as non-reactive polyester resin, epoxy resin; polycarbonate resin, polyolefin, polyvinyl acetate, polyvinyl chloride, polyalkyl vinyl ether, polyalkyl vinyl ketone, polystyrene, poly(meth)acryl ester, melamine formaldehyde resin, polyethylene terephthalate, nylon and polyurethane, as desired.

Examples of the wax component used in the present invention may include: petroleum waxes, such as paraffin wax, microcrystalline wax and petroleum and derivatives thereof; montan wax and derivatives thereof hydrocarbon wax according to Fischer-Tropsche process and derivatives thereof; polyolefin waxes, such as polyethylene wax, and derivatives thereof; natural waxes, such as carnauba wax and canderilla wax, and derivatives thereof; and the derivatives may include oxides, block copolymers with vinyl monomers, and graft-modified products. Further examples may include; alcohols, such as higher fatty alcohols; acid amide, esters, ketones, hardened castor oil and derivatives thereof, vegetable waxes and animal waxes. These wax compounds may be used singly or in combination of two or more species.

Among the above, polyolefin, hydrocarbon wax according to the Fischer-Tropsche process, petroleum waxes, higher alcohol waxes and higher ester waxes may be preferred so as to enhance the effects of improving the developing performance and transferability. These wax components can contain an antioxidant within an extent of not adversely affecting the toner chargeability.

It is particularly preferred to use an ester wax, and if an ester wax is used, it is possible to obtain good fixability as well as good compatibility with the above-mentioned monoazo pigment composition, thereby providing improved color reproducibility of the printed images and transparency for OHP use.

As examples of the ester wax, those represented by the following formula may be raised:

$$R_1—COO—R_2$$

wherein $R_1$ and $R_2$ are hydrocarbon groups each having 15–45 carbon atoms.

The wax component may preferably be used in an amount of 1–30 wt. parts per 100 wt. parts of the binder resin.

The wax component used in the present invention may preferably exhibit a thermal characteristic as represented by a DSC curve as measured according to ASTM D3418-82 showing a main heat absorption peak temperature (Tabs or Tmp (melting point)) in a range of 30–120° C., more preferably 40–90° C.

The use of a wax component showing the above-mentioned thermal characteristic may provide a toner with a good fixability and effectively exhibit the release effect thereof. It is also possible to ensure a sufficient fixable temperature range, thereby providing color images with good color reproducibility and obviate adverse effects on the developing performance, anti-blocking property and the image forming apparatus caused by the conventional wax component. The measurement of a main heat-absorption peak temperature (Tabs) of a wax component may for example be performed by using "DSC-7" (made by Perkin-Elmer Corp.). The temperature correction of the detector may be performed based on melting points of iridium and zinc, and the calory correction may be performed based on heat of fusion of irridium. For the measurement, a sample is placed on an aluminum pan and is heated at a rate of 10° C./min. in a temperature region of 20–180° C. with a blank aluminum pan as a control to obtain a DSC curve, from which a main heat-absorption peak temperature is determined. As a pre-treatment, the sample wax component is subjected to a cycle of heating-cooling under the same conditions as the measurement in order to remove the thermal history. A sample toner containing a wax component may be subjected to the measurement without such a pre-treatment.

In the toner particles according to the present invention, the wax component is dispersed in the form of substantially spherical and/or spindle-shaped disperse phase not mutually soluble with the matrix of the binder resin when observed as a sectional view through a transmission electron microscope (TEM).

The above-mentioned preferable state of dispersion of the wax component may preferably be defined as follows. From a particle size distribution based on circle-equivalent diameters as measured by using a flow particle image analyzer "FPIA-1000", (made by Toa Iyo Denshi K.K.), or a particle size distribution as measured by "COULTER COUNTER" (made by Coulter Electronics Inc.), a weight-average particle size is determined and denoted by D4 ($\mu$m).

Then, sliced toner particles embedded within an epoxy resin are photographed through a TEM to obtain photographs, and 20 toner particle cross section samples each having a longer-axis diameter R falling within a range of D4×0.9 to D4×1.1 are selected on the photographs. For each toner particle cross section showing a longer axis diameter R, a wax particle having the largest longer-axis diameter r among plural wax particles, if any, enclosed therein is selectively determined. For the 20 toner particle cross sectional views, an average ratio $(r/R)_{av.}$ is taken, and if the average is in the range of 0.05–0.95 (i.e., $0.05 \leqq (r/R)_{av.} \leqq 0.95$), the presence of wax particle(s) discretely or insolubly dispersed or enclosed within the matrix binder resin, is confirmed. This state may also be regarded as a dispersion in the form of an island of a spherical or spindle shape.

By establishing a wax dispersion or enclosure state as described above represented by $0.05 \leqq (r/R)_{av.} \leqq 0.95$, it becomes possible to disperse or dispose the pigment composition effectively in the toner particles, thus contributing to stable coloring and chargeability of the toner. Further, as the toner surface deterioration and soiling of the image forming apparatus can be prevented, the continuous image forming performances can be improved. Particularly, in the case of a dispersion state represented by $0.10 \leqq (r/R)_{av.} \leqq 0.80$ good chargeability is maintained, and it is possible to form toner images excellent in dot reproducibility or a long period. Further, as the wax component effectively functions on heat-pressure means as described hereinafter upon heating, the load on the heat-pressure means is effectively reduced without adversely affecting the coloring performances of the pigment composition, the low-temperature fixability and anti-offset characteristic are improved.

The cross section of toner particles defining the toner according to the present invention may be observed through a TEM in the following manner. Sample toner particles are sufficiently dispersed in a cold-setting epoxy resin, which is then hardened for 2 days at 40° C. The hardened product is then dyed with triruthenium tetroxide alone or in combination with triosmium tetroxide as desired and sliced into thin flakes by a microtome having a diamond cutter. The resultant thin flake samples in a number sufficient to provide a required number of toner particle cross sections are observed and photographed through a transmission electron microscope (TEM) at a magnification of e.g., $10^4$–$10^5$. The dyeing with triruthenium tetroxide, etc. may preferably be used in order to provide a contrast between the wax and the binder resin by utilizing some difference in crystallinity therebetween, thereby confirming a desired wax dispersion or enclosure state.

In addition to the monoazo pigment composition, the toner according to the present invention can contain a charge control agent, which may preferably be one providing a quick charging speed as well as a certain level of constant chargeability. In the case of direct production of toner particles through polymerization, it is preferred to use a charge control agent which does not obstruct the polymerization and is free from a matter soluble in the aqueous dispersion medium. Specific examples of negative charge control agents may include: metal compounds of carboxylic acids, such as salicylic acid, naphtoic acid, and dicarboxylic acids; polymeric compounds having a side chain including a sulfonic acid group or a carboxylic acid group, boron compounds, urea compounds, silicon compounds and calixarenes. Examples of positive charge control agent may include: quaternary ammonium salts, polymeric compounds having a side chain including such a quaternary ammonium salt, guanidine compounds, and imidazole compounds.

It is not essential for the toner of the present invention to contain a charge control agent, however, but the toner can omit such a charge control agent by utilizing triboelectrification with a carrier in the two-component developing method or by positively utilizing triboelectrification with a blade member or a sleeve member in the non-magnetic monocomponent developing method.

It is a preferred embodiment of the present invention to add inorganic fine powder to the toner so as to improve the developing performance, transferability, charging stability, flowability and continuous image forming performance. The inorganic fine powder may be known ones and may preferably be selected from silica, alumina, titania and complex oxides of these. It is further preferred to use silica. As the silica, it is possible to use both he dry-process silica (or fumed silica) formed by vapor phase oxidation of a silicon halide or alkoxide and the wet-process silica formed from silicon alkoxides, water glass, etc. It is however rather preferred to use the dry-process silica in view of less superficial or internal silanol groups and less production residues such as $Na_2O$ or $SO_3^{2-}$. In the dry-process silica production, it is also possible to use another metal halide such as aluminum chloride or titanium chloride together with a silicon halide to obtain fine powder of complex oxide of silica and another metal oxide, which can be used in the present invention as a species of silica.

The inorganic fine powder used in the present invention may exhibit good performances if it has a specific surface area as measured by the BET method according to nitrogen adsorption ($S_{BET}$) of at least 30 $m^2/g$, particularly 50–400 $m^2/g$, and may be added in an amount of 0.3–8 wt. parts, preferably 0.5–5 wt. parts, per 100 wt. parts of the toner particles.

By using inorganic fine powder having a controlled specific surface area as mentioned above, the moisture adsorption onto the toner particles can be suppressed to exhibit enhanced effects of control of the chargeability and charging speed even in the case where the monoazo pigment (or the quinacridone pigment) is present in proximity to the toner particle surface. Further, it is also possible to prevent the soiling and damage with the colorant of the image-bearing member and the intermediate transfer member, leading to image defects. Further, as an appropriate level of flowability is imparted to the toner, the uniform chargeability of the toner is synergistically improved, thus retaining the above-mentioned excellent effects even after image formation on a large number of sheets.

If the inorganic fine powder has a specific surface area of below 30 $m^2/g$, it is difficult to impart a sufficient flowability to the toner, and the effect of preventing soiling with the colorant of the toner-carrying member is lowered. On the other hand, if $S_{BET}$ is above 400 $m^2/g$, the inorganic fine powder is liable to be embedded at the toner particle surfaces, thus rather lowering the toner flowability in some cases.

It is further preferred to add an inorganic fine powder having a specific surface area of 50–150 $m^2/g$ and an inorganic fine powder having a specific surface area of 170–400 $m^2/g$ in a weight ratio of 5:95 to 50:50. This provides appropriate degrees of voids between toner particles and flowability, thus enhancing the performances of the toner of the present invention.

If the amount of the inorganic fine powder is below 0.3 wt. part (per 100 wt. parts of the toner particles), a sufficient effect of the addition is difficult to attain. In excess of 8 wt. parts, the toner is liable to be inferior in fixability and chargeability, and an increased amount of isolated inorganic fine powder is liable to obstruct the matching with the image forming apparatus.

It is possible and preferred that the inorganic fine powder used in the present invention has been treated with treating agents, such as silicone varnish, various modified silicone varnish, silicone oil, various modified silicone oil, silane coupling agents, silane coupling agents having a functional group, other organic silicone compounds, organic titanium compounds, and other treating agents, for the purpose of hydrophobization, chargeability control, etc.

The specific surfaces area ($S_{BET}$) described herein is based on values measured according to the BET multi-point method using nitrogen as an adsorbate gas on a sample powder surface by means of a specific surface area meter ('AUTOSORB 1", made by Yuasa Ionics K.K.).

It is particularly preferred that the inorganic fine powder used in the present invention has been treated with at least silicone oil in order to provide a toner retaining a high chargeability, and accomplishing a high transferability and good matching with the image forming apparatus.

The toner according to the present invention can further contain other additives within an extent of not exerting substantially adverse effects thereby. Examples of such additives may include: lubricant powder, such as powders of polytetrafluoroethylene, zinc stearate and polyvinylidene fluoride; abrasives, such as powders of cerium oxide, silicon carbide and strontium titanate; flowability improvers, such as powders of titanium oxide and aluminum oxide; anti-caking agents; electroconductivity-imparting agents, such as powders of carbon black, zinc oxide and tin oxide; and a developing performance improver comprising a small amount of organic fine particles or inorganic fine particles having a chargeability of an opposite polarity.

For constituting a two-component developer, the toner of the present invention may be blended with a magnetic carrier. The magnetic carrier may comprise particles of elements, such as iron, copper, zinc, nickel, cobalt, manganese and chromium alone, or in the form of oxides or complex ferrites. The magnetic carrier particles may have a spherical, flat or indefinite shape. It is also possible to control the surface microstructure, such as surface unevenness of the magnetic carrier particles. It is also suitable to use a resin-coated carrier obtained by surface-coating the above carrier particles with a resin. The carrier particles used may preferably have a weight-average particle size of 10–100 pm, more preferably 20–50 $\mu$m. The toner concentration in such a two-component developer obtained by mixing with the carrier may preferably be ca. 2–15 wt. %.

The toner according to the present invention may be produced through known processes, such as the pulverization process wherein starting ingredients, such as the binder resin, the monoazo pigment composition (and the quinacridone pigment composition) and the wax component are melt-kneaded by means of a pressure kneader, etc., and the kneaded product, after being cooled, is finely pulverized to a desired toner particle size, followed by classification into toner particles having a desired particle size distribution; processes for direct toner production according to suspension polymerization as disclosed in JP-B 36-10231, JP-A 59-53856 and JP-A 59-61842; the process for spraying a melt-kneaded material into the air by means of a disk or a multi-fluid nozzle to form a spherical toner disclosed in JP-B 56-13945; and emulsion processes as represented by soap-free polymerization.

Incidentally, a monoazo pigment composition or a quinacridone pigment composition added to a toner generally retains many hydrophobic functional groups. Accordingly, in the case of producing toner particles by polymerization by dispersed droplets of a polymerizable monomer composition containing a pigment in an aqueous dispersion medium, if a monoazo pigment composition or a quinacridone pigment composition is present alone, the pigment composition is moved to the boundary between the polymerizable monomer composition as the dispersed phase and the aqueous medium and is liable to cause reagglomeration in the vicinity of the toner particle surface. As described above, such reagglomerate of the monoazo or quinacridone pigment composition is liable to adversely affect the chargeability and charging speed of the resultant toner particles and obstruct the matching with the image forming apparatus.

In contact thereto, as a result of our study, it has been found possible to fix the monoazo pigment composition (and the quinacridone pigment composition) in a good dispersed state in the toner particles by specifying the formulation of the monoazo pigment composition (and also specifying the amount thereof in a specific ratio with the quinacridone pigment composition when the quinacridone pigment composition is further used), dispersing and mixing the specified pigment composition together with a portion of the polymerizable monomer composition, and then effecting the suspension polymerization for production of toner particles.

Particularly, by preliminarily dispersing and mixing the monoazo pigment composition together with a portion of the polymerizable monomer composition to form a pigment dispersion composition, and subjecting the pigment dispersion composition together with the remainder of the polymerizable monomer composition to toner production by suspension polymerization, it becomes possible to prevent the reagglomeration of the monoazo pigment composition (and the quinacridone pigment composition) caused when used alone and enclose the monoazo pigment composition (and the quinacridone pigment composition within the toner particles while retaining the interaction of the components, thus providing a toner with desirable chargeability and coloring characteristic and also remarkably improve matching with the image forming apparatus. These effects can be enhanced by incorporating a charge control agent or/and a polar resin as described above in the pigment dispersion composition.

In the toner production process by direct polymerization in an aqueous dispersion medium, it is possible to use an inorganic or/and an organic dispersing agent known heretofore as a dispersing agent contained in the aqueous dispersion medium.

Specific examples of the inorganic dispersing agent may include: calcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica and alumina. Examples of the organic dispersing agent may include: polyvinyl alcohol, gelatin, methyl cellulose, methyl hydroxypropyl cellulose, ethyl cellulose, carboxyethyl cellulose sodium salt, and starch.

Further, commercially available surfactants of the nonionic, anionic and cationic types can also be used. Examples thereof may include: sodium dodecylsulfate, sodium tetradecylsulfate, sodium pentadecylsulfate, sodium octylsulfate, sodium oleate, sodium laurate, potassium stearate and calcium oleate.

In the process for producing the toner according to the present invention, it is preferred to use a hardly water-soluble inorganic dispersing agent which is preferably soluble in acid. In preparation of the aqueous dispersion medium, such a hardly water-soluble inorganic dispersing agent may preferably be used in a proportion of 0.2–2.0 wt. parts per 100 wt. parts of the polymerizable monomer composition. Further, it is preferred to prepare the aqueous dispersion medium by using 300–3000 wt. parts of water per 100 wt. parts of the polymerizable monomer composition.

As such a hardly water-soluble inorganic dispersing agent, a commercially available dispersing agent can be used as it is. However, it is also possible to synthesize such a hardly water soluble inorganic dispersing agent in situ in an aqueous dispersion medium under high-speed stirring so as to form dispersing agent particles in a uniformly fine particle size. For example, fine particles of (tri)calcium phosphate suitably used as a dispersing agent may be formed by mixing a sodium phosphate aqueous solution and a calcium chloride aqueous solution under high-speed stirring.

According to the above-described process for producing the toner of the present invention, it is possible to easily obtain a toner capable of suppressing difficulties frequently encountered in a conventional toner containing a charge control agent, such as lowering in chargeability in a high humidity environment, lowering in charging speed in a low humidity environment and soiling of the toner carrying member.

The polymerizable monomer composition used for the toner production process may be prepared by mixing at least a polymerizable monomer, the monoazo pigment composition and a wax component, and preferably further the quinacridone pigment composition and a charge control agent, and optionally further several additives, as desired.

The polymerizable monomer may be prepared by appropriately mixing several species of polymerizable monomers, as described above, so as to provide a theoretical glass transition temperature (Tg) of 40–75° C. An excessively higher Tg is not preferred because when a color toner for full-color image formation is produced, the resultant toner is liable to show a lower color mixability with other toners and a poor color reproducibility, and also exhibit a lower transparency for OHP use.

A polymerization initiator may be used for polymerizing the polymerizable monomer in the polymerizable monomer composition. Examples thereof may include: azo- or diazo-polymerization initiators, such as 2,2'-azobis-(2,4-dimethylvaleronitrile), 2,2'-azobisisobutyronitrile, 1,1'-azobis (cyclohexane-1-carbonitrile), 2,2'-azobis-4-methoxy-2,4-dimethyl-valeronitrile and azobisisobutyronitrile; and peroxide initiators, such as benzoyl peroxide, methyl ethyl ketone peroxide, diisopropyl peroxycarbonate, cumene hydroperoxide, 2,4-dichlorobenzoyl peroxide, and lauroyl peroxide. These polymerization initiators may be used generally in an amount of 5–20 wt. parts per 100 wt. parts of the polymerizable monomer while it can vary depending on the objective degree of polymerization.

The polymerization initiators may be used singly or in mixture with reference to their 10-hour halflife temperature while it can vary depending on the polymerization process.

In the polymerizable monomer composition, it is also possible to further add a crosslinking agent, a chain transfer agent, a polymerization inhibitor, etc., in order to control the degree of polymerization. These additives may be added to the polymerizable monomer composition in advance or may be added, as desired, in the course of polymerization reaction.

Now, the image forming method according to the present invention will be described with reference to the drawings.

FIG. 1 illustrates an example of full-color image forming apparatus suitable for practicing an embodiment of the image forming method according to the invention wherein toner images successively formed on an image-bearing member are sequentially transferred as primary transfer onto an intermediate member to form superposed toner images thereon, which are then simultaneously transferred by secondary transfer onto a transfer material to form a multi-color image.

Referring to FIG. 1, a full-color image forming apparatus includes a 36 mm-dia. photosensitive drum 1 as an (electrostatic) image bearing member, which rotates in an indicated arrow direction.

A 9 mm-dia. primary charging roller 2 as a charging means is disposed in contact with the photosensitive drum 1 surface. The photosensitive drum 1 primarily charged by the primary charging roller 2 is exposed to laser light 3 emitted from an exposure device (not shown) depending on image signals to form an electrostatic latent image thereon.

A rotary developing unit 4 includes developing means for developing an electrostatic latent image formed on the photosensitive drum 1, more specifically a developing device 41 containing a first color toner and equipped with a 16 mm-dia. developing roller (as a toner-carrying member) carrying a thin layer of the toner on its surface, and similar developing devices 42, 43 and 44 containing second to fourth color toners, respectively. For example, the first color-developing device 41 contains a yellow toner; the second color-developing device 42 contains a magenta toner; the third color-developing device 43 contains a cyan toner; and the fourth color-developing device 44 contains a black toner. At the time of development, the rotary developing unit 4 is rotatively shifted in an indicated arrow direction to dispose the developing roller of one of the developing devices 41–44 in contact with the photosensitive drum 1 surface via a thin layer of associated toner, thereby effecting the development. After the development, the developing device is moved to separate the developing roller from the photosensitive drum 1. At that time, the other developing devices are placed in an operation-off state and do not act on the photosensitive drum 1, thus not affecting the development.

A first color-toner image formed by development on the photosensitive drum 1 is primarily transferred onto an outer surface of an intermediate transfer belt 5 (as an intermediate transfer member) driven in rotation in an indicated arrow direction at an identical circumferential speed as the photosensitive drum 1 by means of a primary transfer roller 6 (as a transfer means). The primary transfer roller 6 contacts a back surface of the transfer belt 5 so as to apply a primary transfer bias voltage supplied from a bias voltage supplied from a bias voltage application means 15.

The surface of the photosensitive drum 1 after completion of the transfer is subjected to cleaning for removal of transfer residual toner thereon by a cleaning device 13, and then subjected to an electrostatic latent image formation in a subsequent cycle.

Similarly as the above-mentioned first color toner image forming cycle, second to fourth color toner images are separately formed on the photosensitive drum 1and successively transferred onto the intermediate transfer belt 5 to form superposed color toner images corresponding to an objective color image.

The primary transfer bias voltage applied to the primary transfer roller 6 from the bias voltage application means is of a polarity opposite to that of the toner charge and set to, e.g., +100 V to 2 kV in the case of using a negatively chargeable toner, for the purpose of successive transfer of a toner image from the photosensitive drum 1 to the intermediate transfer belt 5.

Incidentally, it is also possible to use a transfer drum instead of the above-mentioned intermediate transfer belt 5. In this case, the toner image transfer from the photosensitive drum to the transfer drum may be effected based on a transfer current caused by applying a bias voltage to a core metal as a support member of the transfer drum from a bias voltage application means. Alternatively, it is also possible to use corona discharge or roller charging from the back side of the support member.

The superposed toner images formed on the intermediate transfer belt 5 are simultaneously subjected to secondary transfer onto a surface of a recording material P (as a transfer material) conveyed to a secondary transfer position by means of secondary transfer roller 7 (as a transfer means). The secondary transfer roller 7 is abutted against the back surface of the recording material P to apply a secondary bias voltage thereto from a bias voltage application means 16. The secondary transfer roller 7 is disposed below the intermediate transfer belt 5 separatably therefrom and opposite to an opposite roller 8 rotating with the transfer belt 5.

The toner images inclusively transferred onto the recording material P are thermally fixed onto the recording material P by means of a heat-fixing means 14 including a pair of a fixing roller and an opposite heating roller each provided with a heat-generating member.

Transfer residual toner remaining on the intermediate transfer belt 5 after the secondary transfer is charged by a bias charging device 9 to a polarity opposite to that of the photosensitive drum 1, so that the transfer residual toner is electrostatically back-transferred onto the photosensitive drum 1 to clean the surface of the intermediate transfer belt 5, and the transfer residual toner back-transferred to the photosensitive drum 1 is recovered by the cleaning device 13 to also clean the photosensitive drum 1surface. Thereafter, similar steps are repeated.

Due care should be given to the surface smoothness of the intermediate transfer belt 5. If the belt 5 has a surface roughness Ra (according to JIS B0601) in excess of 1 $\mu$m, the resultant images are liable to exhibit a lower reproducibility of halftone images and thin-line images. Further, the cleaning failure of the intermediate transfer belt is liable to occur due to insufficient back-transfer of transfer residual toner after the secondary transfer, thus being liable to leave a ghost in a subsequently formed image in continuous image formation. This problem is liable to be pronounced particularly in a digital image forming apparatus of 600 dpi or higher.

The intermediate transfer belt may be set to have a volume resistivity in a range of $1\times10^{6}$–$8\times10^{13}$ ohm.cm. Below $1\times10^{6}$ ohm.cm, it becomes difficult to obtain a sufficient transfer electric field, thus being liable to cause a problem regarding image reproducibility. In excess of $8\times10^{13}$ ohm.cm, a high transfer voltage becomes necessary, thus requiring a large bias voltage supply and incurring a cost increase.

The volume resistivity values of the intermediate transfer belt are based on values measured by using a resistance meter ("Ultra-high Resistance Meter R8340A", made by Advantest K.K.) and a sample box ("TR42", made by Advantest K.K.), including a main electrode of 25 mm in diameter, and a guard ring electrode of 41 mm in inner diameter and 49 mm in outer diameter.

The intermediate transfer belt may preferably exhibit an elasticity modulus of 500–4000 MPa when measured at an elongation of from 0.5% to 0.6%, so as to reduce the color deviation at the time of image formation. Above 4000 Mpa, the belt becomes excessively rigid, thus being liable to obstruct the smooth rotation and cause toner sticking.

The elasticity modulus values are based on values measured in the following manner. A sample of 20 mm in width and 100 mm in length in circumferential direction is cut from an intermediate transfer belt, and after measurement of the thickness (as an average of 5 measured values), is set in a tensile tester ("TENSILON RTC-1250A", made by Orientec K.K.) and subjected to measurement at a tensile rate of 5 mm/min. for a measurement interval of 50 mm. The elongation and stress are recorded on a recorder to read stress values at the elongations of 0.5% and 0.6%, thereby calculating an elasticity modulus according to the following equations. The elasticity value is recorded based on an average of 5 measured values obtained in this manner.

$$\text{Elasticity modulus [Mpa]}=(f2-f1)/(20\times t)\times 1000,$$

wherein f1: stress [N] at 0.5%-elongation, f2: stress [N] at 0.6%-elongation, and t: sample thickness [mm].

The intermediate transfer belt may preferably be designed to exhibit an breakage elongation (elongation at breakage) of 5–850%. Below 5%, the belt becomes excessively brittle, thus being liable to be broken at some elongation and exhibit a short life when placed under tension for a long period. A breakage elongation over 850% is excessive, thus being liable to cause elongation resulting in color deviation at the time of rotation of the transfer belt and also toner sticking.

The breakage elongation values are based on values measured in a tensile test similar to the above-mentioned test for the elasticity modulus except for increasing the tensile speed to 50 mm/min. to measure a displacement L [mm], from which a breakage elongation is calculated according to the following equation. Five measured values are averaged to provide a breakage elongation to be recorded.

$$\text{Breakage elongation [\%]}=(L/50)\times 100$$

The intermediate transfer belt may preferably have a thickness of 40–300 $\mu$m. A thickness below 40 $\mu$m is liable to cause instability of shaping resulting in a belt showing a thickness irregularity and insufficient durable strength, thus causing the breakage or cracking of the belt in some cases. A thickness above 300 $\mu$m causes a substantial peripheral speed difference between the inner and outer surfaces at a position around the tension drive shaft, thus being liable to cause image scattering thereon due to shrinkage of the outer surface. Further, it also causes difficulties, such as lowering in flexural durability, excessively high rigidity of the belt causing an increase in drive torque, and larger size and cost increase of the entire apparatus.

The intermediate transfer member can assume a form of intermediate transfer drum. Such an intermediate transfer drum may be prepared by covering the outer surface of a support with a holding member under tension or by coating a substrate with an elastic layer (of, e.g., nitrile-butadiene rubber) imparted with electroconductivity by inclusion of a conductivity-imparting material, such as carbon black, zinc oxide, tin oxide, silicon carbide or titanium oxide. The elastic layer formed on the support or substrate may preferably exhibit a hardness of 10–50 deg. (according to JIS K-6301).

In the image forming method according to the present invention, the chargeability of the toner can be retained at a high level by using the toner containing the specific monoazo pigment composition as a colorant, so that the toner can be uniformly applied on the toner-carrying member, such as a developing roller, thus allowing image formation at a high resolution and a high definition. Accordingly, it is particularly suitable to adopt a contact developing scheme using a mono-component developer.

Further, the use of the toner containing the specific monoazo pigment composition as a colorant also favors the secondary transfer of the toner image on the intermediate transfer member to a transfer material for minimizing the influence of the transfer step and providing high-quality full-color image.

Figure 2:
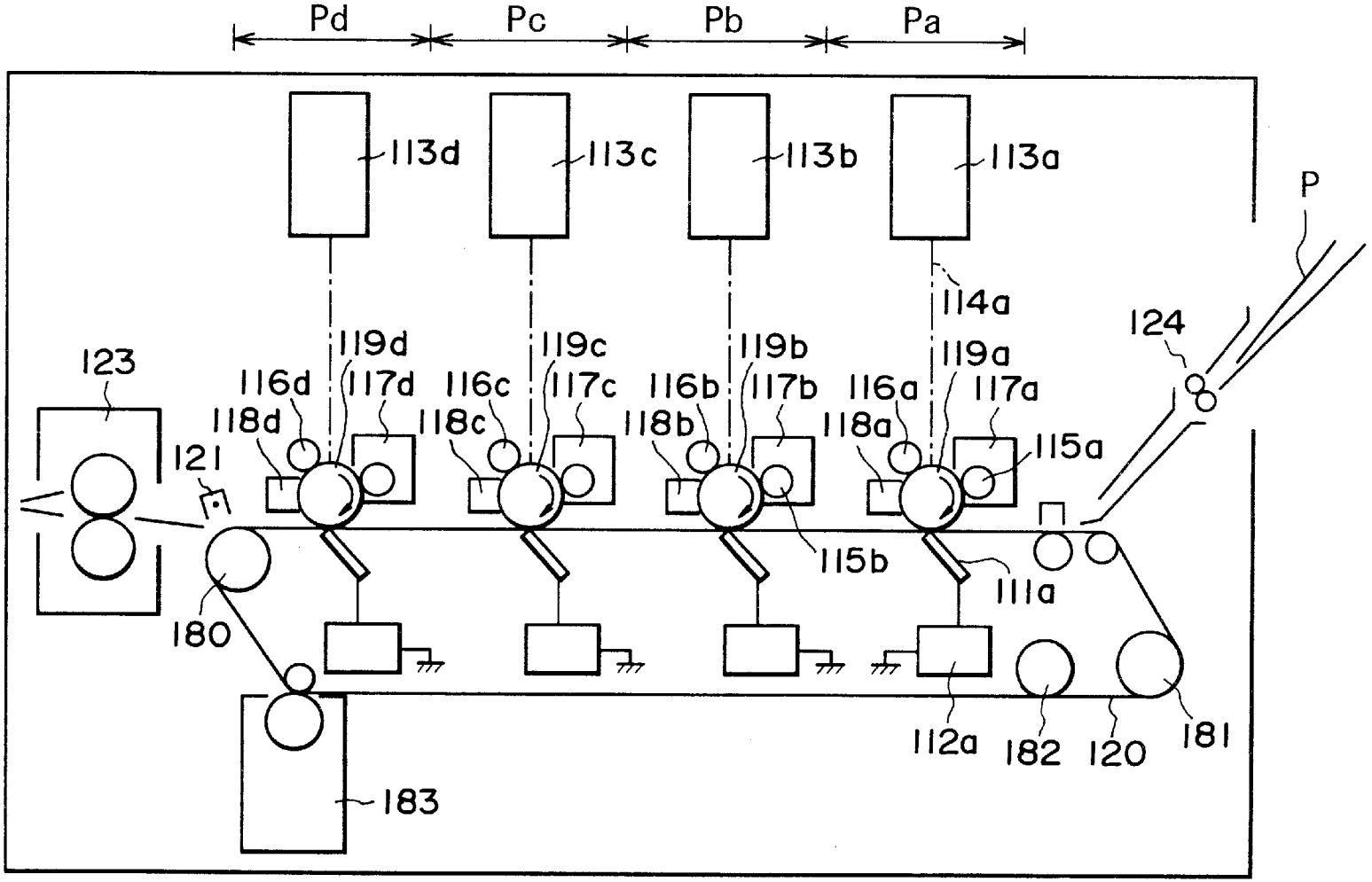

FIG. 2 illustrates a full-color image forming apparatus for practicing an image forming method according to the present invention where a plurality of image forming units are used to form respectively different colors of toner images which are successively transferred in superposition onto a single transfer material to form a multi-color image.

Referring to FIG. 2, a full-color image forming apparatus includes a first image forming unit Pa, a second image forming unit Pb, a third image forming unit Pc and a fourth image forming unit Pd juxtaposed in this order. Different colors of toner images are formed by development in the respective image forming units and then successively transferred onto a transfer material P conveyed by a transfer material conveyer belt 120, and then fixed under heat and pressure to form a full-color image.

The organization of each image forming unit is explained with reference to the first image forming unit Pa for example.

The first image forming unit Pa includes a 24 mm-dia. photosensitive drum 119*a* (as an (electrostatic latent) image-bearing member) which rotates in an indicated arrow direction.

A 12 mm-dia. primary charging roller 116*a* (as a charging means) is disposed in contact with the photosensitive drum 119*a* surface. The photosensitive drum 119*a* primarily charged uniformly by the primary changing roller 116*a* is exposed to laser light 114*a* emitted from an exposure device 113*a* depending on image signals to form an electrostatic latent image thereon.

A developing device 117*a* includes a developing means for developing the latent image on the photosensitive drum 119*a* to form a toner image thereon, wherein a 18 mm-dia. developing roller 115*a* carrying a thin layer of first color toner thereon is disposed in contact with the photosensitive drum 119*a* via the thin toner layer to form a first color toner image on the photosensitive drum 119*a*. The toner layer may be formed on the developer-carrying member by abutment of a toner layer-regulating member against the developer-carrying member.

The developing roller 115*a* (as a toner-carrying member) may preferably be rotated in a direction identical to that of the photosensitive drum 119*a* and so as to provide a surface moving speed which is 1.05 to 3.0 times that of the photosensitive drum 119*a* in the developing region.

The first color toner image formed on the photosensitive drum 119*a* is transferred onto a surface of transfer material P carried and conveyed by a belt-form transfer material-carrying member 120 by a transfer blade 111*a* (as a transfer means). The transfer blade 111*a* is abutted against the back surface of the transfer material-carrying member 120 and applies a transfer bias voltage supplied from a bias voltage supply 112*a*. In the transfer step, the toner imager is transferred on an image bearing member without an intermediate transfer member.

The surface of the photosensitive drum 119*a* after the transfer is subjected to cleaning for removal of transfer residual toner by a cleaning device 118*a* and subjected to a subsequent image forming cycle beginning with the electrostatic latent image formation.

The image forming apparatus of FIG. 2 further includes the second image forming unit Pb, the third image forming unit Pc and the fourth image forming unit Pd each having a similar organization as the first image forming unit Pa but containing its own color toner different in color from the first color toner in the unit Pa, which are successively disposed in juxtaposition with the first image forming unit Pa. For example, the first image forming unit Pa contains a yellow toner, the second image forming unit Pb contains a magenta toner, the third image forming unit Pc contains a cyan toner, and the fourth image forming unit Pd contains a black toner. The respective color toner images formed in the respective image forming units Pa–Pd are sequentially transferred onto a single transfer material P at the transfer position of the respective image forming units while moving the transfer material P in keeping registration with the operations in the respective units, thereby forming a superposition of the respective color toner images on the same transfer material. The transfer material P carrying the thus superposed color toner images is separated from the transfer material-carrying member 120 by a separation charger 121 and sent to a fixing device 123 by a conveyer means such as a conveyer belt, and fixed onto the transfer material P by a single fixing operation at the fixing device 123 to form a desired full-color image thereon.

In the apparatus of FIG. 2, the transfer material-carrying member 120 is in the form of an endless belt and is moved in an indicated arrow direction by a drive roller 180 in synchronism with the progress of the image formation in the respective units Pa–Pd. Along the movement path of the transfer-carrying member 120, there are further disposed a belt-following roller 181, a belt discharger 182 and a belt-cleaning device 183. Further, a pair of registration rollers 124 are disposed so as to supply transfer materials P in a transfer material holder to the transfer material-carrying member 120 in registration with the operations in the respective image forming units Pa–Pd.

In the image forming apparatus, it is possible to use a transfer roller or a non-contact charging means, such as a corona charger, as a transfer means instead of the transfer blade abutted against the back side of the transfer material-carrying member 120.

The transfer material-carrying member 120 may preferably comprise a conveyer belt formed of polyester fiber mesh or a thin dielectric sheet of, e.g., polyethylene terephthalate resin, polyimide resin, or urethane resin from the view points of easiness of processing and durability. It is also possible to use a drum-type conveyer means instead thereof.

In the above-mentioned image forming apparatus, the respective color toner images are sequentially transferred onto a single transfer material at the transfer positions of the respective image forming units, so that a toner image already transferred onto the transfer material in a previous image forming cycle is caused to contact a subsequent photosensitive drum carrying another color toner image. Accordingly, if some toner particles constituting the previously transferred toner image are in a non-stable charge state, the toner particles are liable to be transferred onto the subsequent photosensitive drum, thus causing a so-called "re-transfer" or "back-transfer" resulting in inferior image quality. However, the toner of the present invention containing the prescribed monoazo pigment composition is less liable to cause the problem because of improved charge stability.

The heat-pressure fixing means preferably used in the image forming method according to the present invention is used for fixing a toner image on a transfer material under application of heat and pressure to form a fixed image and is characterized by (i) including at least a rotatory heating member equipped with a heat-generator and a rotatory pressing member pressed against the rotatory heating member to form a nip therebetween, (ii) being supplied with an offset-preventing liquid to be supplied to a surface contacting a toner image on a transfer material at a rate of 0–0.025 mg/cm$^2$ (area of the transfer material) at the most and (iii) functioning to heat and press the toner image on the transfer material by the rotatory heating member and the rotatory pressing member while holding and conveying the transfer material by the nip.

The rotatory heating member constituting a part of the heat-pressure fixing means has a function of principally supplying heat for fixing a toner image on a transfer material and may be embodied as, e.g., (i) a cylindrical or tubular member containing a heat-generating member for imparting heat for fixing the toner image as used in the hot roller-type heat-pressure means, (ii) a cylindrical heat-resistant endless film member enclosing therein a fixedly supported heating member for imparting heat to the toner image and moved relative to the heating member while being pressed against the heating member, as used in the film-type heat-pressure means, or (iii) an endless cylindrical or tubular film or sheet member enclosing therein a magnetic field generating means and having a heat-generating member for imparting heat to the toner image by electromagnetic induction heating under the function of the magnetic field generating means, as used in the electromagnetic induction-type heat-pressure means.

On the other hand, the rotary pressing member is a member pressed against the rotatory heating member to form a nip and holding and coverying the transfer material by the nip for heating and pressing the toner image on the transfer material in cooperation with the rotary heating member.

As mentioned above, the rate of supply (i.e., consumption) of the offset-preventing liquid supplied to a surface contacting the toner image on the transfer material of the heat-pressure fixing device should preferably be suppressed to 0–0.025 mg/cm$^2$ (based on the area of the transfer material) at the most, or more preferably the offset-prevention oil is not supplied at all. As a result, it becomes possible to solve the above-mentioned problems accompanying the use of an offset-preventing liquid while maintaining the performances of the heat-pressure fixing means for a long period to obtain excellent fixed images by using the toner of the present invention.

The rate of consumption of offset-preventing liquid described herein is based on values measured in the following manner. Sheets of regenerated paper for ordinary office use (obtained by using at least 70% of regenerated pulp) having a size corresponding to maximum paper supply region of an objective heat-pressure fixing means are used. Then, an image forming test including a heat-pressure fixing operation is performed on 100 sheets of such regenerated paper, and the amount (mg) of offset-preventing liquid consumed in the test is divided by the total area (cm$^2$) of the regenerated paper sheets to provide a consumption rate (mg/cm$^2$).

As the offset-preventing liquid, it is possible to use a liquid which preferably retains its liquid state in a temperature range of from −15° C. to nearly 300° C. and shows releasability. Specific examples thereof may include: dimethylsilicone oil, modified silicone oils obtained by replacing a portion of the methyl groups of the dimethylsilicone oil with another substituent, and mixtures of these. The silicone oil can contain a small amount of surfactant and may preferably have a viscosity of 100–10,000 mm$^2$/s (cSt).

Such an offset-prevention liquid may be applied onto the fixing member by a known manner, e.g., by using application felt, a felt pad, a felt roller, a web, a pore fron rod, etc., impregnated with the liquid, or by direct application by means of an oil pan, a scooping roller, etc.

Some embodiments of the heat-pressure means suitably used in the image forming method of the present invention will be described with reference to drawings.

Figure 3:
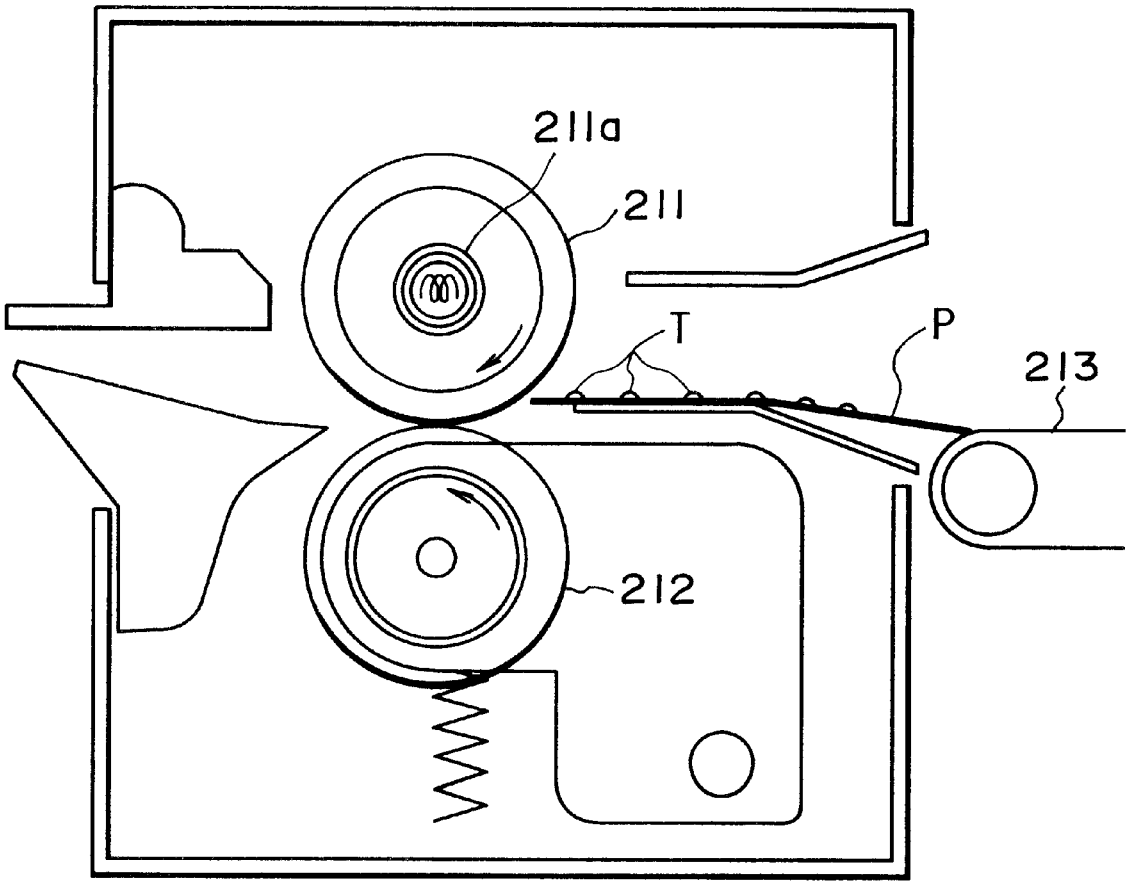
FIG. 3 is a schematic illustration of a hot roller-type heat-pressure means used in Examples.

FIG. 3 is a schematic illustration of a hot roller-type heat-pressure means including a cylindrical heating roller enclosing therein a heat-generating member as a rotary heating member, wherein the heating member is not equipped with a cleaning member for removing fixing residual toner from the surface thereof or a separation member for preventing winding-up of transfer material.

Referring to FIG. 3, a rotary heating member comprising a cylindrical heating roller 211 enclosing therein a heater 211*a* as a heat-generating member and a rotary pressing member comprising a cylindrical pressing member 212 are pressed to each other to form a nip and are rotated in respectively indicated arrow directions in operation.

A transfer material P (as a material to be heated) carrying a yet-unfixed toner image T is conveyed by a conveyer belt 213 from a rightward direction (upstream side) and heated under pressure at the nip between the heating roller 211 and the pressing roller 212 while being conveyed by nipping between the rollers, whereby a fixed image is formed on the transfer material P, which is then discharged leftwards (to the downstream side).

Figure 4A:
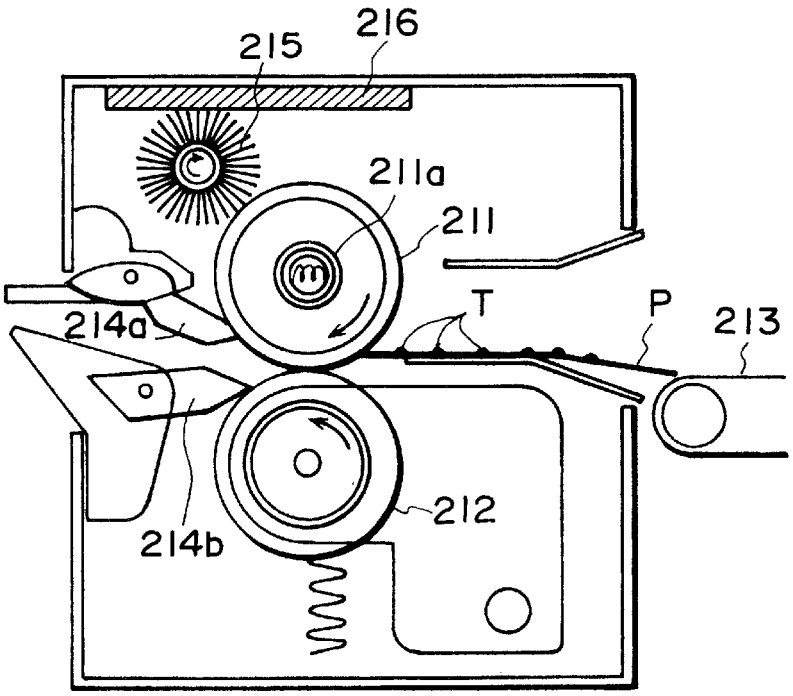
FIGS. 4A and 4B are schematic illustrations of fixing devices including hot roller-type heat-pressure means equipped with separation claws, and further with a cleaning brush roller and a cleaning roller impregnated with an offset-preventing liquid, respectively.
Figure 4B:
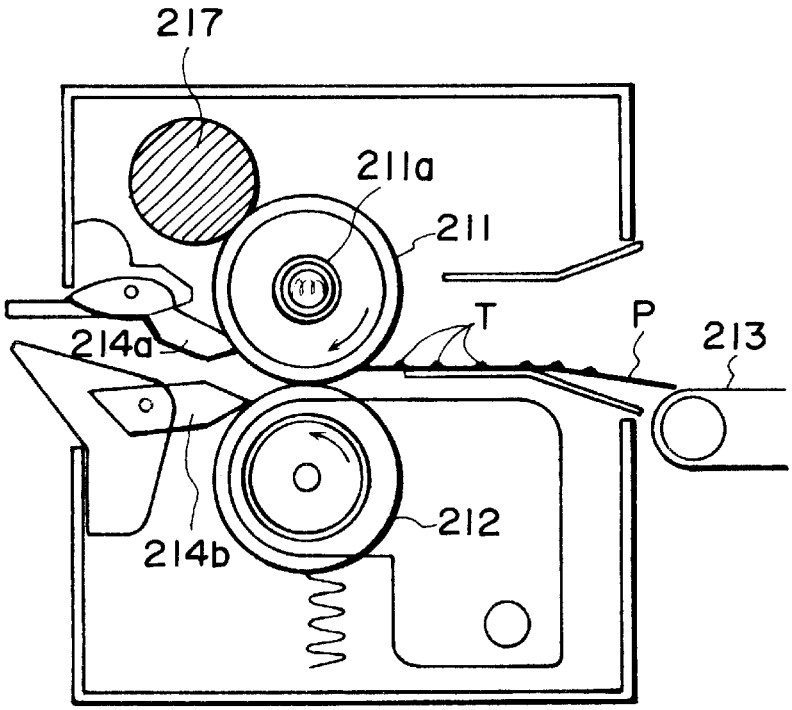

In the present invention, however, it is also possible to use a heat-pressure means as shown in FIGS. 4A and 4B, equipped with separation claws 214*a,* 214*b* for separating the transfer material P from the heating roller 211 and the pressure roller 212.

Further, the heating roller 211 in the heat-pressure means shown in FIG. 4A is further equipped with a cleaning roller 215 formed by cylindrically wound fiber brush for removing fixing residual toner remaining on and supplying an offset-preventing liquid to the surface of the heating roller 211 and a felt pad 216 impregnated with the offset-preventing liquid to be supplied via the brush roller 215 to the heating roller 211. On the other hand, the heating roller 211 in the heat-pressure means shown in FIG. 4B is equipped with a cleaning roller 217 disposed in contact therewith and impregnated with an offset-preventing liquid. In these cases, the oil supply rate is set so that the oil is consumed at a rate in a range of 0–0.025 mg/cm$^2$ (per area of transfer material supplied thereto). This holds true with the case of using heat-pressure means not equipped with separation claws as shown in FIGS. 4A and 4B.

Hitherto, such an offset-preventing liquid has been used also for surface protection of the heating roller and the pressure roller, and if the supply rate is set within the above-mentioned small supply rate range, the function thereof has been insufficient, thus being liable to result in damages, such as scars and peeling, and also lowering in releasability caused thereby, on the surfaces of the heating roller 211 and the pressure roller 212. By using such states of heat-pressure means, transfer materials are liable to be wound about the heating roller or pressure roller, and if separation means, such as the above-mentioned separation claws are removed, severe problems are liable to be caused. In the present invention, however, the load on the heat-pressure means is alleviated by using a toner containing a specified pigment composition, so that excellent fixed images can be continually obtained for a long period by using heat-pressure means not equipped with separation means even at no or only at a small supply rate as described of offset-preventing liquid.

The heating roller 211 may for example comprise a 2 to 5 μm-thick aluminum pipe as a core metal and a 200 to 500 μm-thick coating of silicone rubber or polytetrafluoroethylene on the outer surface of the core metal.

The pressure roller 212 may for example comprise a 10 mm-dia. stainless steel pipe coated with a ca. 3 μm-thick silicone rubber layer.

The heater 211*a* disposed inside the heating roller 211 may comprise, e.g., a tubular heat-generating heater, such as a halogen lamp, and generates radiation heat when supplied with a prescribed voltage, thereby heating the heating roller 211. In this instance, the heating roller 211 and the pressure roller 212 pressed thereto are relatively moderately heated, but as these rollers have large heat capacities, they are heated for long periods in many cases, so that the rollers 211 and 212 are liable to be thermally degraded. Particularly, in the case of using regenerated paper or applying little offset-preventing liquid, the heating roller 211 and the pressure roller 212 are liable to be damaged, so that the thermal degradation is promoted to result in serious problems due to a lowering in releasability of the roller surface. However, by using a toner containing a specified pigment composition, the load on the heat-pressure means is alleviated to allow the formation of excellent fixed images for a long period.

Figure 5A:
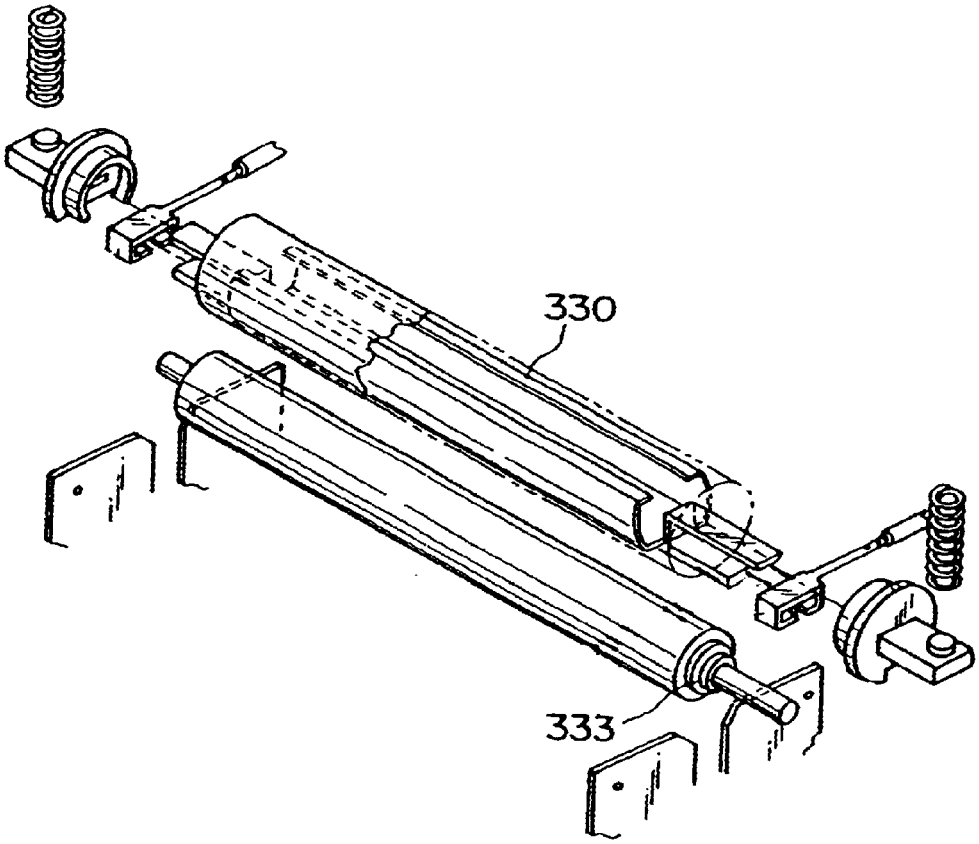
FIGS. 5A and 5B are respectively a partial exploded view and an enlarged transversal sectional view, respectively, of a vital part of a fixing device including a film-type heat-pressure means used in Examples.
Figure 5B:
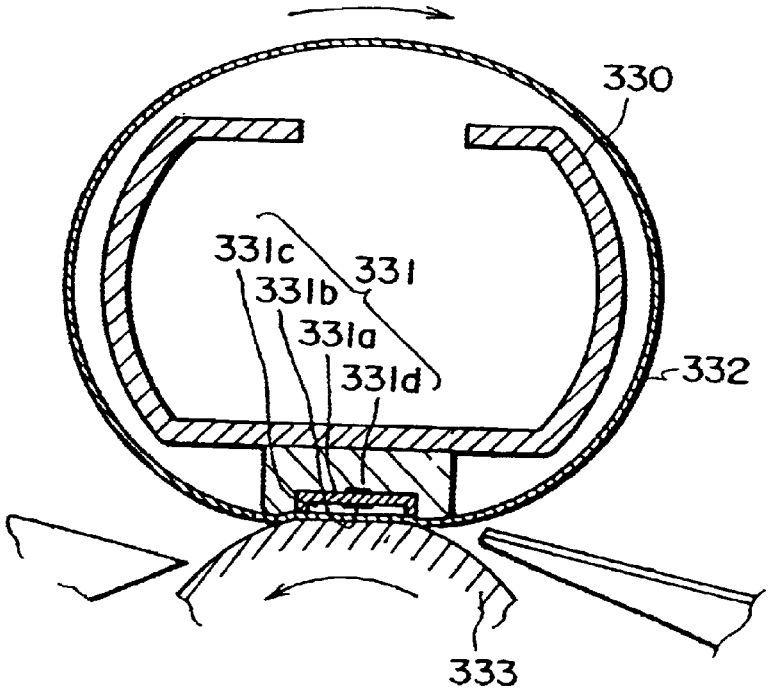

FIG. 5A is a partial exploded view of a film-type heat-pressure means including a rotary heating member which comprises a cylindrical heat-resistant endless film enclosing therein the heating member secured to a support and moved relative to the heating member while being pressed against the heating member, so that a toner image is heated and pressed via the film. FIG. 5B is an enlarged transversal sectional view of a vital part of the heat-pressure means.

Referring to these figures, a cylindrical heat-resistant endless film 332 (as a rotary heating member) enclosing therein a low-heat capacity heat-generating member 331 fixed to a support 330, and a pressure roller 333 (as a rotary heating member) are pressed to each other to form a nip therebetween and are rotated in respectively indicated arrow directions at the time of operation, thereby moving a transfer material (as material to be heated) carrying a toner image together with the endless film 332 while pressing the transfer material against the heating member 331 via the film 332 to heat-fix the toner image onto the transfer material.

The heating member 331 fixedly supported comprises a heater substrate 331*a*, a current-heat-generating resistance member (heat-generating member) 331*b,* a surface protection layer 331*c,* a temperature-detecting element 331*d,* etc.

The heater substrate 331*a* may preferably comprise a member which is heat-resistant, is insulating, has a low-heat capacity and has a high thermal conductivity, e.g., an aluminum substrate of 1 mm in thickness, 10 mm in width and 240 mm in length.

The heat-generating member 331*b* is formed, e.g., by screen printing, in a line or stripe of ca. 10 μm in thickness and a width of 1–3 mm of an electrically resistant material, such as Ag—Pd (silver-palladium), $Ta_2N$ or $RuO_2$ at a substantially central part on and along a longitudinal direction of a lower surface (opposite to the film 332) of the heater substrate 331*a,* and is coated with a surface protection layer 331*c* of ca. 10 μm-thick heat-resistant glass.

The temperature-detection element 331*d* may for example comprise a low-heat capacity-resistance member for temperature measurement, such as a Pt film formed, e.g., by screen printing, at a substantially central part on an upper surface (opposite surface with respect to the surface on which the heat-generating member 331*b* is disposed) of the heater substrate 331*a*. It is also possible to use a low-heat capacity thermistor, etc., in substitution therefor.

The heating member 331 supplies a current to the heat-generating member 331*b* to cause it to generate heat for substantially an entire length thereon at a prescribed timing depending on an image formation start signal supplied thereto.

An electricity of AC 100 volts is supplied thereto, and a supply power is controlled through control of a current supply phase angle by means of a current supply control circuit (not shown) including a triac depending on the detected temperature of the temperature-detection element 331*d*.

As the heat capacities of the heater substrate 331*a*, the heat-generating member 331*b* and the surface protection layer 331*c* are small, the surface temperature of the heating member 331 is quickly elevated to a prescribed fixing temperature by a current supply to the heat-generating member and is quickly cooled to a temperature proximity to room temperature when not used, so that a large heat impact is applied to the heat-resistant endless film 332 and the pressure roller 333. However, by using a toner having a prescribed pigment composition as described above, the load on these heat-pressure means are alleviated, thus allowing formation of excellent fixed images for a long period.

The cylindrical heat-resistant-endless film 332 disposed between the fixed heating member 331 and the pressure roller 333 may preferably comprise a 20 to 100 μm-thick heat resistant film of a single layer or composite layers, in view of heat resistance, strength to be ensured, durability and low-heat capacity. More specifically, the film 332 may comprise a film of, e.g., polyimide, polyetherimide (PEI), polyethersulfone (PES), tetrafluoroethylene-perfluoroalkyl vinyl ether copolymer resin (PFA), polyether ether ketone (PEEK), or polyparabanic acid (PPA), or a composite film of these, e.g., a 20 μm-thick polyimide film coated with an e.g., 10 μm-thick release coating layer of a fluorine-containing resin such as tetrafluoroethylene resin (PTFE), PFA or FEP, or silicone resin, optionally with an electro-conductive particulate materials, such as carbon black, graphite, or conductive whisker, on at least a surface contacting the toner image.

The pressure roller 333 (as a rotary pressing member) also functions as a drive roller for driving the heat-resistant endless film 332, so that it preferably exhibits not only releasability with respect to the toner, etc. but also an intimate contact with the endless film 332. The roller 333 may for example comprise an elastomer, such as silicone rubber. As mentioned above, a large heat impact is applied to the pressure roller 333, and the surface deterioration of the roller 333 affects the drive function of the heat-pressure means per se. However, by using a toner containing a specified pigment composition, the load on the heat-pressure means is alleviated, thus allowing the formation of excellent fixed images for a long period.

Figure 6:
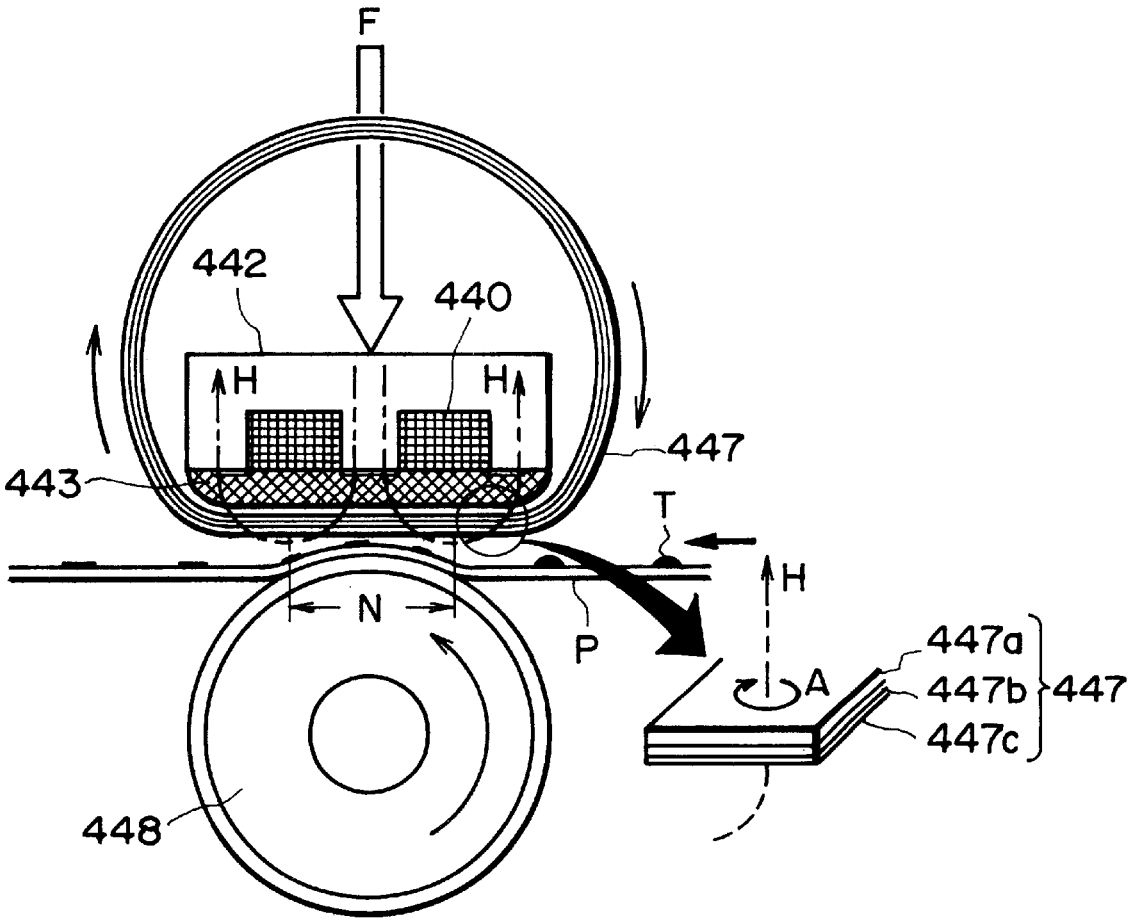
FIG. 6 is a schematic illustration of a fixing device including an electromagnetic induction-type heat-pressure means used in Examples.

FIG. 6 is a schematic illustration of an embodiment of electromagnetic induction-type heat-pressure means including a cylindrical heat-resistant endless film (as a rotary heating member) enclosing therein a magnetic field-generating means and having a heat-generating layer capable of heat generation by electromagnetic induction under the action of the magnetic field.

Referring to FIG. 6, a cylindrical heat-resistant endless film 447 (as a rotary heating member) encloses therein a magnetic field-generating means which comprises an exciting coil 440, a coil core (magnetic material) 442 about which the exciting coil is wound, and a slide plate 443 supporting the exciting coil 440 and also functioning as a guide for movement of the endless film 447. The cylindrical endless film 447 is moved while being pressed against the magnetic field generating means. On the other hand, a cylindrical pressure roller 448 (as a rotary pressing member) is pressed against the endless film 447 backed by the slide plate 443 to form a nip therebetween. In operation, the endless film 447 and the pressure roller 448 are rotated in respectively indicated arrow directions while moving a transfer material P (as a material to be heated) carrying a toner image T together and in intimate contact with the endless film 447 and pressing the transfer material P against the magnetic field generating means via the endless film 447.

In the magnetic field-generating means, by application of an alternating current at a frequency of 10 kHz to 500 kHz from an exciting circuit (not shown), magnetic fluxes H represented by arrows are repetitively generated and extinguished around the exciting coil 440. As a result, in a conductive layer (inductive magnetic material) 447*b* of the endless film 447 moving through the varying magnetic field, an eddy current as represented by an arrow A occurs so as to reduce the magnetic field change according to electromagnetic induction. The eddy current is converted into Joule's heat owing to the superficial resistance of the conductive layer 447*b*, so that the conductive layer 447*b* consequently functions as a heat-generating layer in the endless film 447. Thus, as the vicinity of the surface layer of the heat-resistant endless film 447 directly generates heat, a quick heating can be realized without being affected by the thermal conductivity and heat capacity of a film substrate 447*a* and the thickness of the endless film 447.

The transfer material P carrying the toner image T (as a material to be heated) is heated by the thus generated heat in the endless film 447 while being moved together with the endless film 447 through the nip N, whereby the toner image T is fixed onto the transfer material P.

The cylindrical heat-resistant endless film 447 may preferably comprise at least three layers including a film substrate layer 447*a*, a conductive layer 447*b* and a surface layer 447*c*. For example, the film substrate layer 447*a* may comprise a 10 to 100 μm-thick layer of a heat-resistant resin such as polyimide. The conductive layer 447*b* is formed on an outer surface (directed towerd the pressure roller 448) of the substrate layer 447*a* e.g., as a 1 to 100 μm-thick layer of a metal, such as Ni, Cu, Cr, etc., formed by plating, etc., and is further coated with a surface layer 447*c* of one or more species of heat-resistant resins showing good releasability with respect to a toner, such as PFA and PTFE. It is also possible to use a two-layered endless film by using a film substrate film 447*a* also functioning as a conductor layer.

The coil core 442 may be formed of a material showing a high permeability and a low residual magnetic flux density, such as ferrite or permalloy. By using a material showing a low residual magnetic flux density for the coil core 442, the occurrence of eddy current in the core per se and therefore the heat generation at the core 442 is suppressed to increase the efficiency. Further, by using a material showing a high permeability, the coil core 442 effectively functions as a path of magnetic flux H, thus minimizing magnetic flux leakage to the outside.

The exciting coil 440 is formed from a bundle of thin copper conductors each coated for insulation and by winding the bundle in plural turns. Alternatively, it is also possible to use a sheet-coil substrate comprising multiple layers of exciting coil patterns printed on a non-magnetic planar substrate sheet, such as a glass fiber-reinforced epoxy resin sheet (general purpose electrical substrate) or ceramic sheet.

The slide plate 443 may be formed of a heat-resistant resin, such as a liquid crystal polymer or phenolc resin, and may e coated on its surface facing the endless film 447 with a layer of resin, such as PFA or PTFE, or glass coating layer, rich in slidability for reducing frictional resistance with the endless film 447.

The pressure roller 448 is formed by covering an outer circumference of a core metal with a layer or a tube of silicone rubber or fluorine-containing rubber. The pressure roller 448 is pressed against a lower surface of the slide plate 448 via the endless film 447 at a prescribed pressing force F by shaft means and energizing means (both not shown), thus forming a nip N with the slide sheet 443 while sandwiching the endless film 447.

A magnetic field generated by the magnetic field generating means is concentrated at the nip N, so that the surface layer of the endless film 447 and its vicinity are quickly directly heated by electromagnetic induction heat-generation. As a result, the surface portion of the endless film 447 and the pressure roller are subjected to a large heat-impact, thus being liable to cause a lowering in releasability with respect to the toner, etc., and intimate contact between the endless film 447 and the pressure roller 448. However, by using a toner having a specific pigment composition, the load on the heat-pressure means can be alleviated, thus allowing formation of excellent fixed images for a long period.

Figure 9:
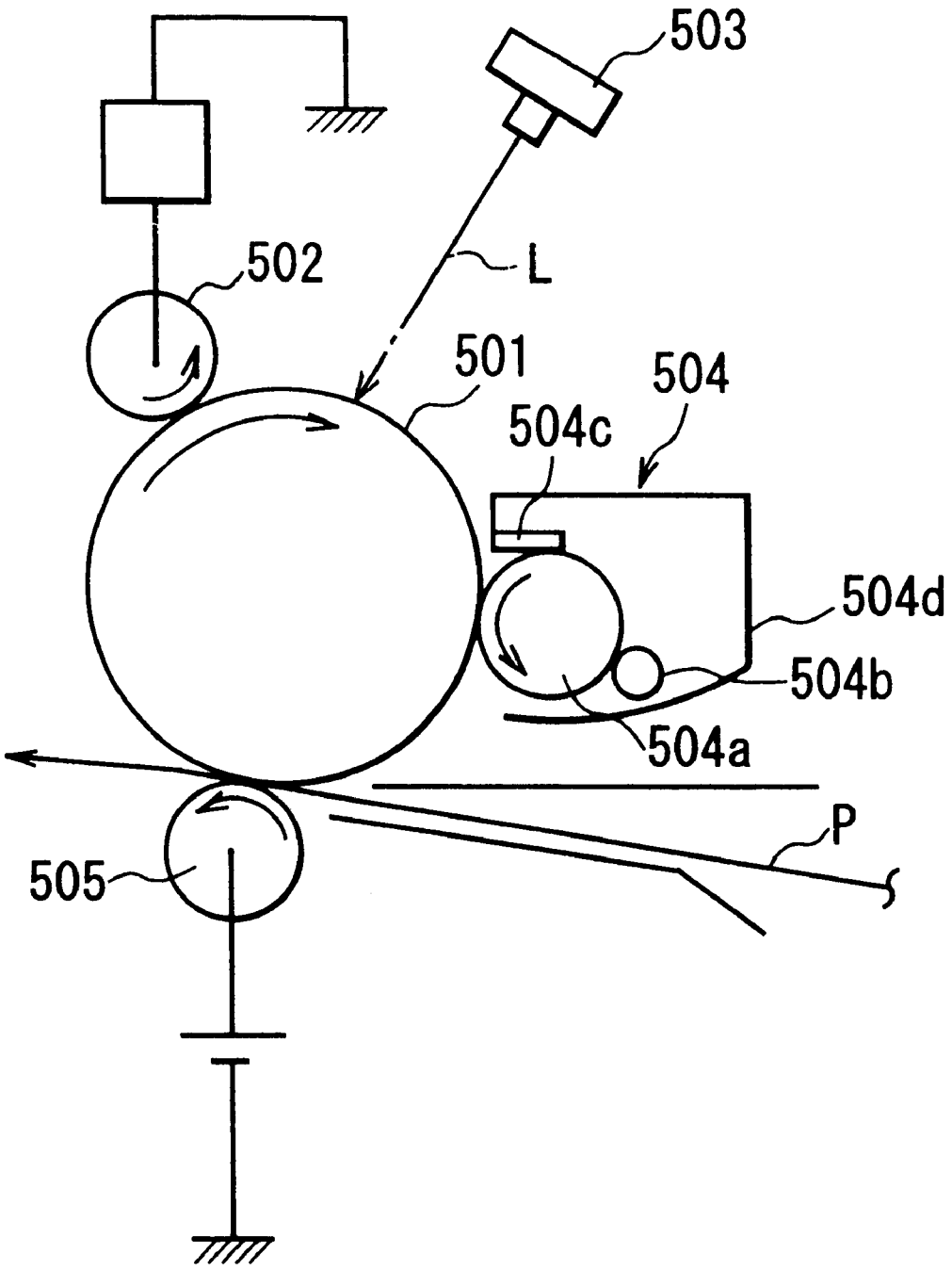
FIG. 9 illustrates an example of image forming apparatus suitable for practicing an embodiment of the image forming method according to the invention.

FIG. 9 illustrates an example of image forming apparatus suitable for practicing an embodiment of the image forming method according to the present invention.

Referring to FIG. 9, a photosensitive drum 501 (as an image-bearing member to be charged) rotates in an indicated arrow direction and is uniformly charged by a charging roller 502 (as a contact charging member) to a surface potential (dark-part potential: Vd) of, e.g., ca. −700 volts. Then, the charged photosensitive drum 501 is exposed to laser light L emitted from a latent image forming means 503 depending on image signals to form an electrostatic image including a surface potential (light-part potential: V1) of, e.g., ca. −100 volts at the exposed part.

The electrostatic latent image on the photosensitive drum 501 is developed with a toner supplied from a developing device 504 disposed in proximity to the photosensitive drum 501 as a unit in a process cartridge detachably mounted to a main assembly of the image forming apparatus, e.g., according to the reversal development mode, thereby forming a toner image on the photosensitive drum 501.

The toner image formed on the photosensitive drum 501 is then transferred onto a recording material P (as a transfer material) by a transfer roller 505 (transfer means) and then fixed onto the recording material P by a heat-pressure means (not shown).

Transfer residual toner remaining on the photosensitive drum 501 surface is scraped off by a cleaning blade (not shown) and recovered in a waste toner vessel (not shown), and the cleaned photosensitive drum 501 is subjected to a subsequent image forming cycle starting with the charging. The cleaning step can be effected substantially simultaneously with the developing step.

The developing device 504 comprises a developer vessel 504*d* containing a toner (as a monocomponent developer) and having an opening extending in its longitudinal direction, and includes a developing sleeve 504*a* (as a toner-carrying member) at the opening. The developing sleeve 504*a* is disposed opposite to the photosensitive drum 501 so as to develop an electrostatic latent image on the photosensitive drum 501.

As shown in FIG. 9, almost a right-half circumference of the developing sleeve 504*a* is enclosed within the developer vessel 504*d,* and almost a left-half circumference thereof is exposed out of the developer vessel 504*d* so as to face the photosensitive drum 501.

The developing sleeve 504*a* is rotated in an indicated arrow direction, and has an appropriate degree of surface unevenness for increasing the opportunity of friction with the toner to allow effective triboelectrification of the toner and good toner conveyance. The developing sleeve 504*a* may for example comprise a 16 mm-dia. aluminum-made sleeve surface-blasted and coated with a resinous coating layer comprising a mixture of conductive graphite particles, carbon black and phenolic resin in wt. ratio of 15:1:15 to have a surface roughness (Rz) of 0.5–10 $\mu$m. The developing sleeve 54*a* is disposed in proximity to the photosensitive drum 501 and driven in rotation to provide, e.g., a circumferential speed of 108 mm/sec relative to a circumferential speed of 72 mm/sec of the photosensitive drum 501.

Above the developing sleeve 504*a* is disposed an elastic blade 504*c* (as a toner-regulating member) comprising, e.g., a rubbery material, such as urethane rubber or silicone rubber, a thin metal sheet of SUS, phosphor bronze, etc., having a spring elasticity, or a substrate of these materials coated with a rubber sheet bonded onto its surface abutted with the developing sleeve 504*a.* The elastic blade 504*c* is secured at its one end to the developer vessel via a support metal sheet and a free end thereof is extended toward an upstream side of the rotation direction of the developing sleeve 504*a* so that its part near the free end tip is abutted against the developing sleeve 504*a* surface. The elastic blade 504*c* may comprise, e.g., a 1.0 mm-thick urethane rubber sheet bonded to the support metal sheet, and may be abutted against the developing sleeve 504*a* at an abutting pressure of, e.g., 24.5–34.3 N/m (25–35 g/cm).

Abutting pressures described herein are based on values measured in the following manner. Three thin metal sheets having a known frictional coefficient in superposition are inserted between objective two members abutted to each other, and a middle sheet among the three sheets is pulled out of the other sheets to measure a tensile load by means of a spring balance, etc. An abutting load and therefore an abutting pressure are calculated from the measured tensile load.

An elastic roller 504*b* is disposed in contact with the developing roller 504*a* at a position upstream of the abutting position between the elastic blade 504*c* and the developing sleeve with respect to the rotation direction of the developing sleeve 504*a,* and is rotatably supported. The elastic roller 504*b* may preferably have a structure comprising, e.g., a mass of foam sponge, or a fur brush of rayon or nylon fiber, etc., planted onto a core metal, in view of toner supply to and peeling of non-used toner from the developing sleeve 504*a*. For example, a 12 mm-dia. elastic roller formed by covering a core metal with polyurethane foam, is abutted against the developing sleeve 504*a* at an abutting width of 1–8 mm, and rotated with a certain relative speed with respect to the developing sleeve 504*a*. For example, the abutting width may be set to 3 mm, and the elastic roller 504*b* may be driven in rotation at a circumferential speed of 72 mm/sec (thus providing a relative speed of 180 mm/sec with respect to the developing sleeve) at a prescribed time of the developing operation by a drive means (not shown).

The free end portion of the elastic blade 504*c* is round-shaped so that its length NE measured from its abutting position against the developing sleeve 504 end to its free end front is gradually reduced from a laterally central part to both lateral edges and becomes substantially zero at both lateral edges, i.e., the free end fronts at the lateral edges are positioned in the region of the abutment between the blade 504*c* and the developing sleeve. As a result, as the toner layer regulation force is increased (to provide a smaller toner layer thickness) at a smaller length NE from the abutting position to the free end front, the tendency of the elastic blade 504*c* that its functions of toner supply and non-used toner peeling are liable to be weakened at both lateral end regions on the developing sleeve 504*a* can be compensated for by the increased regulation force at lateral edges of the elastic blade 504*c*.

At the time of image formation, the toner within the developing vessel 504*d* is moved to the vicinity of the developing sleeve 504*a* by rotation of a stirring member (not shown) and the elastic roller 504*b*, and applied onto the developing sleeve 504*a* surface while being triboelectrically charged by rubbing at the abutting position between the developing sleeve 504*a* and the elastic roller 504*c*. Thus, as the developing sleeve 504*a* is further rotated, the toner on the sleeve 504*a* is placed under pressing by the elastic blade 504*c* to receive a regulation force from the blade 504*c*, whereby a thin toner layer is formed, e.g., in a thickness of 10–20 $\mu$m and a coverage of 0.3–1.0 mg/cm$^2$, on the developing sleeve 504*a*.

In the image forming method of the present invention, it is preferred to use a contact charging means in the charging step, including a charging roller characterized by (i) comprising an electroconductive supported with at least one coating layer, (ii) having an outer diameter deviation not exceeding a roller crown and (iii) having a surface showing a static friction coefficient of at most 1.00 and a surface roughness (Rz) of at most 5.0 $\mu$m.

Figure 10:
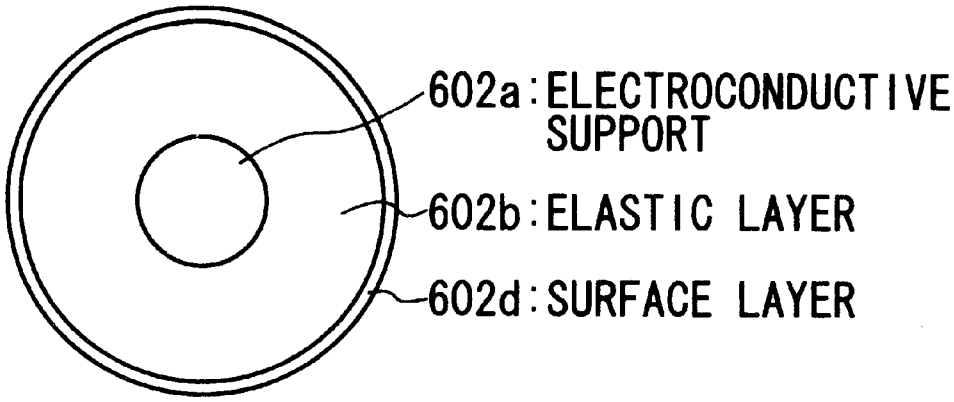
FIGS. 10–12 respectively illustrate an organization of a charging roller as a contact charging member.
Figure 11:
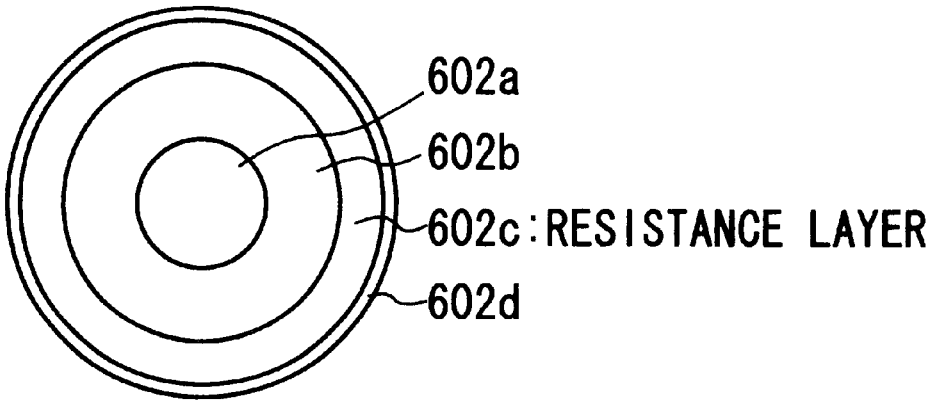
Figure 12:
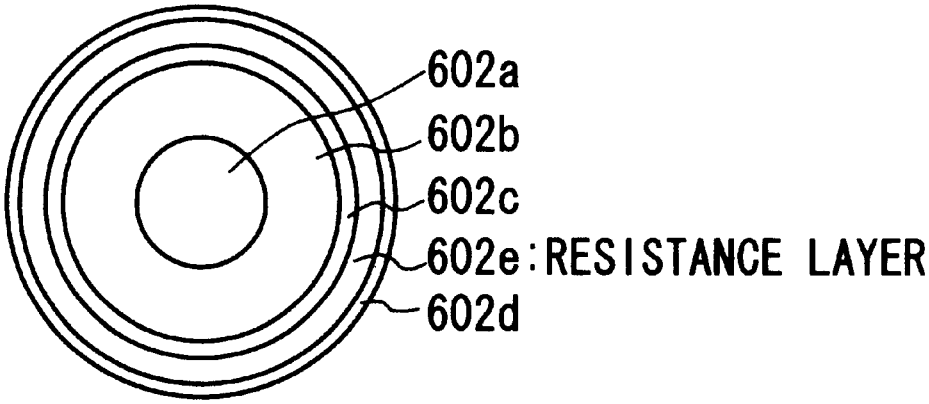

Some examples of such a charging roller are illustrated by transversal sectional views of FIGS. 10–12. For example, a charging roller shown in FIG. 10 comprises a cylindrical electroconductive support 602*a*, and an elastic layer 602*b* and a surface layer 602*d* successively coating an entire circumference of the support 602*a*. A roller shown in FIG. 11 has a three-coating layer-structure including a resistance layer 602*c* between the elastic layer 602*b* and the surface layer 602*d*. A roller shown in FIG. 12 has a four coating layer structure further including a second resistance layer 602*e* between the resistance layer 602*c* and the surface layer 602*d*. It is also possible to adopt a coating layer structure including more than four coating layers including an additional resistance layer.

The electroconductive support 602*a* may comprise a round bar of a metal material, such as iron, copper, stainless steel, aluminum or nickel, and optionally be further subjected to plating for the purpose of providing an improved scratch resistance.

The elastic layer 602 may preferably have appropriate degrees of electroconductivity and elasticity so as to ensure electricity supply to the photosensitive member (as a member-to-be charged) and good and uniform intimate contact of the charging roller with the photosensitive member. In order to increase the uniform and intimate contact between the charging roller and the photosensitive member, the charging roller may preferably have a so-called "crown shape" having a largest diameter at its longitudinal mid point and gradually smaller diameters toward both ends, by grinding the elastic layer 602*b*. A conventionally used charging roller is abutted to a photosensitive member under a pressing force applied at both ends, so that the pressing force acting along the roller length is smaller at the central part and larger at both ends. Accordingly, if the charging roller is not strictly straight along its length, the resultant images are liable to be accompanied with density irregularities between the parts corresponding to the central part and both ends of the charging roller. By forming the charging roller in a crown shape as mentioned above, it becomes possible to prevent the occurrence of such difficulties.

The elastic layer 602*b* may comprise an elastomer, such as a synthetic rubber or a thermoplastic elastomer. Examples of the synthetic rubber may include: vulcanized natural rubber, EPDM (ethylene-propylene-diene terpolymer), SBR (styrene-butadiene rubber), silicone rubber, urethane rubber, IR (ioprene rubber), BR (butyl rubber), NBR (nitrile butyl rubber), and CR (chloroprene rubber); and examples of thermoplastic elastomers may include: polyolefin thermoplastic elastomers, urethane thermoplastic elastomers, polystyrene thermoplastic elastomers, fluorine rubber thermoplastic elastomers, polyester thermoplastic elastomers, polyamide thermoplastic elastomers, polybutadiene thermoplastic elastomers, ethylene-vinyl acetate thermoplastic elastomers, polyvinyl chloride thermoplastic elastomers, and chlorinated polyethylene thermoplastic elastomers. A synthetic rubber material is preferred so as to provide uniform and intimate contact between the charging roller and the photosensitive member. In the DC-charging scheme, a polar rubber material showing little voltage-dependence is preferred, and epichlorohydrin rubber is particularly preferred.

These materials may be used singly or in mixture of two or more species, or in a copolymer form. It is also possible to use a foam body of the above-mentioned elastomer. It is further possible to add a softener oil or a plasticizer for appropriately adjusting the elasticity or the hardness.

The elastic layer 602 may preferably have a volume resistivity of below $10^8$ ohm.cm adjusted by adding a conductive material, such as carbon black, conductive metal oxides, alkali metal salts or ammonium salts. If the resistivity is $10^8$ ohm.cm or higher, the charging roller is caused to have a lower charging performance, so that uniform charging of the photosensitive member becomes difficult.

The surface layer 602*d* of the charging roller may comprise a resin or an elastomer. Examples of the resin may include: fluorine-containing resins, polyamide resins, acrylic resins, polyurethane resins, silicone resins, butyral resin, styrene-ethylene butylene-olefin copolymer (SEBC), and olefin-ethylene butylene-olefin copolymer. Examples of the elastomer may be similar to those used for the elastic layer 602*a*.

As the surface layer 602*d* of the charging roller contacts the photosensitive member to be charged, it is preferred to use a material suitable for preventing the soiling of the photosensitive member with itself or other materials and showing a good surface releasability. For this reason, a resin material as described above is preferred.

The surface layer 602*d* may preferably have an appropriately adjusted desirable resistivity by adding various conductive agents, examples thereof may include: carbon black, tin oxide, titanium oxide, zinc oxide, barium sulfate, copper, aluminum and nickel. The conductive agents can have been subjected to a surface treatment, such as treatment with a coupling agent or a fatty acid. The coupling agent may be a silane coupling agent or a titanate coupling agent. The fatty acid may representatively stearic acid. Such a surface treatment is preferably used for improving the dispersibility of the conductive agent in the surface layer. A specific example thereof may be tin oxide surface-treated with a titanate coupling agent. In order to obtain a desired resistivity value, it is possible to use two or more species of conductive agents as described above in combination.

The surface layer 602*d* may preferably have a resistivity which is higher than that of the elastic layer and is at most $10^{15}$ ohm.cm. If the resistivity is lower than that of the elastic layer, it becomes difficult to prevent charge leakage due to pinholes or scars possibly present at the surface of the charged member. Above $10^{15}$ ohm.cm, the charging performance of the charging roller is lowered, so that uniform charging becomes difficult.

The charging roller can include a resistance layer 602*c* adjacent to the elastic layer 602*b* so as to prevent the bleading-out to the charging roller surface of a softener oil, a plasticizer, etc., added to the elastic layer 602*b*.

The resistance layer 602*c* may comprise a similar material as in the elastic layer 602*b*. The resistance layer may preferably have electro-conductivity or semiconductivity. For providing a desirable resistivity, it is possible to add one or more of conductive agents as enumerated above for the surface layer 602*d*.

The resistance layer 602*c* may preferably have a resistivity which is not higher than that of the surface layer 602*d* and not lower than that of the elastic layer 602*b*. Outside the range, it becomes difficult to provide a uniform charging performance.

The above-mentioned elastic layer, surface layer and resistance layer can respectively contain another functional material, as desired, in addition to the above-mentioned materials. Examples of such other materials may include: an anti-aging agent, such as 2-mercapto-benzimidazole, and a lubricant as represented by stearic acid and zinc stearate.

The resistivity values described herein for the elastic layer, surface layer and resistance layer constituting the charging roller are based on values measured by using a resistance meter (HIRESTA-UP", made by Mitsubishi Kagaku K.K.).

More specifically, for the elastic layer, a material constituting the resistance layer is molded in a thickness of 2 mm, and for the surface layer and the resistance layer, the materials constituting the respective layers are formed into paints and the paints are applied onto aluminum sheets. The thus obtained respective samples are subjected to measurement of resistivities by applying a voltage of 10 volts for 1 min. in an environment of 23° C./55% RH.

Incidentally, the elastic layer, the surface layer and the resistance layer constituting charging layer may be formed according to any appropriate methods for providing the respective layers in appropriate thicknesses, e.g., by using various known methods for forming resinous layers. For example, each layer may be formed by applying a sheet or a tube of a prescribed thickness prepared in advance onto a substrate by bonding or covering (or insertion), by a coating method such as electrostatic spraying or dipping, or by another known layer forming method, with appropriate modification as desired. It is also possible to provide a rough shape of layer by extrusion, followed by polishing, etc., for shape adjustment. Shaping and curing in a mold for providing a prescribed shape can also be used.

The elastic layer, surface layer and resistance layer constituting the charging roller may have any thickness as far as the functions of the respective layers are not obstructed thereby. For example, however, the elastic layer may preferably have a thickness of at least 0.5 mm. Below 0.5 mm, the elastic layer is liable to fail in exhibiting an appropriate degree of elasticity, so that it becomes difficult to accomplish uniform and intimate contact, and also a uniform charging performance.

On the other hand, the surface layer and the resistance layer may preferably have a thickness of 1–1000 $\mu$m for each layer. At a smaller thickness, the layer thickness irregularity is liable to occur in preparation of the charging roller, and the unevennesses of the elastic layer is liable to appear in the charging roller surface as they are. As a result, the uniform intimate contact characteristic is impaired, to be liable to fail in exhibiting uniform charging performance, and transfer residual toner particles and external additive are liable to be attached to the charging roller surface. On the other hand, at a larger thickness, the appropriate degree of elasticity provided to the elastic layer is impaired, so that the intimate contact with the charged member is impaired, thus being liable to fail in exhibiting uniform charging performance.

The thicknesses of the elastic layer, the surface layer and the resistance layer constituting the charging roller may be measured by cutting these coating layers on the substrate and observing the cut layer sections through an optical microscope.

Next, preferable features of the charging member (charging roller) are supplemented.

Even when a charging roller as described above is used, as the degree of uniform and intimate contact between the charging roller and the photosensitive member is enhanced for the purpose of improved uniform charging of a photosensitive member, it becomes difficult to maintain a good image forming state realized at the initial stage for a long period as the attachment of transfer residual toner and external additive becomes severer with contamination of the image formation.

As a result of our further study, it has been discovered that the above difficulties, particularly the attachment onto the charging roller, is greatly associated with the shaping accuracy, surface frictional coefficient and surface roughness of the charging roller in addition to the species and dispersion state of the colorant in the toner.

More specifically, as the charging roller and the photosensitive member (photosensitive drum) rotate while contacting each other, if the shaping accuracy of the charging roller is poor and an outer diameter deviation thereof is large, some gap are formed between the charging roller and the photosensitive drum and the degree of gaps is variously changed. Under this state, transfer residual toner is liable to intrude the gaps and be irregularly attached to soil the charging roller, thus causing image failure. As a result of our study, it has become clear that such toner attachment irregularity is effectively prevented if the charging roller is formed in a crown shape and the roller outer diameter deviation is suppressed down to a level of roller crown (value) or below, more preferably at most ½ of the roller crown (value).

The roller outer diameter deviation and roller crown (value) described herein are based on values measured by using a high-accuracy laser meter ("LSM-430v", made by Mitsutoyo K.K.).

More specifically, the roller outer diameter deviation refers to a difference between a maximum outer diameter and a minimum outer diameter along the length of a charging roller. The measurement is effected at 5 times for a sample, and an average thereof is taken as a roller outer diameter deviation.

The roller crown described herein refers to a difference between an outer diameter B (mm) measured at a mid point along a length of a roller and an average of outer diameters A and C (mm) measured at two points shifted by 90 mm each from the mid point towards both longitudinal ends along the length of the roller, i.e., $$\text{Roller crown (value)}(\mu\text{m})=\{B-(A+C)/2\}\times 1000.$$

In the case of a roller having an entire length of 250 mm, the outer diameter values A, B and C are measured at points of 35 mm, 125 mm and 215 mm, respectively, from one end of the roller. The measurement is effected at 5 times for a sample, and an average thereof is taken as a roller crown (value).

The crown shape of the charging roller is generally provide by adjusting the outer shape of the elastic layer 602*b*. Hitherto, in order to form a member like an elastic layer of a charging roller, it has been a general practice to rely on a grinding method according to a traverse scheme wherein an outer shape of a charging roller is ground with a short grindstone while moving the grindstone along the length of the roller. According to us, it is difficult to finish the outer shape of the charging roller at a high accuracy by the traverse scheme, and even if possible, a very long time is required for the finishing of a charging roller. After realizing the criticality of high-accuracy finishing of the elastic layer of the charging roller. We have adopted a wide grinder scheme for finishing an elastic layer in order to provide an outer shape of a charging roller satisfy the above condition.

More specifically, in the wide grinder scheme, a wide grindstone having a width nearly equal to the length of a charging roller is used, and it is abutted along the entire length of the elastic layer of the charging roller to grind the elastic layer. As a result, it has become possible to finish the crown shape satisfying the above-mentioned conditions in a short time.

The charging roller may preferably have a roller hardness of 30–75 deg. which is measured after provision of the surface layer but is generally governed by a hardness of the elastic layer. If the roller hardness is below 35 deg., the charging roller is liable to come off the grindstone during the grinding, thus making it difficult to achieve a high-accuracy finish. On the other hand, above 75 deg., it becomes difficult to ensure the uniform and intimate contact between the charging roller and the photosensitive member, thus being liable cause charging failure.

The roller hardness referred to herein are based on values measured by using an ASKER-C rubber hardness meter (made by Kobunshi Keiki K.K.). More specifically, rubber hardness values are measured at 5 points arbitrarily selected on a sample charging roller, and an average of the 5 measured values is taken as a roller hardness.

The charging roller may preferably have a surface exhibiting a static friction coefficient of at most 1.00, more preferably at most 0.85, so as to suppress the occurrence of image failure. Above 1.00, toner is liable to attach to the roller surface, and once attached toner is not readily liberated to cause charging failure.

In order to accomplish the requirement, it is preferred to select a material showing a static friction coefficient of at most 0.50 from the above-mentioned materials for the surface layer.

More specifically, for providing a surface layer satisfying the above-mentioned friction coefficient requirement, it is preferred that a surface layer material (resin) is tested by forming a paint thereof and applying the point on an aluminum sheet to form a coating film thereon. The coating film surface is subjected to measurement of a static friction coefficient $\mu_{SB}$ by using a static friction coefficient meter (e.g., "HEIDON TRIBOGEAR $\mu_S$ TYPE: 941", made by Shintoh Kagaku K.K.). As a result of the above test, a resin material showing $\mu_{SB} \leqq 0.50$ may be selected, and an conductive agent and other additives are added thereto to formulate a surface layer composition, which is expected to provide a surface showing a static friction coefficient $\mu_S$ of at most 1.00, more preferably at most 0.95.

Figure 13:
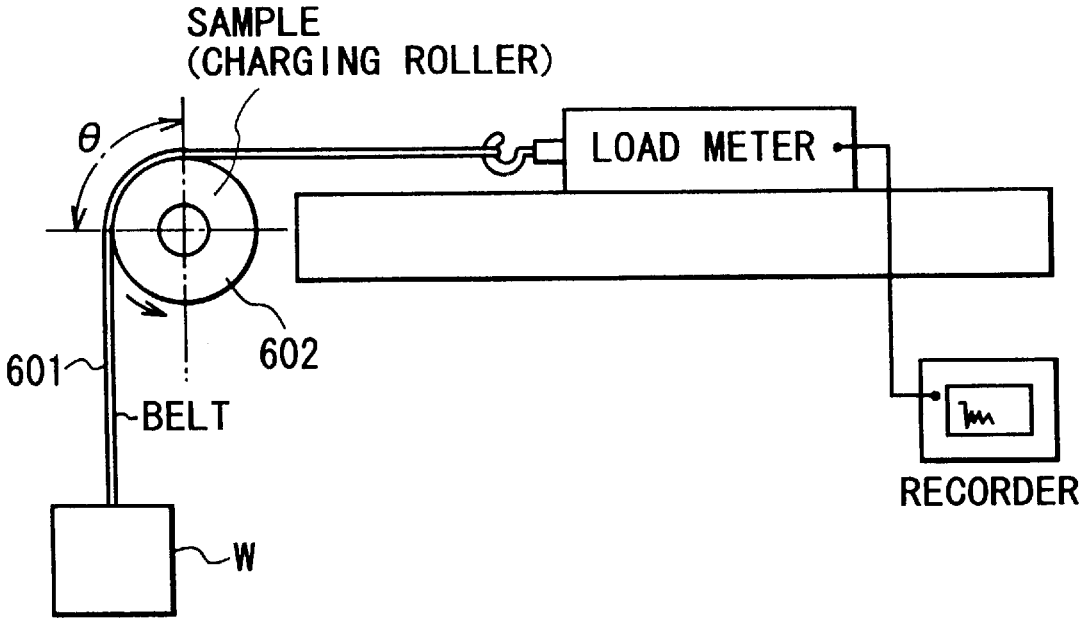
FIG. 13 illustrates a device for measuring a static frictional coefficient of a charging roller surface.

The static friction coefficient of charging roller surface may suitably be measured by using a device as shown in FIG. 13 according to a scheme similar to the Euler's belt scheme.

More specifically, referring to FIG. 13, a belt 601 (thickness=20 $\mu$m, width=30 mm, length=180 mm) is disposed to be wound about a sample charging roller 602 for a contact angle range of θ deg. One end meter 602 and the other end is connected to a weight W (of e.g., 5.0 g). In this state, the sample roller 602 is started to rotate in a prescribed indicated arrow direction at a prescribed speed to measure a load F (g) at the load meter. A friction coefficient ($\mu$) at this time is calculated by the following equation:

$$\mu=(1/\theta)\ln(F/W).$$

Figure 14:
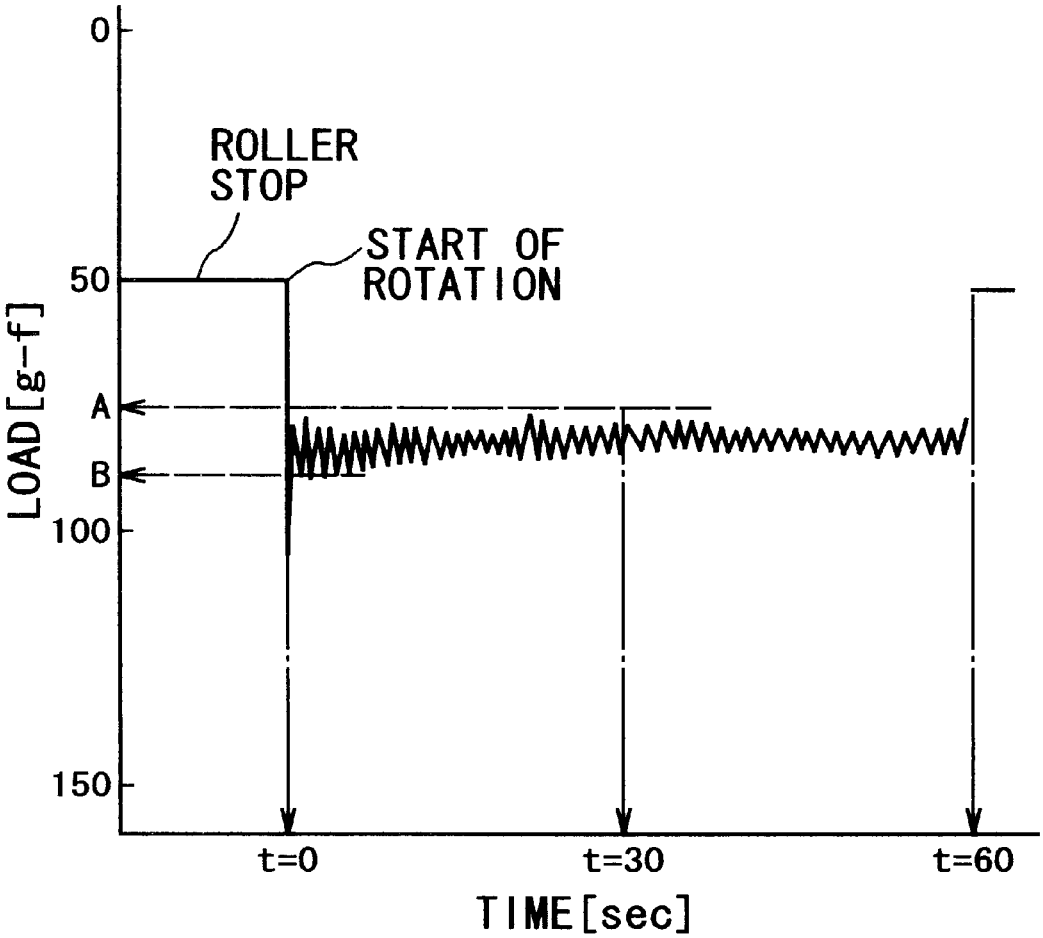
FIG. 14 illustrates an example of chart recorded by operation of the device shown in FIG. 13.

FIG. 14 shows an example of chart (load recorded by the load meter vs. time) obtained by using the device shown in FIG. 13, for 60 sec. of rotation of a sample roller. Referring to the chart of FIG. 14, a load indicated at a time (t=0) immediately after a start of rotation is a force necessary for initiating the rotation and loads (A–B) after that are forces required for continuing the rotation. Thus, the load at time t2 ($F_{<t=0}$, ca. 105 g in FIG. 14) represents a static friction force, and the forces (A–B, at time $0<t\leqq 60$) represent dynamic friction forces. Accordingly, a static friction coefficient $\mu_S$ of a sample roller surface is calculated according to the following formula:

$$\mu_S=(1/\theta)\ln(F_{<t=0>}/W)$$

The static friction coefficient of charging rollers described herein are values measured by using a device as shown in FIG. 13, wherein the belt 601 was a stainless steel belt showing a ten-point average surface roughness (Rz) of below 5 $\mu$m, W was 50 g and the roller 602 was related at 100 rpm The charging roller may preferably have a surface showing a ten-point average roughness (Rz according to JIS B0601) of at most 5 $\mu$m, as measured as an average of measured values at arbitrarily selected 5 points on a sample roller by using a surface roughness meter (e.g., "SE-3400", made by Kosaka Kenkyusho K.K.).

If substantial unevennesses are present at the charging roller surface, the toner intrudes thereto to cause surface soil, and once attached toner is difficult to remove physically. Accordingly, the charging roller surface should preferably have a surface roughness below the particle sizes of the toner used for the image formation. Further, if the charging roller surface is rough, some charging irregularity is liable to occur due to surface unevennesses thereof, thus being liable to result in image failure. In some severe cases, the photosensitive member surface can be abraded thereby, so that a smoother charging roller surface is preferred.

Incidentally, the image-bearing member used in the present invention may preferably comprise a photosensitive member having a surface imparted with releasability and preferably showing a contact angle with water of at least 85 deg., more preferably at least 90 deg.

The provision of releasability to the photosensitive member surface may be achieved by, e.g., (1) using a resin showing a low surface energy as a resin for constituting the surface layer, (2) dispersing an additive imparting water-repelling or lipophilicity in the surface layer, or (3) dispersing powder of a material showing a high releasability in the surface layer. For example, (1) may be realized by using a fluorine-containing resin or silicone group-containing resin, (2) may be realized by using a surfactant as such an additive, and (3) may be realized by dispersing powder of a fluorine-containing compound, such as polytetrafluoroethylene, polyvinylidene fluoride or fluorinated carbon.

It is also preferred that the photosensitive member shows a universal hardness of 150–230 N/mm$^2$ as measured by using an ultra-micro hardness meter ("H100V", made by Fischer Instruments Co.) whereby a 4-side or 3-side angular apex stylus is pressed into a sample surface to measure a load W (N) and a contact area A ($mm^2$) between the indented sample surface and the stylus at that load to calculate a universal hardness=W/W ($N/mm^2$).

Hereinbelow, the present invention will be described based on Examples, which however should not be construed to restrict the scope of the present invention. "Part(s)" and "%" used hereinafter for describing relative amounts of a material are by weight unless otherwise noted specifically.

<Monoazo Pigment Composition>

Production Example 1-1

50 parts of 3-amino-4-methoxybenzanilide was placed in 1000 parts of water, and ice was added thereto to set the temperature at 0–5° C. Then, 60 parts of 35%-HCl aqueous solution was added thereto, followed by stirring for 20 min. Thereafter, 50 parts of 30%-sodium nitrite aqueous solution was added and the system was stirred for 60 min., followed by addition of 2 parts of sulfamic acid to decompose an excess of nitrite. Further, 50 parts of sodium acetate and 75 parts of 90%-acetic acid were added to the system to form a diazonium salt solution.

Separately, 80 parts of N-(5-chloro-2-methoxyphenyl)-3-hydroxy-2-naphthalenecarboxyamide (as β-naphthol derivative (1)) and 3 parts of β-oxynaphthoic acid (as β-naphthol derivative (2)) were dissolved together with 1000 parts of water and 25 parts of sodium hydroxide at a temperature of 80° C. or below, and an appropriate amount of sodium alkylbenzenesulfonate (as an anionic surfactant for adjusting pigment particle size) was added thereto to form a coupler solution.

The coupler solution was added to the above-prepared diazonium salt solution at a temperature of at most 10° C. to effect a coupling. For the coupling, the system was made alkaline, 400 parts of 10%-sodium abietate aqueous solution was added thereto, followed by stirring to effect a rosin treatment and a solution of 200 parts of calcium chloride hydrate in 1000 parts of water was added thereto, followed by stirring for 60 min. to effect a laking. The system was made acidic, and after being heat-treated at 90° C., was subjected to filtration and washing, followed by drying at 100° C. and pulverization to obtain a pigment composition containing a monoazo pigment was subjected to an alkali treatment at pH 11 to obtain Pigment composition 1-1 containing 19,000 ppm of N-(5-chloro-2-methoxyphenyl)-3-hydroxy-2-naphthalenecarboxyamide, 300 ppm of β-oxynaphthoic acid and 65 ppm of 3-amino-4-methoxybenzanilide.

Production Examples 1-2 to 1-5

Pigment compositions were prepared in the same manner as in Production Example 1-1 except for the following changes:

the rosin treatment and the laking were omitted at the time of the coupling, and the alkali treatment (at pH 11) was changed to an acid treatment (at pH 2) (Production Example 1-2);

the alkali-treatment (at pH 11) after the coupling was changed to a sequence of an alkali treatment (at pH 11), an acid treatment (at pH 2) and careful washing (Production Example 1-3);

the coupler solution was prepared by omitting the β-oxynaphthoic acid and increasing the amount of the N-(5-chloro-2-methoxyphenyl)-3-hydroxy-2-naphthalenecarboxyamide to 83 parts, the rosin treatment and the laking were omitted at the time of the coupling and the alkali treatment (at pH 11) after the coupling was changed to a sequence of an alkali treatment (at pH 11), an acid treatment (at pH 2) and careful washing (Production Example 1-4); and the rosin treatment and the laking were omitted at the time of the coupling, and the alkali treatment (at pH 11) after the coupling was changed to a sequence of an alkali treatment (at pH 11), an acid treatment (at pH 2) and careful washing (Production Example 1-5).

As a result, Monoazo pigment compositions 1-2 to 1-5 having contents of N-(5-chloro-2-methoxyphenyl)-3-hydroxy-2-naphthalenecarboxyamide (indicated as β-naphthol derivative (1)), β-oxynaphthoic acid (indicated as β-naphthol derivative (2)) and 3-amino-4-methoxybenzanilide (indicated as aromatic amine), respectively as shown in Table 1-1, were obtained.

Comparative Production Example 1-1

Comparative monoazo pigment composition 1-1 containing 63,000 ppm of N-(5-chloro-2-methoxyphenyl)-3-hydroxy-2-naphthalenecarboxyamide and 2,400 ppm of 3-amino-4-methoxybenzanilide was prepared in the same manner as in Production Example 1-1 except for preparing the coupler solution by omitting the β-oxynaphthoic acid and increasing the amount of the N-(5-chloro-2-methoxyphenyl)-3-hydroxy-2-naphthalene-carboxyamide to 83 parts, omitting the rosin treatment and the laking at the time of the coupling, and omitting the alkali treatment after the coupling.

Production Examples 1-6 to 1-9

Monoazo pigment compositions 1-6 to 1-9 having contents of β-naphthol derivatives (1), β-naphthol derivative (2) (β-oxynaphthoic acid) and aromatic amines, respectively shown in Table 1-1, were prepared in the same manner as in Production Example 1-1 except that the N-(5-chloro-2-methoxyphenyl)-3-hydroxy-2-naphthalenecarboxyamide as β-naphthol derivative (1) was changed to 47 parts of 3-hydroxy-2-naphthalene-carboxyamide (Production Example 1-6), 80 parts of N-benzimidazoline-3-hydroxy-2-naphthalene-carboxyamide (Production Example 1-7), 78 parts of N-(3-nitrophenyl)-3-hydroxy-2-naphthalenecarboxyamide (Production Example 1-8) and 92 parts of N-(5-chloro-2,4-dimethoxyphenyl)-3-hydroxy-2-naphthalenecarboxyamide (Production Example 1-9), respectively, and with further modification of:

omitting the β-oxynaphthoic acid for preparing the coupler solution, and omitting the rosin treatment and the laking at the time of the coupling (Production Example 1-7);

omitting the rosin treatment and the laking at the time of the coupling (Comparative Example 1-8); and changing the 3-amino-4-methoxybenzanilide to 54 parts of 3-amino-4-methoxyphenyl-N,N-diethylsulfonamide (Production Example 1-9), respectively.

<Toner>

Production Example 1-1

Into a 2 liter-four-necked flask equipped with a high-speed stirrer ("CLEARMIX", made by M. Technique K.K.), 470 parts of deionized water and 3 parts of $Na_3PO_4$ were charged and heated to 65° C. under stirring at 10,000 rpm. Then, $CaCl_2$ aqueous solution was added thereto to prepare an aqueous dispersion medium containing minute particles of $Ca_3(PO_4)_2$ (hardly water-soluble dispersing agent). The aqueous dispersion medium was further adjusted to pH 5.2 by addition of dilute hydrochloric acid.

On the other hand, a mixture comprising

| | |
|---|---|
| Styrene | 83 part(s) |
| n-Butyl acrylate | 17 part(s) |
| Divinylbenzene | 0.2 part(s) |
| Monoazo pigment composition 1–3 | 5 part(s) |
| Polyester resin (Mp (peak molecular weight) = 7000) | 5 part(s) |
| Charge control agent (dialkylsalicylic acid Al compound) | 2 part(s) |
| Ester wax (represented by $C_{15}H_{31}COOC_{16}H_{33}$, Tmp = 60° C.) | 12.5 part(s) |

was subjected to 3 hours of dispersion by an attritor (made by Mitsui Kinzoku K.K.), and 3 parts of 2,2'-azobis(2,4-dimethylvaleronitrile) was added thereto at 65° C., followed by 1 min. of stirring, to prepare a polymerizable monomer composition.

The polymerizable monomer composition was charged to the above-prepared aqueous dispersion medium under stirring at an elevated stirring speed of 15,000 rpm, and the stirring was further continued for 3 min. at an internal temperature of 60° C. under $N_2$ atmosphere, to form droplets of the polymerizable monomer composition. Then, the stirrer was changed to a paddle stirrer, and under stirring at 200 rmp, the system was held at that temperature up to a conversion of 90%. Then, the temperature was raised up to 80° C. and held at that temperature until a polymerization conversion of ca. 100% to complete the polymerization.

After the polymerization, the system was cooled, and dilute hydrochloric acid was added thereto to dissolve the dispersing agent. The polymerizate was washed several times with water by using a pressure filter and dried to obtain Polymerizate particles (1-1), which exhibited a weight-average particle size (D4) of 7.2 $\mu$m.

100 parts of Polymerizate particles (1-1) and hydrophobic oil-treated silica fine powder ($S_{BET}$(BET specific surface area)=200 $m^2/g$) were dry-blended with each other by means of a HENSCHEL mixer (made by Mitsui Kinzoku K.K.) to obtain Toner (1-1).

Toner (1-1) was found to contain 17500 ppm of N-(5-chloro-2-methoxyphenyl)-3-hydroxy-2-naphthalene-carboxyamide (β-naphthol derivative (1)), 220 ppm of β-oxynaphthoic acid (β-naphthol derivative (2)) and 14 ppm of 3-amino-4-methoxybenzanilide, based on the weight of the pigment composition contained therein.

The weight average particle size (D4), and the contents of the β-naphthol derivatives and aromatic amines (based on the weight of pigment composition) of Toner (1-1) are inclusively shown in Table 1-2, together with those of Toners prepared in Production Examples described hereinbelow.

Production Examples 1-2 to 1-9,

Comparative Production Example 1-1

Toners (1-2) to (1-9) and Comparative Toner (1-1) were prepared in the same manner as in Production Example 1-1 except for charging the species and amounts of Monoazo pigment compositions used therein respectively as shown in Table 1-2.

Comparative Production Example 1-2

Comparative Toner 1-2 was prepared in the same manner as in Production Example 1-1 except for changing Monoazo pigment composition 1-3 to 5 parts of C.I. Pigment Red 57:1 (comprising a monoazo pigment of the following structural formula:

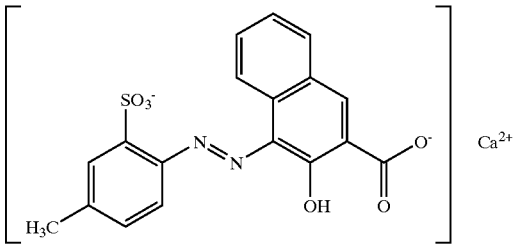

and containing 64000 ppm of β-naphthol derivative and 370 ppm of aromatic amine).

Reference Production Examples 1-1 and 1-2

Cyan Toner 1-1 and Yellow Toner 1-2 were prepared in the same manner as in Production Example 1-1 except for changing Monoazo pigment composition 1-3 to 5 parts of C.I. Pigment Blue 15:3 and 8 parts of C.I. Pigment Yellow 93, respectively.

(Toner Production Example 1–10)

| | |
|---|---|
| Styrene-butyl acrylate copolymer (Tg = 65° C.) | 100 parts |
| Monoazo pigment composition 1–3 | 4 parts |
| Charge control agent (dialkylsalicylic acid Al compound) | 2 parts |
| Ester wax (Tmp = 60° C.) | 7 parts |

The above ingredients were blended and melt-kneaded by a twin-screw extruder. The kneaded product, after cooling, was coarsely crushed by a hammer mill and finely pulverized by a jet mill. The pulverizate was subjected to sphering by a hybridizer (made by Narakikai Seisakusho K.K.) to provide Toner particles (1-10), which exhibited D4=7.5 $\mu$m.

100 parts of Toner particles (1-10) and 1.5 parts of hydrophobic silica fine powder ($S_{BET}$=25 $m^2/g$) treated with hexamethyldisilazane were dry-blended by a Henschel mixer to obtain Toner (1-10).

Toner (1-10) was found to contain 17600 ppm of N-(5-chloro-2-methoxyphenyl)-3-hydroxy-2-naphthalene-carboxyamide (β-naphthol derivative (1)), 230 ppm of β-oxynaphthoic acid (β-naphthol derivative (2)) and 18 ppm of 3-amino-4-methoxybenzanilide, based on the weight of the pigment composition contained therein.

Toner Production Examples 1-11 and 1-12

Toners (1-11) and (1-12) were prepared in the same manner as in Toner Production Example 1-10 except for changing Monoazo pigment composition 1-3 to Monoazo pigment compositions 1-6 and 1-8, respectively.

<Toner Performances>

EXAMPLE 1-1

Toner (1-1) was charged in a process cartridge of a commercially available laser beam printer having a structure as shown in FIG. 1 except for including an intermediate transfer drum instead of the intermediate transfer belt ("LBP-2160", made by Canon K.K.) after remodeling so as to provide a process speed of 32 sheets (A4-size)/min. and subjected to a continuous printing test on 3,000 sheets of plain paper (75 g/m$^2$) as a transfer material according to a mono-color mode for reproducing character images with an image areal percentage of 4%.

In addition to the above test, Toner (1-1) (magenta toner) prepared in Toner Production Example 1-1 was evaluated together with Cyan Toner (1-1) and Yellow Toner (1-2) prepared in Reference Production Examples (1-1) and (1-2) by charging them into the relevant process cartridges of a similarly remodeled laser beam printer ("LBP-2160", made by Canon K.K.) to effect a full-color printing test on plain paper (75 g/m$^2$) and on OHP sheets ("CG 3700", made by 3M Co.).

Based on the above printing test, toner performances were evaluated with respect to the following items.

(1) Image Density (I.D.)

A 5 mm-square solid image was printed on plain paper (75 g/m$^2$) and the image density thereof was measured by a reflection densitometer ("X-RITE 504", made by X-Rite K.K.) as a relative density with reference to a printed image of white background portion. Based on the measured relative image density (ID), the evaluation was performed according to the following standard:

S: ID≧1.40

B: 1.30≦ID<1.40

C: 1.00≦ID<1.30

D: ID<1.00

(2) Image Soiling

A halftone image formed by a repetition of 1 dot-size line and 1 dot-size space was printed on plain paper (75 g/m$^2$), and the degree of image soiling on the halftone image was evaluated according to the following standard.

A: Not observed.

B: Slight soiling was observed.

C: Minute spots of soiling were observed.

D: Periodical stripe soiling or vertical streak soiling was observed.

(3) Image Fog

Toner at a part between the developing step and the transfer step on the photosensitive drum at the time of forming a solid white image was peeled off by a polyester adhesive type and applied onto white paper together with the adhesive tape to measure a reflection density (Dm), and a blank polyester adhesive tape alone was applied on the same white paper to measure a reflection density (Db) respectively by a reflection densitometer ("X-RITE 504"). A fog image density (Df) was calculated as a difference between the measured densities (Dm–Db). A smaller fog image density represents better suppression of fog. Based on the thus-obtained fog image density (Df), the evaluation was performed according to the following standard.

A: Df<0.03

B: 0.03≦Df<0.07

C: 0.07≦Df<0.15

D: Df≧0.15

(4) Transferability (Transfer)

Transfer residual toner on the photosensitive drum at the time of forming a solid black (non-white) image was peeled off by a polyester adhesive type and applied onto white paper together with the adhesive tape to measure a reflection density (Dm), and a blank polyester adhesive tape alone was applied on the same white paper to measure a reflection density (Db) respectively by a reflection densitometer ("X-RITE 504"). A transfer residual image density (Dtr) was calculated as a difference between the measured densities (Dm–Db). A smaller transfer residual image density represents a better transferability. Based on the thus-obtained transfer residual image density (Dtr), the evaluation was performed according to the following standard.

A: Dtr<0.03

B: 0.03≦Dtr<0.07

C: 0.07≦Dtr<0.15

D: Dtr≧0.5

(5) Matching with an Intermediate Transfer Belt (Belt Cleaning)

The cleanability of secondary transfer-residual toner and printed images were observed to evaluate the matching with the intermediate transfer belt according to the following standard:

A: No residual toner remained on the transfer belt and good printed images were obtained.

B: Slight toner was attached to the transfer belt but did not affect the printed images.

C: Slight toner soil occurred in the printed images.

D: The transfer belt was remarkably soiled and toner attachment was also observed on the cleaning roller.

(6) Color Reproducibility on Plain Paper

Full-color images formed on plain paper (75 g/m$^2$) were evaluated with eyes and subjected to measurement of lightness L*, chromatic index a* representing a degree of red or green and chromatic index b* representing a degree of yellow or blue according to the CIE-Lab color space by "X-RITE SP68" (made by X-Rite K.K.) to obtain a volume of color space. A large color space volume represents a better color reproducibility. Based on the measured color space volume values, the evaluation was performed according to the following standard.

<Color Space Volume>

A: $\geqq 2.50\times10^6$

B: $\geqq 2.00\times10^6$ and $<2.50\times10^6$

C: $\geqq 1.50\times10^6$ and $<2.00\times10^6$

D: $<1.50\times10^6$.

<Eye Observation>

A: Both magenta and secondary colors (red, blue) exhibited excellent color reproducibility.

B: Magenta exhibited excellent color reproducibility but the color reproducibility of secondary colors (red, blue) was somewhat inferior.

C: The color reproducibilities of magenta and secondary colors (red, blue) were both somewhat inferior.

D: The color reproducibilities of magenta and secondary colors (red, blue) were both inferior.

(7) Color Reproducibility and Transparency of Full-color Projection Image

Full color image on an OHP sheet ("CG3700", made by 3M Co.) were projected by an OHP ("9550", made by 3M Co.) onto a white wall, and the projected images were evaluated with eyes and subjected to measurement of lightness L*, chromatic index a* representing a degree of red or green and chromatic index b* representing a degree of yellow or blue according to the CIE-Lab color space (made by X-Rite K.K.) to obtain a volume of color space. Based on the measured color space volume values, the evaluation was performed according to the following standard.

<Color Space Volume>

A: $\geqq 2.50\times10^6$

B: $\geqq 2.00\times10^6$ and $<2.50\times10^6$

C: $\geqq 1.50\times10^6$ and $<2.00\times10^6$

D: $<1.50\times10^6$.

<Eye Observation>

A: Clear and excellent transparency

B: Good transparency, excellent color reproducibility of magenta, but the reproducibility of secondary colors (red, blue) was somewhat inferior.

C: Slightly inferior transparency, and the color reproducibilities of magenta and secondary colors (red, blue) were both somewhat inferior.

D: Exhibited sombre color, and color reproducibilities of magenta and secondary colors (red, blue) were both inferior.

The results of the above evaluation are summarized in Table 1-3 together with those of Examples described hereinbelow.

EXAMPLES 1-2 to 1-12

And Comparative Examples 1-1 and 1-2

Image formation and evaluation were performed in the same manner as in Example 1-1 except for using Toners (1-2) to (1-12) and Comparative Toners (1-1) and (1-2), respectively, instead of Toner (1-1).

TABLE 1-1

| Prod. | | Monoazo pigment C.I. Pigment | Monoazo pigment compositions: β-naphthol derivative (formula(2)) $R_9$ | | Substituents in [A] | | | | Aromatic amine (formula(3)) | | |
|---|---|---|---|---|---|---|---|---|---|---|---|
| Ex. | No. | No. | (1)*2 | (2) | $R_5$ | $R_6$ | $R_7$ | $R_8$ | $R_{10}$ | $R_{11}$ | $R_{12}$ |
| 1-1 | 1-1 | PR269 | [A] | —OH | —$OCH_3$ | —H | —H | —Cl | —$OCH_3$ | —H | —$CONHC_6H_5$ |
| 1-2 | 1-2 | PR269 | [A] | —OH | —$OCH_3$ | —H | —H | —Cl | —$OCH_3$ | —H | —$CONHC_6H_5$ |
| 1-3 | 1-3 | PR269 | [A] | —OH | —$OCH_3$ | —H | —H | —Cl | —$OCH_3$ | —H | —$CONHC_6H_5$ |
| 1-4 | 1-4 | PR269 | [A] | —OH | —$OCH_3$ | —H | —H | —Cl | —$OCH_3$ | —H | —$CONHC_6H_5$ |
| 1-5 | 1-5 | PR269 | [A] | —OH | —$OCH_3$ | —H | —H | —Cl | —$OCH_3$ | —H | —$CONHC_6H_5$ |
| Comp. 1-1 | Comp. 1-1 | PR269 | [A] | —OH | —$OCH_3$ | —H | —H | —Cl | —$OCH_3$ | —H | —$CONHC_6H_5$ |
| 1-6 | 1-6 | PR150 | —$NH_2$ | —OH | — | — | — | — | —$OCH_3$ | —H | —$CONHC_6H_5$ |
| 1-7 | 1-7 | PR176 | [B] | —OH | — | — | — | — | —$OCH_3$ | —H | —$CONHC_6H_5$ |
| 1-8 | 1-8 | PR31 | [A] | —OH | —H | —H | —H | —$NO_2$ | —$OCH_3$ | —H | —$CONHC_6H_5$ |
| 1-9 | 1-9 | PR5 | [A] | —OH | —$OCH_3$ | —H | —$OCH_3$ | —Cl | —$OCH_3$ | —H | —$SO_2N(C_2H_5)_2$ |

| Prod. Ex. | No. | Contents(ppm) of secondary components: β-naphthol derivative (1) | (2) ((1)/(1) + (2)*1) | (1) + (2) | aromatic amine | rosin treatment |
|---|---|---|---|---|---|---|
| 1-1 | 1-1 | 19,000 | 300 (1.6%) | 19,300 | 65 | done |
| 1-2 | 1-2 | 28,000 | 500 (1.8%) | 28,500 | 18 | no |
| 1-3 | 1-3 | 18,000 | 250 (1.4%) | 18,250 | 20 | done |
| 1-4 | 1-4 | 18,200 | — (0%) | 18,200 | 21 | no |
| 1-5 | 1-5 | 18,000 | 240 (1.3%) | 18,240 | 19 | no |
| Comp. 1-1 | Comp. 1-1 | 63,000 | — (0%) | 63,000 | 2,400 | no |
| 1-6 | 1-6 | 1,400 | 25 (1.8%) | 1,425 | 90 | done |
| 1-7 | 1-7 | 700 | — (0%) | 700 | 190 | no |
| 1-8 | 1-8 | 1,200 | 24 (2.0%) | 1,224 | 130 | no |
| 1-9 | 1-9 | 2,100 | 35 (1.6%) | 2,135 | 179 | done |

*1wt. percentage of β-naphthol derivative (2) (=β-oxynaphthoic acid) in total β-naphthol derivatives ((1) + (2)).

*2$R_9$ in Formula(2) for β-naphthol derivative (1).

[A]

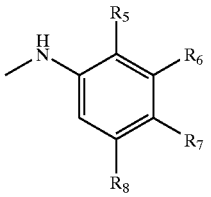

[B]

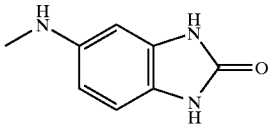

TABLE 1-2

| Toners | | | | | | | | | |
|---|---|---|---|---|---|---|---|---|---|
| | | Monoazo pigment composition | | | | Contents (ppm) in toner | | | |
| | | | | | | β-naphthol derivative | | | |
| Prod. Ex. | Toner No. | No. | C.I. Pigment No. | Amount (parts) | $D_4$ (μm) | (1) | (2) ((1)/(1) + (2)*[1]) | (1) + (2) | aromatic amine |
| 1-1 | 1-1 | 1-3 | PR269 | 5 | 7.2 | 17,500 | 220 (1.2%) | 17,720 | 14 |
| 1-2 | 1-2 | 1-1 | PR269 | 5 | 7.0 | 17,900 | 290 (1.6%) | 18,190 | 58 |
| 1-3 | 1-3 | 1-2 | PR269 | 6 | 7.1 | 26,600 | 470 (1.7%) | 27,070 | 11 |
| 1-4 | 1-4 | 1-4 | PR269 | 8 | 7.2 | 17,700 | — (0%) | 17,700 | 13 |
| 1-5 | 1-5 | 1-5 | PR269 | 6.5 | 7.3 | 17,400 | 230 (1.9%) | 27,630 | 11 |
| 1-6 | 1-6 | 1-6 | PR150 | 5.5 | 7.1 | 1,010 | 20 (1.9%) | 1,030 | 80 |
| 1-7 | 1-7 | 1-7 | PR176 | 7 | 7.3 | 640 | — (0%) | 640 | 176 |
| 1-8 | 1-8 | 1-8 | PR31 | 8 | 7.5 | 1,100 | 23 (2.0%) | 1,123 | 110 |
| 1-9 | 1-9 | 1-9 | PR5 | 6 | 7.0 | 1,900 | 38 (2.0%) | 1,938 | 167 |
| Comp. 1-1 | Comp. 1-1 | Comp. 1-1 | PR269 | 5 | 6.5 | 62,400 | — (0%) | 62,400 | 1,700 |
| 1-10 | 1-10 | 1-3 | PR269 | 4 | 7.5 | 17,600 | 240 (1.3%) | 17,840 | 18 |
| 1-11 | 1-11 | 1-6 | PR150 | 4 | 7.3 | 1,300 | 23 (1.7%) | 1,323 | 88 |
| 1-12 | 1-12 | 1-8 | PR31 | 4 | 7.4 | 650 | — (0%) | 650 | 184 |

*[1]wt. percentage of β-naphthol derivative (2)(=β-oxynaphthoic acid) in total β-naphthol derivatives ((1) + (2)).

TABLE 1-3

| Toner performances (image evaluation) | | | | | | | | | | | |
|---|---|---|---|---|---|---|---|---|---|---|---|
| | | Magenta pigment composition | Mono-color | | | | | Full-color Color reproducibility (and transparency) | | | |
| | | | | | | | Belt | on plain paper | | OHP projection image | |
| Example | Toner No. | No. | Image density | Image soil | Fog | Transfer | cleaning | Color space | with eyes | Color space | with eyes |
| 1-1 | 1-1 | 1-3 | A | A | A | A | A | A | A | A | A |
| 1-2 | 1-2 | 1-1 | A | B | B | A | A | A | A | A | A |
| 1-3 | 1-3 | 1-2 | B | A | A | A | B | B | B | C | C |
| 1-4 | 1-4 | 1-4 | B | B | B | B | A | B | B | C | C |
| 1-5 | 1-5 | 1-5 | B | A | A | A | B | B | B | C | C |
| 1-6 | 1-6 | 1-6 | A | B | B | A | B | A | A | A | B |
| 1-7 | 1-7 | 1-7 | C | C | C | C | C | B | B | C | C |
| 1-8 | 1-8 | 1-8 | A | B | B | A | B | B | B | C | C |
| 1-9 | 1-9 | 1-9 | A | B | B | B | B | A | A | B | B |
| 1-10 | 1-10 | 1-3 | A | A | A | A | A | A | A | A | A |
| 1-11 | 1-11 | 1-6 | A | B | B | B | B | A | A | A | A |
| 1-12 | 1-12 | 1-8 | A | B | B | A | C | B | B | C | C |
| Comp. 1-1 | Comp. 1-1 | Comp. 1-1 | C | D | D | D | D | D | C | D | D |
| Comp. 1-2 | Comp. 1-2 | P.R.57:1 | D | D | D | D | D | D | C | D | D |

<Photosensitive Drum>

Production Example 2-1

Photosensitive drum (2-1) was prepared by coating a 48 mm-dia. aluminum cylinder as a support by dipping successively with the following layers.

1) a 15 μm-thick electroconductive coating layer principally comprising powders of tin oxide and titanium oxide dispersed in phenolic resin.
2) a 0.6 μm-thick undercoating layer principally comprising modified nylon and copolymer nylon.
3) a 0.3 μm-thick charge generation layer principally comprising oxytitanium phthalocyanine dispersed in butyral resin.
4) a 25 μm-thick charge transport layer principally comprising a hole-transporting triphenyl-amine compound dispersed in polycarbonate resin (1:1 mixture of bisphenol C-type and bisphenol Z-type).

The resultant Photosensitive drum (2-1) exhibited a universal hardness of 170 $Nmm^2$ at its surface.

Production Example 2-2

Photosensitive drum (2-2) was prepared in the same manner as in Production Example 2-1 except for using a 24 mm-dia. aluminum cylinder as a support.

The resultant Photosensitive drum (2-2) exhibited a universal hardness of 190 $Nmm^2$ at its surface.

<Intermediate Transfer Belt>

Production Example 2-1

100 parts of vinylidene fluoride resin (PVDF) and 14 parts of polyether-containing anti-static resin were melt-knead by a twin-screw extruder at 200° C. or higher and formed into molding pellets of ca. 2 mm. The molding pellets were melted under heating and melt-extruded through an annular die into a cylindrical tube, which was then subjected to a shape adjustment by blowing air into and circumference of the tube and then cutting to obtain a cylindrical film. The cylindrical film was further subjected to a post treatment by using a cylindrical mold for removing wrinkles and external shape adjustment, and a meandering prevention member was attached thereto to obtain Intermediate transfer belt (2-1), which exhibited a surface roughness Ra of 0.03 $\mu$m, a volume resistivity of $6.5\times10^{10}$ ohm.cm, an elasticity modulus of 800 Mpa, a breakage elongation of 20%, and a thickness of 102 $\mu$m.

Production Example 2-2

Intermediate transfer belt (2-2) was prepared in the same manner as in Production Example 2-1 except for using a molding composition of 100 parts of PVDF, 8 parts of polyether-containing antistatic resin and 4 parts of sulfonic acid salt-type surfactant, and changing the condition for the post treatment using the cylindrical mold.

The resultant Intermediate transfer belt (2-2) exhibited a surface roughness Ra of 0.11 $\mu$m, a volume resistivity of $8.9\times10^9$ ohm.cm, an elasticity modulus of 600 Mpa, a breakage elongation of 650%, and a thickness of 100 $\mu$m.

Comparative Production Example 2-1

Comparative Intermediate transfer belt (2-1) was prepared in the same manner as in Production Example 2-1 except for using a molding composition of 100 parts of PVDF, 18 parts of electroconductive carbon black and 50 parts of metal oxide particles, and changing the condition for the post treatment using the cylindrical mold.

Comparative Intermediate transfer belt (2-1) exhibited a surface roughness Ra of 1.29 $\mu$m, a volume resistivity of $7.7\times10^5$ ohm.cm, an elasticity modulus of 1500 Mpa, a breakage elongation of 3%, and a thickness of 99 $\mu$m.

Comparative Production Example 2-2

Comparative Intermediate transfer belt (2-2) was prepared in the same manner as in Production Example 2-1 except for using a molding composition of 100 parts of PVDF, 30 parts of polyether-containing antistatic resin and 4 parts of sulfonic acid salt-type surfactant, and changing the condition for the post treatment using the cylindrical mold.

Comparative Intermediate transfer belt (2-1) exhibited a surface roughness Ra of 0.51 $\mu$m, a volume resistivity of $3.1\times10^9$ ohm.cm, an elasticity modulus of 300 Mpa, a breakage elongation of 900%, and a thickness of 108 $\mu$m.

<Quinacridone Pigment Composition>

Production Example 2-1

A compound represented by a formula of

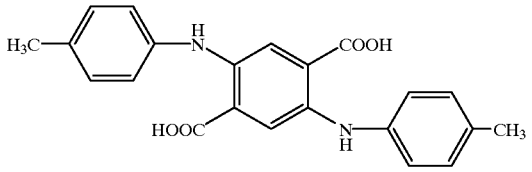

was cyclized in phosphoric acid to form 2,9-dimethylquinacridone. The phosphoric acid containing the formed 2,9-dimethylquinacridone was dispersed in water, and the 2,9-dimethylquinacridone was filtered out to obtain a wet cake of crude 2,9-dimethylquinacridone (C.I. Pigment Red 122). Separately, a compound represented by a formula of

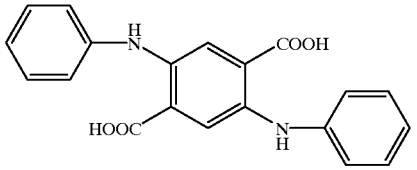

was cyclized in phosphoric acid to form unsubstituted quinacridone. The phosphoric acid containing the formed quinacridone was filtered out to obtain a wet cake of crude unsubstituted quinacridone (C.I. Pigment Violet 19).

66 parts of the crude 2,9-dimethylquinacridone and 34 parts of crude quinacridone were added to a vessel equipped with a condenser and already containing a mixture liquid of 600 parts of water and 300 parts of ethanol. Then, the mixture liquid was subjected to 5 hours of heat-refluxing while milling the 2,9-dimethylquinacridone and quinacridone. After cooling, the solid pigment was filtered out, washed and re-dispersed in 2000 parts of water, and a sodium abietate aqueous solution was added. After sufficient stirring, a calcium chloride aqueous solution was added thereto, followed by heating at 90° C. under stirring, and repetition of filtering and washing. After drying and pulverization, Quinacridone pigment composition (2-1) as a rosin-treated quinacridone solid-solution pigment was obtained.

Production Example 2-2

Quinacridone pigment composition (2-2) as a quinacridone solid-solution pigment was prepared in the same manner as in Production Example 2-1 except for omitting the addition of the sodium abietate aqueous solution.

Production Example 2-3

Crude 2,9-dimethylquinacridone (C.I. Pigment Red 122) was prepared in the same manner as in Production Example 2-1, and then sufficiently washed, dried and pulverized to obtain Quinacridone pigment composition (2-3).

Production Example 2-4

Crude unsubstituted quinacridone (C.I. Pigment Violet 19) was prepared in the same manner as in Production Example 2-1, and then sufficiently washed, dried and pulverized to obtain Quinacridone pigment composition (2-4).

Production Example 2-5

A compound represented by a formula of

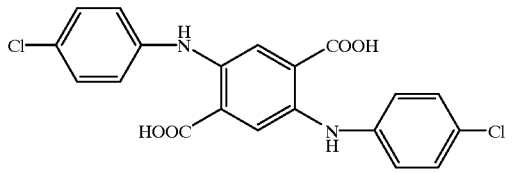

was cyclized in phosphoric acid to form 2,9-dichloroquinacridone. The phosphoric acid containing the thus-formed 2,9-dichloroquinacridone was dispersed in water, and the 2,9-dichloroquinacridone (crude C.I. Pigment Red 202) was then sufficiently washed, dried and pulverized to obtain Quinacridone pigment composition (2-5).

<Monoazo Pigment Compositions>

Production Example 2-1

50 parts of 3-amino-4-methoxybenzanilide was uniformly dispersed in 1000 parts of water, and ice was added thereto to set the temperature to 0–5° C. Under high-speed stirring, 60 parts of 35%-HCl aqueous solution was gradually added, followed by continuation of the high-speed stirring for 20 min. Thereafter, 50 parts of 30%-sodium nitride aqueous solution was added, and the system was stirred for 60 min., followed by addition of 2 parts of sulfamic acid to decompose an excess of the nitrite. Further, 50 parts of sodium acetate and 75 parts of 90% acetic acid were added to the system to form a diazonium salt solution.

Separately, 50 parts of 3-hydroxy-2-naphthalenecarboxyamide was dissolved in 1000 parts of water together with 25 parts of sodium hydroxide at 80° C. or below, and 3 parts of an anionic surfactant (sodium alkylbenzenesulfonate) was added thereto, to form a coupler solution.

To the coupler solution held at a temperature of 10° C. or below under strong stirring, the above-prepared diazonium salt solution was added at one stroke. At this time, the mixing ratio was adjusted so that the diazonium salt of 3-amino-4-methoxy-benzanilide in the diazonium salt solution and the 3-hydroxy-2-naphthalenecarboxyamide in the coupler solution would provide a ratio of 1:1.02.

After the mixing, the system was gently stirred until the coupling was completed. Then, after the reaction liquid was made alkaline, a sodium abietate aqueous solution was added thereto, and the system was made acidic again. Then, under a strong stirring, a calcium chloride aqueous solution was added thereto to effect laking. Then, after a heat treatment at 90° C., the reaction liquid was subjected to filtration, and the resultant pigment cake was subjected to several times of alternate washing with alkaline water and acidic water, followed by strong washing with neutral water to obtain a crude pigment, which was then heat-dried at 100° C. and pulverized to obtain Monoazo pigment composition (2-1).

Monoazo pigment composition (2-1) comprised principally a monoazo pigment (C.I. Pigment Red 150) containing 10 wt. % of calcium abietate, and also contained 12000 ppm of 3-hydroxy-2-naphthalene-carboxyamide and 14 ppm of 3-amino-4-methoxybenzanilide.

Production Example 2-2

The diazonium salt solution and the coupler solution were prepared in the same manner as in Production Example 2-1. Then, these solutions were mixed so that the diazonium salt of 3-amino-4-methoxy-benzanilide in the diazonium salt solution and the 3-hydroxy-2-naphthalenecarboxyamide in the coupler solution would provide a ratio of 1:1.03 to effect a coupling. The reaction liquid after the coupling was heated at 90° C., and subjected to several repetition of filtering and washing to recover a crude pigment, which was then heat-dried at 100° C. and pulverized to obtain Monoazo pigment composition (2-2).

Monoazo pigment composition (2-2) principally a monoazo pigment (C.I. Pigment Red 150), and also contained 18000 ppm of 3-hydroxy-2-naphthalenecarboxyamide and 27 ppm of 3-amino-4-methoxybenzanilide.

Production Example 2-3

Monoazo pigment composition (2-3) was prepared in the same manner as in Production Example 2-1 except for using N-(5-chloro-2-methoxyphenyl)-3-hydroxy-2-naphthalenecarboxyamide instead of the 3-hydroxy-2-naphthalenecarboxyamide, and effecting a coupling by mixing the diazonium salt solution and the coupler solution so that the diazonium salt of 3-amino-4-methoxybenzanilide and the N-(5-chloro-2-methoxyphenyl)-3-hydroxy-2-naphthalenecarboxyamide in the coupler solution would provide a mol ratio of 1:1.02.

Monoazo pigment composition (2-3) principally comprised a monoazo pigment (C.I. Pigment Red 269) containing 15 wt. % of calcium abietate, and also contained 5500 ppm of N-(5-chloro-2-methoxyphenyl)-3-hydroxy-naphthalenecarboxyamide and 23 ppm of 3-amino-4-methoxybenzanilide.

Production Example 2-4

Monoazo pigment composition (2-4) was prepared in the same manner as in Production Example 2-2 except for using N-(5-chloro-2-methoxyphenyl)-3-hydroxy-2-naphthalenecarboxyamide instead of the 3-hydroxy-2-naphthalenecarboxyamide, and effecting a coupling by mixing the diazonium salt solution and the coupler solution so that the diazonium salt of 3-amino-4-methoxybenzanilide and the N-(5-chloro-2-methoxyphenyl)-3-hydroxy-2-naphthalenecarboxyamide in the coupler solution would provide a mol ratio of 1:1.03.

Monoazo pigment composition (2-4) principally comprised a monoazo pigment (C.I. Pigment Red 269), and also contained 5500 ppm of N-(5-chloro-2-methoxyphenyl)-3-hydroxy-naphthalenecarboxyamide and 44 ppm of 3-amino-4-methoxybenzanilide.

Production Example 2-5

Monoazo pigment composition (2-5) was prepared in the same manner as in Production Example 2-2 except for using N-benzimidazoline-3-hydroxy-2-naphthalenecarboxyamide instead of the 3-hydroxy-2-naphthalenecarboxyamide, and effecting a coupling by mixing the diazonium salt solution and the coupler solution so that the diazonium salt of 3-amino-4-methoxybenzanilide and the N-benzimidazoline-3-hydroxy-2-naphthalenecarboxyamide in the coupler solution would provide a mol ratio of 1:1.03.

Monoazo pigment composition (2-5) principally comprised a monoazo pigment (C.I. Pigment Red 176), and also contained 3400 ppm of N-benzimidazoline-3-hydroxy-naphthalenecarboxyamide and 95 ppm of 3-amino-4-methoxybenzanilide.

Production Example 2-6

Monoazo pigment composition (2-6) was prepared in the same manner as in Production Example 2-2 except for using 54 parts of 3-amino-4-methoxyphenyl-N,N-diethylsulfonamide instead of the 3-amino-4-methoxybenzanilide, using 92 parts of N-(5-chloro-2-methoxyphenyl)-3-hydroxy-2-naphthalenecarboxyamide instead of the 3-hydroxy-2-naphthalenecarboxyamide, and effecting a coupling by mixing the diazonium salt solution and the coupler solution so that the diazonium salt of 3-amino-4-methoxyphenyl-N,N-diethylsulfonamide and the N-(5-chloro-2-methoxyphenyl)-3-hydroxy-2-naphthalenecarboxyamide in the coupler solution would provide a mol ratio of 1:1.03.

Monoazo pigment composition (2-6) principally comprised a monoazo pigment (C.I. Pigment Red 5), and also contained 5500 ppm of N-(5-chloro-2-methoxyphenyl)-3-hydroxy-naphthalenecarboxyamide and 170 ppm of 3-amino-4-methoxyphenyl-N,N-diethylsulfonamide.

Production Example 2-7

Monoazo pigment composition (2-7) was prepared in the same manner as in Production Example 2-2 except for using a 6:4 mixture of N-(2,4-dimethoxy-4-chlorophenyl)-3-hydroxy-2-naphthalenecarboxyamide and N-(5-chloro-2-methylphenyl)-3-hydroxy-2-naphthalenecarboxyamide instead of the 3-hydroxy-2-naphthalenecarboxyamide, and effecting a coupling by mixing the diazonium salt solution and the coupler solution so that the diazonium salt of 3-amino-4-methoxybenzanilide and the total of the N-(2,4-dimethoxy-4-chlorophenyl)-3-hydroxy-2-naphthalenecarboxyamide and N-(5-chloro-2-methylphenyl)-3-hydroxy-2-naphthalenecarboxyamide in the coupler solution would provide a mol ratio of 1:1.03.

Monoazo pigment composition (2-7) principally comprised a monoazo pigment (C.I. Pigment Red 184), and also contained 26,000 ppm in total of N-(2,4-dimethoxy-4-chlorophenyl)-3-hydroxy-2-naphthalenecarboxyamide and N-(5-chloro-2-methylphenyl)-3-hydroxy-2-naphthalenecarboxyamide and 190 ppm of 3-amino-4-methoxybenzanilide.

Production Example 2-8

Monoazo pigment composition (2-8) was prepared in the same manner as in Production Example 2-2 except for using 78 parts of N-(3-nitrophenyl)-3-hydroxy-2-naphthalenecarboxyamide instead of the 3-hydroxy-2-naphthalenecarboxyamide, and effecting a coupling by mixing the diazonium salt solution and the coupler solution so that the diazonium salt of 3-amino-4-methoxybenzanilide and the N-(3-nitrophenyl)-3-hydroxy-2-naphthalenecarboxyamide in the coupler solution would provide a mol ratio of 1:1.03.

Monoazo pigment composition (2-8) principally comprised a monoazo pigment (C.I. Pigment Red 31), and also contained 950 ppm of N-(3-nitrophenyl)-3-hydroxy-naphthalenecarboxyamide and 180 ppm of 3-amino-4-methoxybenzanilide.

Comparative Production Example 2-1

Comparative Monoazo pigment composition (2-1) was prepared in the same manner as in Production Example 2-8 except that the 35%-HCl aqueous solution was added at a time to the aqueous dispersion of the 3-amino-4-methoxybenzanilide, the diazonium salt solution and the coupler solution were mixed so that the diazonium salt of 3-amino-4-methoxybenzanilide in the diazonium salt solution and the N-(3-nitrophenyl)-3-hydroxy-2-naphthalenecarboxyamide would provide a mol ratio of 1:1.00, and washing the pigment cake obtained after the coupling only with neutral water.

Comparative Monoazo pigment composition (2-1) principally comprised a monoazo pigment (C.I. Pigment Red 31), and also contained 200 ppm of N-(3-nitrophenyl)-3-hydroxy-naphthalenecarboxyamide and 890 ppm of 3-amino-4-methoxybenzanilide.

Comparative Production Example 2-2

Comparative Monoazo pigment composition (2-2) was prepared in the same manner as in Production Example 2-8 except that:

the 35%-HCl aqueous solution was added at a time to the aqueous dispersion of the 3-amino-4-methoxybenzanilide, the diazonium salt solution and the coupler solution were mixed so that the diazonium salt of 3-amino-4-methoxybenzanilide in the diazonium salt solution and the N-(3-nitrophenyl)-3-hydroxy-2-naphthalenecarboxyamide would provide a mol ratio of 1:1.07, and washing the pigment cake obtained after the coupling only with neutral water.

Comparative Monoazo pigment composition (2-2) principally comprised a monoazo pigment (C.I. Pigment Red 31), and also contained 53000 ppm of N-(3-nitrophenyl)-3-hydroxy-naphthalenecarboxyamide and 340 ppm of 3-amino-4-methoxybenzanilide.

Several compositional features of (Comparative) Monoazo pigment composition produced in the above-described (Comparative) Production Examples are inclusively shown in Table 2 below.

TABLE 2

Compositional features of Monoazo pigment compositions

| Prod. Ex. | Monoazo pigment composition | diazonium salt: β-naphthol derivative (mol. ratio) | Primary Component*10 | | Substituents in Formula(1)*20 $R_1$ | $R_2$ | $R_3$ | $R_4$ | Contents (ppm) of secondary components β-naphthol derivative | aromatic amine |
|---|---|---|---|---|---|---|---|---|---|---|
| 2-1 | (2-1) | 1:1.02 | C.I.PR-150 | (90%) | $NH_2$ | $OCH_3$ | H | $CONHC_6H_5$ | 12000 | 14 |
| | | | CAB | (10%) | — | — | — | — | | |
| 2-2 | (2-2) | 1:1.03 | C.I.PR-150 | (100%) | $NH_2$ | $OCH_3$ | H | $CONHC_6H_5$ | 18000 | 27 |
| 2-3 | (2-3) | 1:1.02 | C.I.PR-269 | (85%) | (X-1) | $OCH_3$ | H | $CONHC_6H_5$ | 5500 | 23 |
| | | | CAB | (15%) | — | — | — | — | | |

TABLE 2-continued

Compositional features of Monoazo pigment compositions

| Prod. Ex. | Monoazo pigment composition | diazonium salt: β-naphthol derivative (mol. ratio) | Primary Component*10 | | Substituents in Formula(1)*20 $R_1$ | $R_2$ | $R_3$ | $R_4$ | Contents (ppm) of secondary components β-naphthol derivative | aromatic amine |
|---|---|---|---|---|---|---|---|---|---|---|
| 2-4 | (2-4) | 1:1.03 | C.I.PR-269 | (100%) | (X-1) | $OCH_3$ | H | $CONHC_6H_5$ | 7900 | 44 |
| 2-5 | (2-5) | 1:1.03 | C.I.PR-176 | (100%) | (X-2) | $OCH_3$ | H | $CONHC_6H_5$ | 3400 | 95 |
| 2-6 | (2-6) | 1:1.03 | C.I.PR-5 | (100%) | (X-3) | $OCH_3$ | H | $SO_2N(C_2H_5)_2$ | 5500 | 170 |
| 2-7 | (2-7) | 1:1.04 | C.I.PR-184** | | | | | | 26000 | 190 |
| | | | C.I.PR-146 | (60%) | (X-4) | $OCH_3$ | H | $CONHC_6H_5$ | | |
| | | | C.I.PR-147 | (40%) | (X-5) | $OCH_3$ | H | $CONHC_6H_5$ | | |
| 2-8 | (2-8) | 1:1.03 | C.I.PR-31 | (100%) | (X-6) | $OCH_3$ | H | $CONHC_6H_5$ | 950 | 180 |
| Comp. 2-1 | Comp. (2-1) | 1:1.00 | C.I.PR-31 | (100%) | (X-6) | $OCH_3$ | H | $CONHC_6H_5$ | 200 | 890 |
| Comp. 2-2 | Comp. (2-2) | 1:1.10 | C.I.PR-31 | (100%) | (X-6) | $OCH_3$ | H | $CONHC_6H_5$ | 53000 | 340 |

*10C.I.PR = C.I. Pigment Red, CAB = calcium abietate.

**C.I.PR-184 is a pigment composition of 60% of C.I.PR-146 and 40% of C.I.PR-147.

*20

X-1:

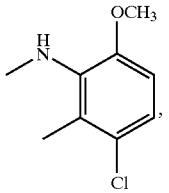

X-2:

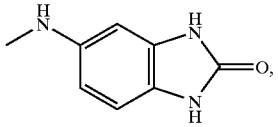

X-3:

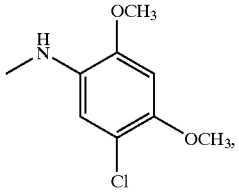

X-4:

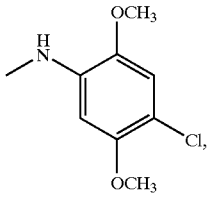

X-5:

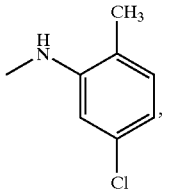

X-6:

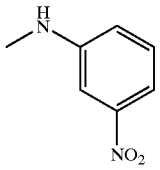

<Toners>

Production Example 2-1

Into a 2 liter-four-necked flask equipped with a high-speed stirrer ("CLEARMIX", made by M. Technique K.K.), 700 parts of deionized water and 800 parts of 0.1 mol/l-$Na_3PO_4$ aqueous solution were charged and heated to 60° C. under stirring at 10,000 rpm. Then, 70 parts of 1.0 mol/l-$CaCl_2$ aqueous solution and a small amount of dilute hydrochloric acid were added thereto to prepare an aqueous dispersion medium (pH 5) containing minute particles of $Ca_3(PO_4)_2$ (hardly water-soluble dispersing agent).

On the other hand, a mixture comprising

| | |
|---|---|
| Quinacridone pigment composition (2-1) (containing 90 wt. % of solid solution of C.I. Pigment Red 122 and C.I. Pigment Violet 19, and 10 wt. % of calcium abietate) | 5 part(s) |
| Monoazo pigment composition (2-1) (principally comprising 90 wt. % of C.I. Pigment Red 150 and 10 wt. % of calcium abietate) | 3 part(s) |
| Styrene monomer | 43 part(s) |
| Charge control agent (dialkylsalicylic acid Al compound) | 1 part(s) |
| Polyester resin (Mp = 5500, Acid value = 30 mg/KOH/g) | 5 part(s) |

was subjected to 4 hours of dispersion by means of an attritor (made by Mitsui Kinzoku K.K.) to prepare a pigment dispersion composition.

Further, in a separate vessel, a mixture comprising

| | |
|---|---|
| Styrene monomer | 40 part(s) |
| n-Butyl acrylate monomer | 17 part(s) |
| Divinylbenzene monomer | 0.2 part(s) |
| Ester wax (represented by $C_{17}H_{35}COOC_{18}H_{37}$, Tmp = 64° C.) | 7 part(s) |

was charged, and 57 parts of the above-prepared pigment dispersion composition was added thereto for dispersion and mixing, followed by addition and mixing of 3 parts of 2,2'-azobis(2,4-dimethylvaleronitrile) to prepare a polymerizable monomer composition.

The polymerizable monomer composition was charged to the above-prepared aqueous dispersion medium under stirring at an elevated stirring speed of 15,000 rpm, and the stirring was continued for 5 min. at an internal temperature of 60° C. under $N_2$ atmosphere, to form droplets of the polymerizable monomer composition. Then, the stirrer was changed to a paddle stirrer, and under stirring at 200 rpm, the system was held at the same temperature for 5 hours. Then, $Na_2CO_3$ was added to the system to adjust the aqueous dispersion medium at pH 10, and the system was further heated to 80° C. to continue the polymerization up to a conversion of ca. 100%.

After completion of the polymerization, residual monomer was distilled off under heating and a reduced pressure, and after cooling, dilute hydrochloric acid was added to the system to dissolve the dispersing agent. Then, the polymerizate was subjected to several times of repeated washing with water, and drying by means of a conical ribbon-type drier (made by Ohkawara Seisakusho K.K.) to obtain Polymerizate particles (2-A).

100 parts of Polymerizate particles (2-A) were dry-blended with 1 part of silicone oil-treated hydrophobic silica fine powder ($S_{BET}$=200 $m^2/g$) and 0.5 part of silicone oil-treated titania fine powder ($S_{BET}$=50 $m^2/g$) by means of a HENSCHEL mixer (made by Mitsui Kinzoku K.K.) to obtain Toner (2-A) showing a volume-average particle size (Dv) of 6.5 $\mu$m.

Some compositional features of Toner (2-A) thus obtained are summarized in Table 3 appearing hereinafter together with those of Toners obtained in Production Examples and Comparative Production Examples described below.

Production Examples 2-2 to 2-10

Toners (2-B) to (2-J) were prepared in the same manner as in Production Example 2-1 except for changing the species and amounts of Quinacridone pigment compositions and Monoazo pigment compositions, and changing the species and amounts of the wax components, respectively as shown in Table 3.

Comparative Production Examples 2-1 to 2-3

Comparative Toners (2-a) to (2-c) were prepared in the same manner as in Production Example 2-1 except for charging the species and amounts of Quinacridone pigment compositions and Monoazo pigment compositions, and the species and amounts of the wax components, respectively as shown in Table 3.

Comparative Production Example 2-4

Comparative Toner (2-d) was prepared in the same manner as in Production Example 2-1 except for using, as a monoazo pigment composition, a carmine pigment composition (C.I. Pigment Red 57:1, containing 65,000 ppm of 3-hydroxy-2-naphthoic acid and 390 ppm of 2-amino-5-methylbenzenesulfonic acid), and paraffin wax (Tmp=60° C.) as a wax component.

Representative prescriptions and some properties of Toners prepared in the above Production Examples and Comparative Production Examples are summarized in the following Table 3, wherein the contents of the colorant and the pigment compositions are indicated in wt. parts per 100 wt. parts of the binder resin, the contents of β-naphthol derivative and aromatic amine are indicated in ppm by weight of the monoazo pigment composition.

TABLE 3

| Compositional features of Toners | | | | | | | | | | | | | |
|---|---|---|---|---|---|---|---|---|---|---|---|---|---|
| | | Colorants | | | | | | | | Toner properties | | | |
| | | Quin-cridone pigment*1 | | Monoazo | | Total | | Wax component | | β-naphthol derivative | aromatic amine | | wax |
| Prod. Ex. | Toner | compo-sition | (wt. parts) | pigment*1 composition | (wt. parts) | content (wt %) | Quinacridone/ Monoazo | species*2 | wt. parts | content (ppm) | content (ppm) | Dv (μm) | dispersion (r/R) av. |
| 2-1 | (2-A) | (2-1) | 5 | (2-1) | 3 | 8 | 62.5:37.5 | ester | 7 | 11700 | 12 | 6.5 | 0.28 |
| 2-2 | (2-B) | (2-2) | 5 | (2-1) | 3 | 8 | 62.5:37.5 | do. | 7 | 11800 | 15 | 6.4 | 0.25 |
| 2-3 | (2-C) | (2-2) | 5 | (2-2) | 3 | 8 | 62.5:37.5 | do. | 7 | 17500 | 20 | 6.8 | 0.27 |
| 2-4 | (2-D) | (2-2) | 5 | (2-3) | 3 | 8 | 62.5:37.5 | do. | 10 | 5100 | 15 | 6.3 | 0.32 |
| 2-5 | (2-E) | (2-2) | 6 | (2-4) | 3 | 9 | 66.7:33.3 | do. | 10 | 7700 | 33 | 6.4 | 0.35 |
| 2-6 | (2-F) | (2-2) | 4 | (2-5) | 4 | 8 | 50:50 | do. | 5 | 3300 | 82 | 6.2 | 0.18 |
| 2-7 | (2-G) | (2-3) | 3 | (2-6) | 6 | 9 | 33.3:66.7 | do. | 5 | 5400 | 150 | 6.5 | 0.16 |
| 2-8 | (2-H) | (2-4) | 4 | (2-7) | 4 | 8 | 50:50 | paraffin | 15 | 25500 | 170 | 6.4 | 0.40 |
| 2-9 | (2-I) | (2-5) | 3 | (2-8) | 6 | 9 | 33.3:66.7 | do. | 5 | 850 | 170 | 6.5 | 0.19 |
| 2-10 | (2-J) | — | — | (2-4) | 6 | 5 | 0:100 | do. | 5 | 7700 | 35 | 6.7 | 0.20 |
| Comp. 2-1 | Comp. (2-a) | (2-5) | 2 | Comp. (2-1) | 7 | 9 | 22.2:77.8 | do. | 7 | 150 | 670 | 6.6 | 0.26 |
| Comp. 2-2 | Comp. (2-b) | (2-5) | 7 | Comp. (2-2) | 2 | 9 | 77.8:22.2 | do. | 7 | 31500 | 320 | 6.5 | 0.30 |
| Comp. 2-3 | Comp. (2-c) | (2-5) | 8 | — | — | 8 | 100:0 | do. | 25 | 0 | 0 | 6.4 | 0.81 |
| Comp. 2-4 | Comp. (2-d) | — | — | Carmine | 5 | 5 | 0:100 | do. | 2 | 64000 | 350 | 6.6 | 0.04 |

*1Some composition contains calcium abietate.
*2All paraffin waxes were the same having a melting point of 60° C.

Cyan Toner Production Example

Cyan toner was prepared through polymerization in a similar manner as in Production Example 2-1 except for using 6 wt. parts of C.I. Pigment Blue 15:3 as the pigment.

Yellow Toner Production Example

Yellow toner was prepared through polymerization in a similar manner as in Production Example 2-1 except for using 7 wt. parts of C.I. Pigment Yellow 93 as the colorant.

Black Toner Production Example

Black toner was prepared through polymerization in a similar manner as in Production Example 2-1 except for using 10 wt. parts of carbon black (particle size=35 nm) as the colorant.

<Toner Performances>

EXAMPLE 2-1

Toner (2-A) produced in Production Example 2-1 was subjected to an image forming test according to a single color-mode by using a full-color image forming apparatus having an organization as described with reference to FIG. 1. The developing roller was driven to provide a circumferential speed which was 120% of that of the photosensitive drum 1. The photosensitive drum 1 was Photosensitive drum (2-1) and the intermediate transfer belt 5 was Intermediate transfer belt (2-1) produced in respective Production Examples (2-1). The fixing device 14 was a hot roller-type heat-pressure fixing device as illustrated in FIG. 3 having no separation claw or offset-preventing liquid application mechanism.

More specifically, referring to FIG. 3, the fixing device included a fixing roller 11 and a pressure roller 12. The fixing roller 11 was formed by coating an aluminum cylinder successively with a primer layer, an elastic layer of dimethylsilicone rubber, a primer layer and a 50 μm-thick surface layer of PFA (tetrafluoroethylene-perfluoroalkyl ether copolymer) tube. On the other hand, the pressure roller 12 was formed by coating a stainless steel-made cylinder successively with a primer layer, a dimethyl silicone rubber layer, a primer layer and a 50 μm-thick PFA surfacing tube. Inside the cylinder of the heating roller 11 was disposed a halogen heater for providing a fixing roller surface temperature of 180° C. at the time of heat-pressure fixing operation. An abutting pressure of 30 kg.f was applied to form a 3.5 mm-wide nip between the heating roller 11 and the pressure roller 12.

Figure 7:
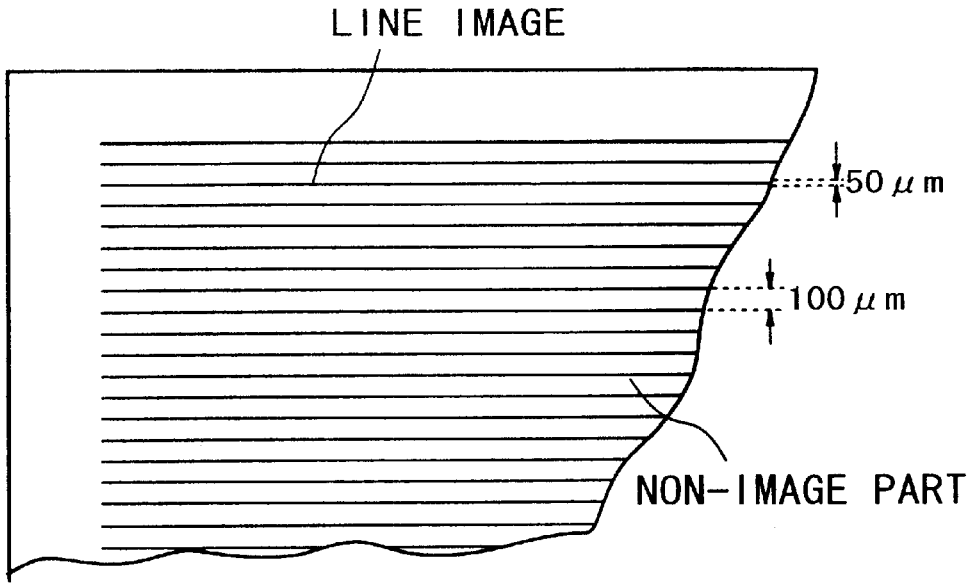
FIG. 7 illustrates a line image for evaluating reproducibility and fixing state of thin lines.

Toner (2-A) was charged in the second color developing device 42 and subjected to a monocolor-mode printing of a thin line-pattern as shown in FIG. 7 on $1.5\times10^5$ sheets of recycle paper ("RECYCLE PAPER EN-100", made by Canon; made from 100%-regenerated pulp) at a rate of 12 (A4-size) sheets/min. As for toner performances, image qualities were evaluated with respect to a printed image at the time of printing on $1.5\times10^4$ sheets, matching with the photosensitive drum and the intermediate transfer belt of the image forming apparatus was evaluated after printing on $1.5\times10^4$ sheets, and matching with the fixing device was evaluated after printing on $1.5\times10^5$ sheets.

Further, a full-color image forming test was performed by using the same image forming apparatus after charging Yellow toner, Cyan toner, and Black toner prepared in the respective Production Examples in the first, third and fourth developing devices 41, 43 and 44 in addition to Toner (2-A) charged in the second developing device 42. The full-color image forming test was performed by printing full-color graphic images on a transparency film ("OHP FILM CG 3700", made by Sumitomo 3M K.K.) at a rate of 1 sheet (A 4-size)/min., and the full-color image formed thereby was projected on a white wall and evaluated in a manner described hereinafter.

Incidentally, similar full-color images were also printed on recycle paper ("RECYCLE PAPER EN-100", made by Canon K.K.) at a rate of 3 sheets (A4-size)/min., whereby good images were obtained with excellent color reproducibility and thin line reproducibility and with suppressed image peeling.

Toner performances were generally evaluated with respect to items described hereinafter and the results thereof are inclusively shown in Table 4 appearing hereinafter together with those of Examples and Comparative Examples described below.

EXAMPLES 2-2 to 2-10

Toners (2-B) to (2-J) were evaluated in the same manner as in Example 2-1 except for additionally changing the intermediate transfer belt, as desired, as shown in Table 4.

EXAMPLE 2-11

Toner (2-F) (used in the above-described Example 2-6 was evaluated in the same manner as in Example 2-1 except that the fixing device was equipped with a roller impregnated with dimethylsilicone oil (as an offset-preventing oil) abutted against the fixing roller (11 in FIG. 3) so as to provide an oil consumption rate of 0.015–0.020 kg/cm$^2$ (area of transfer paper).

As a result, the printed images were somewhat accompanied with some gloss and resulted in somewhat sticking finger touch, and the OHP full-color projected image was somewhat inferior in color reproducibility and transparency. However, some improvement was observed with respect to matching with the fixing deice, etc. Other results are also shown in Table 4.

Comparative Examples 2-1 to 2-4

Comparative Toners (2-a) to (2-d) were evaluated in the same manner as in Example 2-1 except for additionally changing the intermediate transfer belt, as desired, as shown in Table 4.

The evaluation items shown in Table 4 and standards thereof are described below.

<1> Image Density (I.D.)

A 5 mm-square solid image was printed on plain paper (75 g/m$^2$) and the image density thereof was measured by a reflection densitometer ("MACBETH RD 918", made by Macbeth Co.) as a relative density with reference to a printed image of white background portion. Based on the measured relative image density (ID), the evaluation was performed according to the following standard.

S: ID≧1.40

B: 1.30≦ID<1.40

C: 1.00≦ID<1.30

D: ID<1.00

<2> Image fog (Fog)

Toner at a part between the developing step and the transfer step on the photosensitive drum at the time of forming a solid white image was peeled off by a polyester adhesive types and applied onto white paper together with the adhesive tape to measure a reflection density (Dm), and a blank polyester adhesive tape alone was applied on the same white paper to measure a reflection density (Db) respectively by a reflection densitometer ("Macbeth RD918"). A fog image density (Df) was calculated as a difference between the measured densities (Dm–Db). A smaller fog image density represents better suppression of fog. Based on the thus-obtained fog image density (Df), the evaluation was performed according to the following standard.

A: Df<0.03

B: 0.03≦Df<0.07

C: 0.07≦Df<1.00

D: Df≧1.00

<3> Thin-line Reproducibility (Resolution)

Reproducibility of thin lines (as shown in FIG. 7) as an item for evaluation of image quality and gradation of graphical images according to the following standard:

A: Good thin line reproducibility.

B: Slight change in width of thin lines was observed.

C: Noticeable local thinning of lines and scattering observed.

D: Thin lines were broken at some parts, thus showing inferior reproducibility.

<4> Image Peeling (Image Peel)

After printing on 15,000 sheets in an environment of normal temperature/normal humidity (25° C./60%RH), a solid image with a toner coverage of ca. 0.8 mg/cm$^2$ was printed on rather thin transfer paper (ca. 105 g/m$^2$, A4-size), and the printed image was observed with eyes regarding the number of peeling parts on the image and evaluated according to the following standard.

A: Not observed at all.

B: 1 to 5 parts.

C: 6 to 10 parts.

D: 11 parts or more (or peeling in size of 2 mm or larger in diameter)

<5> Light-fastness of Images

After printing on 15,000 sheets in an environment of normal temperature/normal humidity (25° C./60%RH), a solid image with a toner coverage of ca. 0.6 mg/cm$^2$ was formed on transfer paper and exposed to ultraviolet rays for 240 hours from a carbon arc lamp by using a UV-auto-fade meter ("FAL-AU", made by Suga Shikenki K.K.). An image density after the exposure was divided by an image density before exposure to obtain an image density-retention percentage, based on which the lightfastness was evaluated according to the following standard.

A: >=90%

B: ≧80% and <90%

C: ≧65% and <80%

D: <65%

<6> Color Reproducibility and Transparency of Full-color Projection Image

Full color images on an OHP sheet formed in a normal temperature/normal humidity (25° C./60%RH) environment, were projected by an OHP ("9550", made by 3M Co.) onto a white wall, and the projected images were evaluated with eyes and subjected to measurement of lightness L*, chromatic index a* representing a degree of red or green and chromatic index b* representing a degree of yellow or blue according to the CIE-Lab color space by a spectral radiation luminance meter (made by Photo Research K.K.) to obtain a volume of color space. Based on the measured color space volume values, the evaluation was performed according to the following standard.

<Eye Observation>

A: Secondary colors (red and blue) exhibited clear color reproducibility and excellent transparency.

B: Excellent color reproducibility of magenta but somewhat inferior color reproducibility of secondary colors.

C: Somewhat inferior color reproducibility and transparency of magenta.

D: Inferior color reproducibility of magenta and resulted in sombre images.

<Color Space Volume>

A: $\geqq 2.50\times10^6$

B: $\geqq 2.00\times10^6$ and $<2.50\times10^6$

C: $\geqq 1.50\times10^6$ and $<2.00\times10^6$

D: $<1.50\times10^6$.

<7> Matching with Photosensitive Drum (Drum)

After the printing test, the state of scars and toner sticking on the photosensitive drum surface and the influence thereof to the printed images were evaluated with eyes.

A: No scars or sticking.

B: Some scars observed but no sticking.

C: Sticking observed but having little affected the images.

D: Much sticking and having resulted in longitudinal streak image defects.

<8> Matching with the Intermediate Transfer Belt (Belt)

After the printing test, the cleanability of transfer residual toner was evaluated by observing the intermediate transfer belt (5) and the charging cleaning roller (9 in FIG. 1) and influence thereof on the printed images respectively with eyes, and the evaluation was effected according to the following standard.

A: No residual toner on the transfer belt and the cleaning roller.

B: Slight toner soil was observed on the cleaning roller but not affected the printed images.

C: Toner soil was observed on the cleaning roller, and toner attachment was observed on the belt surface.

D: Remarkable toner soiling was observed on the cleaning roller, the cleaning on the belt surface was difficult, and the printed image qualities were affected thereby.

<9> Matching with a Hot Roller Fixing Device (Fixer)

After the printing test, the heating roller surface was observed with respect to residual toner sticking thereto and influence thereof on the printed images.

A: No toner sticking.

B: Soiling with paper dust and toner sticking at edges were observed, but not substantially affected the fixed images.

C: The back sides of printed images were slightly soiled due to paper dust soil and toner sticking at edges, but the fixed images were not substantially affected.

D: Fixed images were affected by toner sticking, and winding of the printed image products occurred during the printing test.

Incidentally, the image formation tests and evaluation were generally performed in the environment of normal temperature/normal humidity (25° C./60% RH), but some were performed also in environments of low temperature/low humidity (15° C./10% RH) and high temperature/high humidity (30° C./80% RH).

TABLE 4

| | | | | Toner performance | | | | | | | | | | | | |
|---|---|---|---|---|---|---|---|---|---|---|---|---|---|---|---|---|
| | | | Anti-offset | Mono color | | | | | | | | Full-color | | | | |
| | | Intermediate | oil | 25° C./60% RH | | | 15° C./10% RH | | | | | Projected image | | | | |
| Example | Toner | transfer belt | (mg/cm$^2$) | I.D. | Fog | Resolution | I.D. | Fog | Resolution | Image peel | Light-fastness | with eyes | color space | Matching with: Drum | Belt | Fixer |
| 2-1 | (2-A) | (2-1) | 0 | A | A | A | A | A | A | A | A | A | A | A | A | A |
| 2-2 | (2-B) | (2-1) | 0 | A | A | A | A | A | B | A | A | A | A | A | A | A |
| 2-3 | (2-C) | (2-2) | 0 | A | A | A | A | A | B | A | A | A | A | A | A | A |
| 2-4 | (2-D) | (2-2) | 0 | A | A | A | A | A | A | A | A | A | A | A | A | A |
| 2-5 | (2-E) | (2-2) | 0 | A | A | A | A | A | B | A | A | A | B | A | A | A |
| 2-6 | (2-F) | (2-2) | 0 | A | A | B | A | A | B | A | B | B | B | B | B | B |
| 2-7 | (2-G) | (2-2) | 0 | A | B | B | A | C | C | A | B | C | C | B | C | B |
| 2-8 | (2-H) | (2-2) | 0 | A | B | B | A | C | C | A | B | B | C | C | C | B |
| 2-9 | (2-I) | (2-2) | 0 | A | B | B | A | C | C | A | B | C | C | B | C | B |
| 2-10 | (2-J) | (2-2) | 0 | A | A | A | A | B | B | A | C | C | C | B | B | A |
| 2-11 | (2-F) | (2-2) | 0.015~0.020 | A | A | B | A | A | B | A | B | C | B | B | B | A |
| Comp. 2-1 | Comp. (2-a) | (2-2) | 0 | A | C | C | A | D | D | B | C | C | D | C | D | B |
| Comp. 2-2 | Comp. (2-b) | (2-2) | 0 | A | C | C | A | D | D | C | B | B | C | D | D | C |
| Comp. 2-3 | Comp. (2-c) | Comp. (2-1) | 0 | B | B | B | B | C | C | D | A | B | B | D | D | D |
| Comp. 2-4 | Comp. (2-d) | Comp. (2-2) | 0 | B | B | C | B | C | D | B | D | C | C | B | C | B |

EXAMPLE 2-12

Toner (2-A) produced in Production Example 2-1 was subjected to an image forming test according to a single color-mode by using a full-color image forming apparatus having an organization as described with reference to FIG. 2. Each developing roller was driven to provide a circumferential speed which was 150% of that of an associated photosensitive drum in an identical direction. Each photosensitive drum (119*a*–119*d*) was Photosensitive Drum (2-2) produced in Production Example (2-2). The fixing device 23 was an electromagnetic induction-type heat-pressure fixing device as shown in FIG. 6.

More specifically, with reference to FIG. 6, the fixing device included a cylindrical heat-resistant endless film 447 having a three-layer structure including a 50 $\mu$m-thick cylindrical nickel substrate film (as a heat-generating layer), of which the outer surface was coated successively with an elastic layer of dimethylsilicone rubber and a release layer of PFA. On the other hand, a pressure film 448 was formed by coating a stainless steel-made cylinder substrate successively with a primer layer, an elastic foam layer of dimethylsilicone rubber, a primer layer and a 50 μm-thick surface tube of PFA. Inside the cylindrical heat-resistant endless, an electromagnetic induction heating device 442 including a magnetic field generating member 440 was disposed so as to provide a surface temperature of 180° C. to the heat-resistant endless film 447 at the time of operation. Further, the magnetic field-generating member 440 and the pressure roller 448 were abutted to each other via the endless film 447 at an abutting pressure of 25 kg.f so as to form a 6 mm-wide nip therebetween.

Toner (2-A) was charged in the second color developing device 117*b* and subjected to a monocolor-mode printing of character images having an image areal percentage of 4% on $1.5\times10^5$ sheets of recycle paper ("RECYCLE PAPER EN-100", made by Canon; made from 100%-regenerated pulp) at a rate of 16 (A4-size) sheets/min. As for toner performances, image qualities were evaluated with respect to a printed image at the time of printing on $1.5\times10^4$ sheets and matching with some members of the image forming apparatus were evaluated after printing on $1.5\times10^5$ sheets. The respective printed images were evaluated with respect to items described hereinafter and the results thereof are inclusively shown in Table 5 appearing hereinafter together with those of Examples and Comparative Examples described below.

EXAMPLES 2-13 to 2-21

Toners (2-B) to (2-J) were evaluated in the same manner as in Example 2-12.

Comparative Examples 2-5 to 2-8

Comparative Toners (2-a) to (2-d) were evaluated in the same manner as in Example 2-12.

The evaluation items shown in Table 5 and standards thereof are described below.

<1> Image Density (I.D.)

The same as in Table 4.

<2> Image Fog (Fog)

The same as in Table 4.

<3> Dot Reproducibility (Dot)

Figure 8:
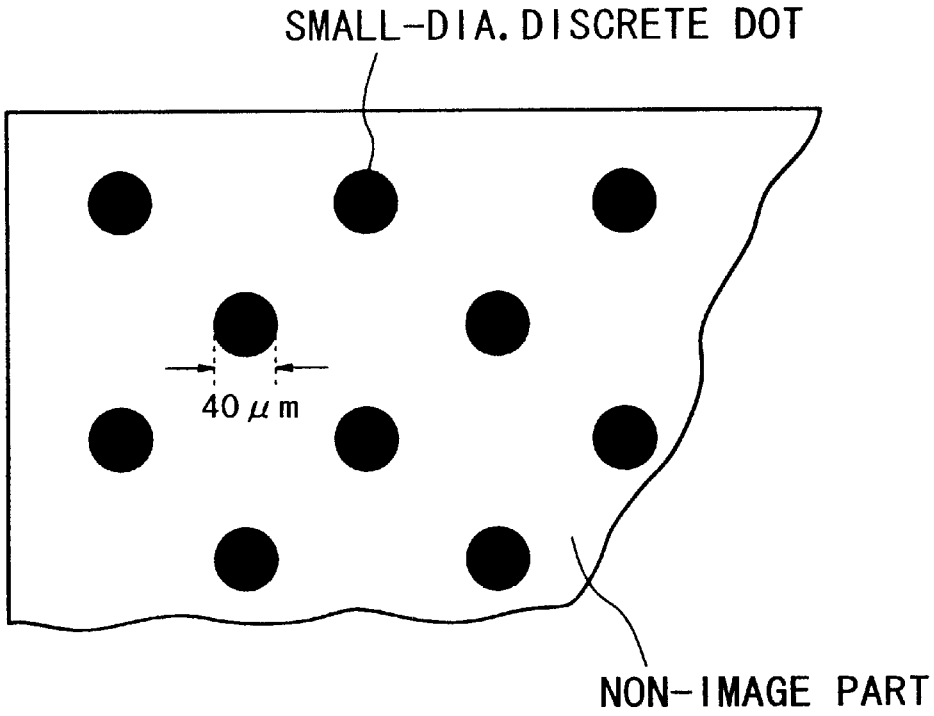
FIG. 8 illustrates a small-diameter discrete dot pattern for evaluating resolution.

A pattern of small discrete dots (of 40 μm in diameter) as shown in FIG. 8 was printed for evaluating dot reproducibility. It is known that such a small dot is difficult to reproduce because the electric field is liable to be closed due to the latent image electric field. The evaluation was performed based on the number of lacked dots per 100 dots according to the following standards.

A: At most 2 lacked dots.

B: 3–5 lacked dots.

C: 6–10 lacked dots.

D: 11 or more lacked dots.

<4> Image Peel

The same as in Table 4.

<5> Matching with Developing Roller (Sleeve)

After the printing test, the state of residual toner sticking on the developing roller (sleeve) surface and the influence thereof to the printed images were evaluated with eyes.

A: No sticking.

B: Some soiling observed but substantially no sticking.

C: Sticking observed but having little affected the images.

D: Much sticking and having resulted in image irregularity.

<6> Matching with Photosensitive Drum (Drum)

After the printing test, the state of scars and toner sticking on the photosensitive drum surface and the influence thereof to the printed images were evaluated with eyes.

A: No sticking.

B: Some scars observed but no sticking.

C: Sticking observed but having little affected the images.

D: Much sticking and having resulted in longitudinal streak image defects.

<7> Matching with Transfer-material Conveyer Belt (Belt)

After the printing, the state of toner sticking onto the surface of the transfer material-conveyer belt (120 in FIG. 2), and influences thereof on the other image forming units, were observed with eyes and evaluated according to the following standard.

A: No toner attachment on the belt surface.

B: Very slight toner soil observed on the belt surface.

C: Toner soil was observed on the belt surface but not affected the other image forming units.

D: Mingling of transfer residual toner into other image forming units occurred presumably via the conveyer belt.

<8> Matching with a Heat-resistant Endless Film (Fixer Film)

After the printing test, the surface of the endless film (447 in FIG. 6) was observed with respect to residual toner sticking thereto and influence thereof on the printed images.

A: No toner sticking.

B: Soiling with paper dust observed, but substantially no toner sticking.

C: Soiling with paper dust and toner sticking at edges were observed, but not substantially affected the fixed images.

D: Winding of the printed image products occurred during the printing test.

TABLE 5

| | | Toner performances | | | | | | | | | | |
|---|---|---|---|---|---|---|---|---|---|---|---|---|
| | | Printed image evaluation | | | | | | | | | | |
| | | 25° C./60% RH | | | 30° C./80% RJ | | | Image | Matching with: | | | |
| Example | Toner | I.D. | Fog | Dot | I.D. | Fog | Dot | peel | Sleeve | Drum | Belt | Fixer film |
| 2-12 | (2-A) | A | A | A | A | A | A | A | A | A | A | A |
| 2-13 | (2-B) | A | A | A | A | A | B | A | A | A | A | A |
| 2-14 | (2-C) | A | A | A | A | A | B | A | A | A | A | A |
| 2-15 | (2-D) | A | A | A | A | A | B | A | A | A | A | A |

TABLE 5-continued

| | | Toner performances | | | | | | | | | | |
|---|---|---|---|---|---|---|---|---|---|---|---|---|
| | | Printed image evaluation | | | | | | | | | | |
| | | 25° C./60% RH | | | 30° C./80% RJ | | | Image | Matching with: | | | |
| Example | Toner | I.D. | Fog | Dot | I.D. | Fog | Dot | peel | Sleeve | Drum | Belt | Fixer film |
| 2-16 | (2-E) | A | A | A | A | A | B | A | A | A | A | A |
| 2-17 | (2-F) | A | A | B | B | B | B | A | B | C | B | B |
| 2-18 | (2-G) | A | B | B | C | C | C | A | C | B | C | B |
| 2-19 | (2-H) | A | B | B | C | C | C | A | B | C | C | B |
| 2-20 | (2-I) | A | B | B | B | C | C | A | C | B | C | B |
| 2-21 | (2-J) | A | A | A | A | B | B | A | A | B | B | A |
| Comp. 2-5 | Comp. (2-a) | A | C | C | A | D | D | B | C | C | D | B |
| Comp. 2-6 | Comp. (2-b) | A | C | C | B | D | C | C | D | D | D | C |
| Comp. 2-7 | Comp. (2-c) | B | B | B | B | D | C | D | D | D | D | D |
| Comp. 2-8 | Comp. (2-d) | B | B | C | B | C | D | B | C | B | C | B |

EXAMPLE 2-22

The same full-color image forming apparatus as used in Example 2-12 was used for a full-color image forming test. More specifically, in addition to charging Toner (2-A) prepared in Production Example 2-1 in the second developing device 117*b,* Yellow toner, Cyan toner and Black toner were charged in the first, third and fourth developing devices 117*a,* 117*c* and 117*d,* respectively, of the image forming apparatus shown in FIG. 2. The full-color image forming test was performed by printing full-color graphic images on recycle paper ("RECYCLE PAPER EN-100") at a rate of 16 sheets (A4-size)/min. and a transparency film ("OHP FILM CG3700", made by Sumitomo 3M K.K.) at a rate of 4 sheets (A4-size)/min., otherwise in the same manner as in Example 2-12.

As a result, full-color images excellent in color reproducibility and thin line reproducibility were formed, and no image peeling was caused.

EXAMPLE 2-23

Toner (2-A) was evaluated by a monocolor-mode image forming test in the normal temperature/normal humidity environment by charging it into a second color image forming unit of an image forming apparatus, having an organization as shown in FIG. 2 in a similar manner as in Example 2-12 except that the image forming apparatus shown in FIG. 2 was modified as follows.

The cleaning device (118*b*) for the second color image forming unit was removed, and the developing roller 115 was remodeled so as to be rotated to provide a circumferential speed which was 130% of that of the photosensitive drum 119*b* in an identical direction at their mutually contacting position. The photosensitive drum 119*b* was photosensitive drum (2-2) prepared in Production Example (2-2), and the process conditions were set as shown below so as to recover transfer residual toner on the photosensitive drum by the developing roller 115*b*.

Drum surface dark-part potential=−700 volts

Drum surface light-part potential=−150 volts

Bias voltage to the developing roller=−450 volts (DC alone)

Further, the fixing device 123 was replaced with a film-type heat-pressure means shown in FIGS. 5A and 5B having no separation claw or offset-preventing liquid application mechanism.

In the fixing device, the heat-resistant endless film 332 comprised a 60 μm-thick polyimide film coated, on its surface contacting with transfer materials, with a low-resistivity release layer comprising polytetrafluoroethylene with a conductive filler. The pressure roller 333 was formed by coating a stainless steel-made core metal successively with a primer, an elastic layer of dimethylsilicone rubber foam, a primer, a dimethylsilicone rubber elastic layer and a 20 μm-thick surface layer of polytetrafluoroethylene. Inside the endless film 332 was disposed a fixed heating member 331 comprising a heater substrate, a heat generator screen-printed thereon and a heat-resistant surface protective layer. The heating member was operated so as to provide a surface temperature of 170° C. in operation. Further, the heating member and the pressure roller were abutted to each other via the endless film at an abutting pressure of 10 kg-f so as to form a 5 mm-wide nip.

Toner performances were evaluated with items described below and results thereof are shown in Table 6 together with those of Examples and Comparative Examples described below.

EXAMPLES 2-24 to 2-32

Comparative Examples 2-9 to 2-12

Toners (2-B) to (2-J) and Comparative Toners (2-a) to (2-d) were evaluated in the same manner as in Example 2-23.

Toner performances were evaluated with respect to the following items and results are shown in Table 6 inclusively.

<1> Image Density (I.D.)

The same as in Table 4.

<2> Image Soil

A halftone image formed by repetition of 1 dot-wide line and 1 dot-wide space was printed, and the degree of soiling of the halftone image was evaluated with eyes according to the following standard:

A: No soil at all.

B: Slight soil observed.

C: Minute black spot soil observed.

D: Periodical stripe soil or vertical streak soil observed.

<3> Dot Reproducibility (Dot)

The same as in Table 4.

<4> Matching with a Charging Roller (Charger)

A weight per unit area of toner attached to the charging roller was measured, and evaluation was performed based on the measured toner weight according to the following standard:

A: <0.20 mg/cm$^2$

B: ≧0.20 mg/cm$^2$ and <0.35 mg/cm$^2$

C: ≧0.35 mg/cm$^2$ and <0.55 mg/cm$^2$

D: ≧0.55 mg/cm$^2$

<5> Matching with Developing Roller (Sleeve)

The same as in Table 5.

<6> Matching with Photosensitive Drum (Drum)

The same as in Table 4.

<7> Matching with Transfer Material-conveyer Belt (Belt)

The same as in Table 5.

<8> Matching with a Film-type Fixing Device (Fixer Film)

The same as in Table 5.

TABLE 6

| | | Toner performances | | | | | | | | |
|---|---|---|---|---|---|---|---|---|---|---|
| | | Printed image evaluation | | | | Matching with: | | | | |
| Example | Toner | I.D. | Image soil | Dot | Image peel | Charger | Sleeve | Drum | Belt | Fixer film |
| 2-23 | (2-A) | A | A | A | A | A | A | A | A | A |
| 2-24 | (2-B) | A | A | A | A | A | A | A | A | A |
| 2-25 | (2-C) | A | A | A | A | B | A | A | B | A |
| 2-26 | (2-D) | A | A | A | A | A | A | A | A | A |
| 2-27 | (2-E) | A | B | A | A | B | A | A | B | A |
| 2-28 | (2-F) | B | C | B | A | C | B | C | B | B |
| 2-29 | (2-G) | B | B | B | A | C | C | B | C | B |
| 2-30 | (2-H) | B | C | B | A | C | B | C | C | B |
| 2-31 | (2-I) | B | B | B | A | C | C | B | C | B |
| 2-32 | (2-J) | B | B | A | A | C | A | B | B | A |
| Comp. 2-9 | Comp. (2-a) | B | D | D | B | D | C | C | D | B |
| Comp. 2-10 | Comp. (2-b) | B | D | D | C | D | D | D | D | C |
| Comp. 2-11 | Comp. (2-c) | B | C | C | D | C | D | D | D | D |
| Comp. 2-12 | Comp. (2-d) | C | D | D | B | D | C | B | C | B |

EXAMPLE 2-33

A full-color image forming test was performed in the same manner as in Example 2-22 by using the image forming apparatus shown in FIG. 2 except for further removing the cleaning device 118*b* from the second image forming unit Pb.

As a result, full-color images excellent in color reproducibility and thin line reproducibility were formed, and no image peeling was caused.

<Charging Rollers>

Charging rollers used in Examples and Comparative Examples described hereinafter were prepared in the following manner.

Production Example 1

The following ingredients were blended and kneaded in a closed-type mixer warmed at 45° C. to prepare a starting compound.

| | |
|---|---|
| Epichlorohydrin Terpolymer rubber (epichlorohydrin/ethylene oxide/acrylic glycidyl ether = 40/56/4 (by mol)) | 100 part(s) |
| Light calcium carbonate | 10 part(s) |
| Stearic acid | 1 part(s) |
| 2-Mercaptobenzimidazole (anti-aging agent) | 0.5 part(s) |
| Zinc oxide | 5 part(s) |
| Quaternary ammonium salt | 4 part(s) |

To the above-prepared starting compound, 1 wt. part of vulcanizer (sulfur), 1 wt. part of vulcanization accelerator 1 (DM: dibenzothiadisulfide) and 0.5 wt. part of vulcanization accelerator 2 (TS: tetramethylthiuram monosulfide) were added, and the blend was kneaded by means of a two-roller mill cooled at 20° C. The resultant compound was shaped through an extruder into a tube so as to cover a 6 mm-outer dia. stainless steel core metal, thereby providing a roller having an outer diameter of 15 mm. After being vulcanized in a heated steam atmosphere, the roller was ground into a roller having an outer diameter of 12 mm by using a wide grindstone, thereby forming Roller (1) having an elastic layer.

Separately, for providing a coating layer paint,

| | |
|---|---|
| Caprolactone-modified acryl polyol solution (solid matter 20 wt. %, in solvent MEK) | 100 parts |
| Electroconductive tin oxide (treated with titanate coupling agent) | 20 parts |

were blended and dispersed for 5 hours in a sand mill. To the resultant dispersion liquid, hexamethylene diisocyanate (HDI) was added so as to provide an NCO group (in the isocyanate)/OH-group (in the polyol) ratio of 0.35, to prepare a coating layer-forming point.

The paint was further applied onto the above-prepared Roller (1) having an elastic layer by dipping, and dried for 1 hour in a hot air circulating drier warmed at 150° C., to obtain Charging roller (1).

Charging roller (1) had a coating layer thickness (Coat thickness) of 17 μm and exhibited a roller outer diameter deviation (O.D. deviation) of 10 μm, a roller crown of 55 μm, a surface static friction coefficient ($\mu_S$) of 0.25, a surface roughness (Rz) of 2.5 μm, and a roller hardness (Hardness) of 62 deg.

Production Example 2

Charging roller (2) was prepared in the same manner as in Production Example 1 except for using a coating layer-forming paint prepared by adding an increased amount of HDI so as to provide an NCO group (in the isocyanate)/OH group (in the polyol) ratio of 0.70.

Production Example 1

The following ingredients were blended and kneaded for 10 min. in a closed-type mixer warmed at 60° C., and then for 20 min. at 20° C. to prepare a starting compound.

| | |
|---|---|
| NBR | 100 part(s) |
| Calcium carbonate | 30 part(s) |
| Ester plasticizer | 25 part(s) |
| Fatty acid | 2 part(s) |
| Zinc oxide | 5 part(s) |
| Quaternary ammonium salt | 3 part(s) |

To the above-prepared starting compound, 1 wt. parts of vulcanizer (sulfur), and 3 wt. parts of vulcanization accelerator (TS: tetramethylthiuram monosulfide) were added, and the blend was kneaded for 10 min. by means of a two-roller mill cooled at 20° C. The resultant compound was shaped through an extruder into a tube so as to cover a 6 mm-outer dia. stainless steel core metal, and after being vulcanized in a heated steam atmosphere, the roller was ground into a roller having an outer diameter of 12 mm according to the traverse grinding scheme, thereby forming Roller (2) having an elastic layer.

Separately, for providing a coating layer paint,

| | |
|---|---|
| Polyvinyl butyral solution (solid matter 50 wt. %, in solvent ethanol) | 100 parts |
| Electroconductive tin oxide | 20 parts |

were blended and dispersed, to prepare a coating layer-forming point.

The paint was further applied onto the above-prepared Roller (2) having an elastic layer by dipping, and dried to obtain Charging roller (3).

Comparative Production Example 1

The following ingredients were blended and kneaded for 10 min. in a closed-type mixer warmed at 60° C., and after addition of 15 parts of paraffin oil, further kneaded for 20 min. at 20° C., to prepare a starting compound.

| | |
|---|---|
| EPDM | 100 part(s) |
| Electroconductive carbon black | 30 part(s) |
| Fatty acid | 2 part(s) |
| Zinc oxide | 5 part(s) |

To the above-prepared starting compound, 1 wt. parts of vulcanizer (sulfur), 1 wt. part of vulcanization accelerator 1 (MBT: 2-mercapto-benzothiazole), 1 part of vulcanization accelerator 2 (TMTD: tetramethylthiuram disulfide), and 1.5 wt. part of vulcanization accelerator 3 (ZnMDC: zinc dimethyldithiocarbamate) were added, and the blend was kneaded for 10 min. by means of a two-roller mill cooled at 20° C. The resultant compound was shaped into a tube by press-molding and fitted about a 6 mm-outer dia. stainless steel core metal, followed by vulcanization, to form Roller (3) having an elastic layer of 12 mm in outer diameter.

Further,

| | |
|---|---|
| Polyurethane | 100 parts |
| Electroconductive carbon black | 15 parts |

were dissolved and dispersed in methyl ethyl ketone (MEK) to obtain a resistance layer paint, which was then applied by dipping on the elastic layer of Roller (3) and dried to form a 100 μm-thick resistance layer.

Further,

| | |
|---|---|
| Polyamide resin | 100 parts |
| Electroconductive tin oxide | 10 parts |

were dissolved and dispersed in a methanol/toluene mixture solvent to form a surface layer-forming paint, which was then applied on the resistance layer of Roller (3) and dried to obtain Comparative Charging roller (a).

Comparative Production Example 2

The following ingredients were blended and kneaded for 10 min. in a closed-type mixer, and after addition of 20 parts of a plasticizer (DOS: dioctyl sebacate), were further kneaded for 20 min. at 20° C. to prepare a starting compound.

| | |
|---|---|
| NBR | 100 parts |
| Carbon black | 50 parts |
| Calcium carbonate | 30 parts |
| Fatty acid | 2 parts |
| Zinc oxide | 5 parts |

To the above prepared starting compound, 1 part of vulcanizer (sulfur) and 3 parts of vulcanization accelerator (TS: tetramethylthiuram monosulfide) were added and kneaded together therewith by means of a two-roller mill cooled at 20° C. The resultant compound was shaped into a tube so as to cover a 6 mm-outer dia. stainless steel core metal and vulcanized under steam heating to form a roller covered with a 15 mm-outer dia. elastic layer, which was then ground according to the transverse grinding scheme to forma 12 mm-outer dia. Comparative Charging roller (b).

Some properties of the above prepared (Comparative) Charging rollers are summarized in the following Table 7.

TABLE 7

| Prod. Ex. | Roller | Coat thickness (μm) | O.D. deviation (μm) | Roller crown (μm) | $\mu_S$ | Rz (μm) | Hardness (deg.) |
|---|---|---|---|---|---|---|---|
| | | Charging rollers | | | | | |
| 1 | (1) | 17 | 10 | 55 | 0.25 | 2.5 | 62 |
| 2 | (2) | 15 | 30 | 60 | 0.28 | 2.1 | 69 |
| 3 | (3) | 10 | 80 | 95 | 0.42 | 1.8 | 60 |
| Comp. | | | | | | | |
| 1 | (a) | 5 | 90 | 87 | 1.03 | 7.9 | 85 |
| 2 | (b) | 10 | 100 | 85 | 1.14 | 8.2 | 82 |

<Toner Performances>

EXAMPLE 3-1

Toner (2-A) prepared in Production Example 2-1 was charged in the developing device 504 of the image forming apparatus described with reference to FIG. 8, wherein Charging roller (1) prepared in Production Example 1 was used as the charging roller 502 and subjected to image forming tests in respective environments of normal temperature/normal humidity (N/N=25° C./60% RH), high temperature/high humidity (H/H=32.5° C./80% RH) and low temperature/low humidity (L/L=15° C./15% RH). In each environment, a character image having an image areal percentage of 4% was continually printed on 15,000 sheets (A4size) while replenishing the toner as necessary. After the printing test, toner performances were evaluated with respect to items shown below.

Thereafter, each image forming apparatus was left standing together with the toner for one whole day in each environment, and then the continual printing on 15,000 and evaluation of toner performances were repeated in a similar manner as above.

(1) Image Density (I.D.)

The same as in Table 4.

(2) Density Uniformity (Dsty.ufmty.)

After the continuous printing, a wholly solid image (magenta) was printed on two A4-size sheets, and a maximum difference in local image density on the second sheet was measured by using a Macbeth densitometer ("RD918", made by Macbeth Co.). Based on the measured maximum density difference, evaluation was performed according to the following standard.

A: <0.05

B: ≧0.05 and <0.10

C: ≧0.10 and <0.30

D: ≧0.30

(3) Image Fog (Fog)

The same as in Table 4.

(4) Matching with Charging Roller (4-1) Charging Irregularity (Charge Irreg.)

A solid white image was printed and the printed image was evaluated with respect to the occurrence of periodical fog according to the following standard.

A: Not observed at all.

B: Still periodical fog observed.

C: Periodical fog observed.

D: Periodical density irregularity observed.

(4-2) Halftone

A halftone image formed by alternation of 1 dot-wide line and 1 dot-wide space was printed, and the degree of image soiling attributable to inappropriate matching with the charging roller was evaluated according to the following standard.

A: No soil at all.

B: Slight soil observed.

C: Minute black spot soil observed.

D: Periodical stripe soil or vertical streak soil observed.

The results of the above evaluation are summarized in Table 8 together with those of Examples and Comparative Examples described below. In Table 8, the results of the evaluation after the first printing and the evaluation after the printing after standing for one whole day for each evaluation item are indicated by connection with an arrow "(→)", e.g., "A→B" means that the tested toner exhibited a level "A" performance after the first printing on 15,000 sheets and exhibited a lower level performance "B" after the second printing on 15,000 sheets after standing for one whole day after the first printing.

EXAMPLES 3-2 to 3-9

Comparative Examples 3-1 to 3-4

The toner performance evaluation was performed in the same manner as in Example 3-1 except for changing the toner and/or the charging roller as shown in Table 8.

The results of evaluation are also shown in Table 8.

TABLE 8

| Example | Toner | Charging roller | Environment | Printed image: I.D. | Dsty. ufmty. | Fog | Charge irreg. | Halftone |
|---|---|---|---|---|---|---|---|---|
| | | | | Toner performances | | | | |
| 3-1 | (2-A) | (1) | N/N | A→A | A→A | A→A | A→A | A→A |
| | | | H/H | A→A | A→A | A→A | A→A | A→A |
| | | | L/L | A→A | A→A | A→A | A→B | A→A |
| 3-2 | (2-B) | (1) | N/N | A→A | A→A | A→A | A→A | A→A |
| | | | H/H | A→A | A→A | A→A | A→B | A→A |
| | | | L/L | A→A | A→A | A→A | A→B | A→A |
| 3-3 | (2-C) | (2) | N/N | A→A | A→A | A→A | A→A | A→A |
| | | | H/H | A→A | A→A | A→A | A→B | A→A |
| | | | L/L | A→A | A→A | A→A | A→B | A→A |
| 3-4 | (2-D) | (2) | N/N | A→A | A→A | A→A | A→B | A→A |
| | | | H/H | A→A | A→A | A→A | B→B | A→A |
| | | | L/L | A→A | A→B | A→B | B→B | A→A |

TABLE 8-continued

| | | | | Toner performances | | | | |
|---|---|---|---|---|---|---|---|---|
| | | Charging | Environ- | Printed image | | | | |
| Example | Toner | roller | ment | I.D. | Dsty. ufmty. | Fog | Charge irreg. | Halftone |
| 3-5 | (2-E) | (2) | N/N | A→A | A→A | A→A | A→B | A→A |
| | | | H/H | A→A | A→A | A→B | B→B | A→A |
| | | | L/L | A→B | A→B | A→B | B→B | A→B |
| 3-6 | (2-F) | (3) | N/N | A→A | A→A | A→A | A→B | A→A |
| | | | H/H | A→A | A→B | A→B | B→B | A→A |
| | | | L/L | A→B | A→B | A→B | B→B | A→B |
| 3-7 | (2-G) | (3) | N/N | A→A | A→A | A→B | B→B | A→A |
| | | | H/H | A→B | A→B | B→B | B→B | A→A |
| | | | L/L | A→B | A→B | B→B | B→B | A→B |
| 3-8 | (2-H) | (3) | N/N | A→A | A→A | A→B | B→B | A→A |
| | | | H/H | A→B | A→B | B→B | B→B | A→B |
| | | | L/L | A→B | A→B | B→B | B→B | A→B |
| 3-9 | (2-I) | (3) | N/N | A→B | A→A | B→B | B→B | A→A |
| | | | H/H | A→B | A→B | B→B | B→B | A→B |
| | | | L/L | A→B | A→B | B→B | B→B | A→B |
| Comp. 3-1 | (2-a) | Comp. (a) | N/N | A→C | A→B | B→C | B→C | C→D |
| | | | H/H | A→C | B→B | B→C | B→C | C→D |
| | | | L/L | A→C | B→B | B→C | B→C | C→D |
| Comp. 3-2 | (2-b) | Comp. (a) | N/N | A→C | A→B | B→C | B→C | C→D |
| | | | H/H | A→C | B→B | B→C | B→C | C→D |
| | | | L/L | A→C | B→B | B→C | B→C | C→D |
| Comp. 3-3 | (2-C) | Comp. (b) | N/N | B→C | B→B | B→C | B→C | C→D |
| | | | H/H | B→C | B→C | B→C | B→C | C→D |
| | | | L/L | B→C | B→C | B→D | B→D | C→D |
| Comp. 3-4 | (2-d) | Comp. (b) | N/N | B→C | B→B | B→C | B→C | C→D |
| | | | H/H | B→C | B→C | B→C | B→C | C→D |
| | | | L/L | B→C | B→C | B→D | B→D | C→D |

What is claimed is:

1. A toner, comprising: at least a binder resin, a colorant and a wax component;

wherein the colorant comprises a monoazo pigment composition comprising a monoazo pigment represented by Formula (1) below, a β-naphthol derivative represented by Formula (2) below and an aromatic amine represented by Formula (3) below, the monoazo pigment composition is contained in a proportion of 1–20 wt. parts per 100 wt. parts of the binder resin, and the β-naphthol derivative and the aromatic amine are contained in proportions of 500–50,000 ppm and at most 200 ppm, respectively, based on the monoazo pigment composition; Formula (1):

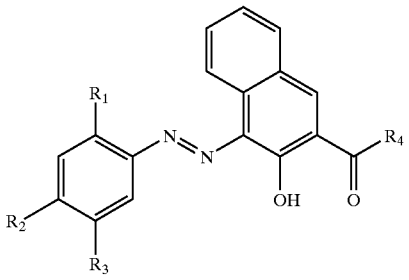

wherein R1–R3 independently denote a substituent selected from the group consisting of hydrogen, halogen, alkyl, alkoxy, nitro, anilido and sulfamoyl; R4 denotes a substituent selected from the group consisting of —OH, —$NH_2$,

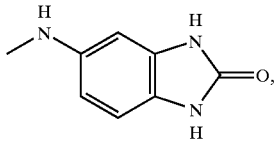

and

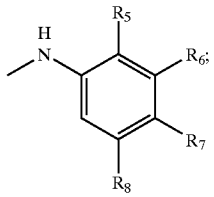

and R5–R8 independently denote a substituent selected from the group consisting of hydrogen, halogen, alkyl, alkoxy and nitro; Formula (2):

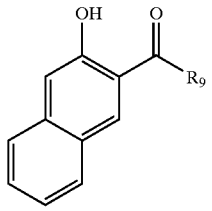

wherein R9 denotes a substituent selected from the same group as for R4, Formula (3):

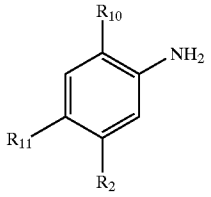

wherein R10–R12 independently denote a substituent selected from the same group as for R1–R3.

2. The toner according to claim 1, wherein the β-naphthol derivative is contained in 500–30,000 ppm by weight of the monoazo pigment composition.

3. The toner according to claim 1, wherein the aromatic amine is contained in 10–200 ppm by weight of the monoazo pigment composition.

4. The toner according to claim 1, wherein the monoazo pigment is C.I. Pigment Red 269 represented by a formula below:

C.I. Pigment Red 269

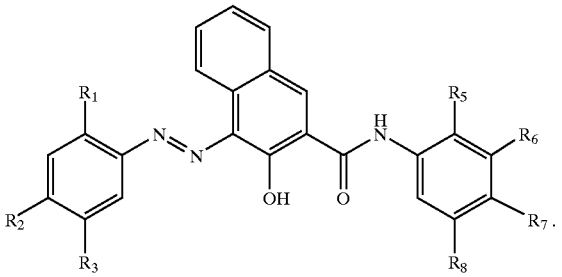

$R_1 = OCH_3$
$R_2 = H$
$R_3 = CONHC_6H_5$
$R_5 = OCH_3$
$R_6 = H$
$R_7 = H$
$R_8 = Cl$

5. The toner according to claim 1, wherein the monoazo pigment is C.I. Pigment Red 150 represented by a formula below:

C.I. Pigment Red 150

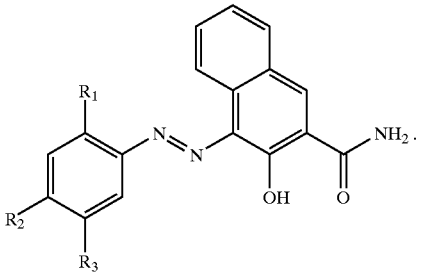

$R_1 = OCH_3$
$R_2 = H$
$R_3 = CONHC_6H_5$

6. The toner according to claim 1, wherein the monoazo pigment is C.I. Pigment Red 176 represented by a formula below:

C.I. Pigment Red 176

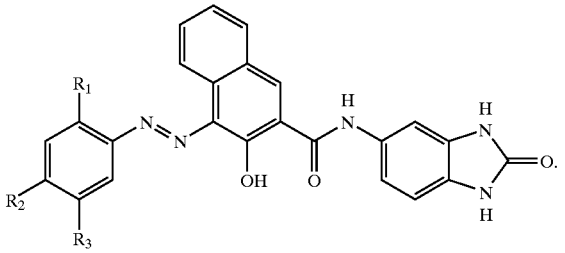

$R_1 = OCH_3$
$R_2 = H$
$R_3 = CONHC_6H_5$

7. The toner according to claim 1, wherein the monoazo pigment is C.I Pigment Red 31 represented by a formula below:

C.I. Pigment Red 31

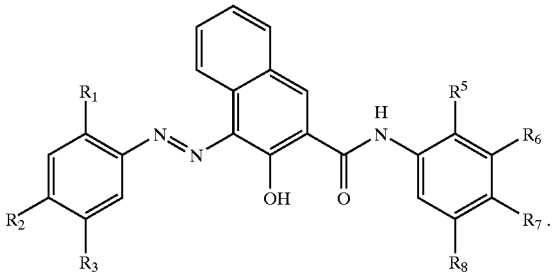

$R_1 = OCH_3$
$R_2 = H$
$R_3 = CONHC_6H_5$
$R_5 = H$
$R_6 = H$
$R_7 = H$
$R_8 = NO_2$

8. The toner according to claim 1, wherein the monoazo pigment is C.I. Pigment Red 5 represented by a formula below:

C.I. Pigment Red 5

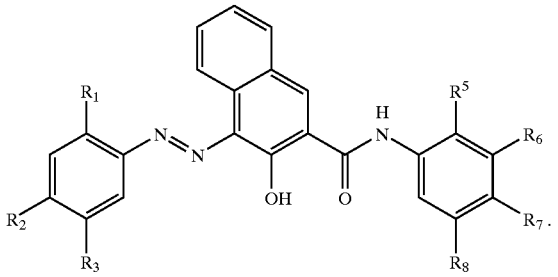

$R_1 = OCH_3$
$R_2 = H$
$R_3 = SO_2N(C_2H_5)_2$
$R_5 = OCH_3$
$R_6 = H$
$R_7 = OCH_3$
$R_8 = Cl$

9. The toner according to claim 1, wherein the toner containing a quinacridone pigment composition represented by Formula (9) shown below in addition to the monoazo pigment composition: Formula (9):

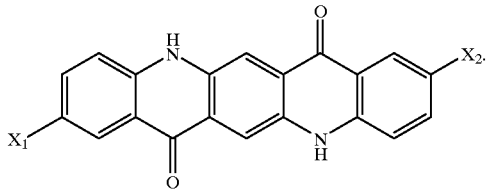

wherein $X_1$ and $X_2$ are each hydrogen, halogen, alkyl or alkoxy.

10. The toner according to claim 9 wherein the toner contains 1–20 wt. % thereof in total of the monoazo pigment composition and the quinacridone pigment in a weight ratio of 25:75 to 75:25.

11. The toner according to claim 1, wherein the toner particles have such a wax dispersion state as to provide 20 arbitrarily selected toner particle cross-sections each having a longer-axis diameter R in a range of $0.9\times D4 \leqq R \leqq 1.1\times D4$ with respect to a weight-average particle size (diameter) D4 of the toner particles, and the 20 arbitrarily selected toner particle cross-sections provide 20 values each of r and R giving an average $(r/R)_{av.}$ satisfying $0.05 \leqq (r/R)_{av} \leqq 0.95$, wherein r denotes a maximum longer-axis diameter of wax particle(s) dispersed discretely in a shape of sphere or spindle in the matrix of the binder resin in each toner article cross-section as observed through a transmission electron microscope.

12. The toner according to claim 1, wherein the monoazo pigment composition contains (i) natural rosin, (ii) modified rosin, (iii) synthetic rosin, (iv) an alkali metal salt of the natural rosin, synthetic rosin, or modified rosin, or (v) an ester of the natural rosin, synthetic rosin, or modified rosin.

13. An image forming method, comprising:

(a) a charging step an image-bearing member by charging member supplied with a voltage from an external voltage supply, (b) a latent image forming step of forming an electrostatic image on the charged image-bearing member, (c) a developing step of developing the electrostatic image with a toner carried on a developer-carrying member to form a toner image on the image-bearing member, (d) a transfer step of transferring the toner image on the image-bearing member onto transfer material via or without via an intermediate transfer member, (e) a cleaning step of removing non-transferred residual toner remaining on the image-bearing member, and (f) a fixing step of fixing the toner image onto the transfer material under application of heat and pressure from heat-pressure means, wherein the toner comprises at least a binder resin, a colorant and a wax component;

wherein the colorant comprises a monoazo pigment composition comprising a monoazo pigment represented by Formula (1) below, a β-naphthol derivative represented by Formula (2) below and an aromatic amine represented by Formula (3) below, the monoazo pigment composition is contained in a proportion of 1–20 wt. parts per 100 wt. parts of the binder resin, and the β-naphthol derivative and the aromatic amine are contained in proportions of 500–50,000 ppm and at most 200 ppm, respectively, based on the monoazo pigment composition; Formula (1):

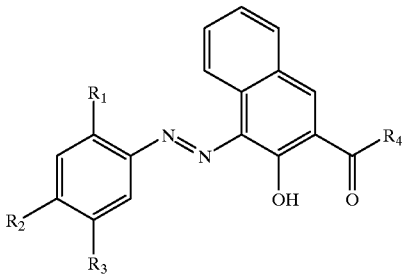

wherein R1–R3 independently denote a substituent selected from the group consisting of hydrogen, halogen, alkyl, alkoxy, nitro, anilido and sulfamoyl; R4 denotes a substituent selected from the group consisting of —OH, —$NH_2$,

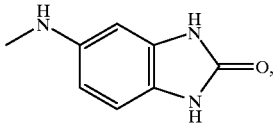

and

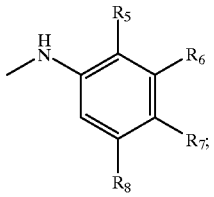

and R5–R8 independently denote a substituent selected from the group consisting of hydrogen, halogen, alkyl, alkoxy and nitro; Formula (2):

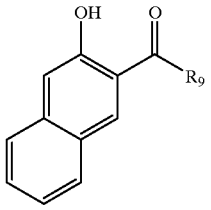

wherein R9 denotes a substituent selected from the same group as for R4, Formula (3):

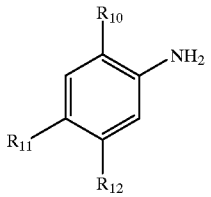

wherein R10–R12 independently denote a substituent selected from the same group as for R1–R3.

14. The image forming method according to claim 13, wherein the heat-pressure means is characterized by (i) including at least a rotatory heating member equipped with a heat-generator and a rotatory pressing member pressed against the rotatory heating member to form a nip therebetween, (ii) being supplied with an offset-preventing liquid to be supplied to a surface of the rotary-heating member contacting a toner image on a transfer material at a rate of 0–0.025 mg/cm$^2$ (area of the transfer material) at the most and (iii) functioning to heat and press the toner image on the transfer material by the rotatory heating member and the rotatory pressing member while holding and conveying the transfer material by the nip.

15. The image forming method according to claim 14, wherein the surface contacting the toner image on the transfer material is not supplied with the offset-preventing liquid.

16. The image forming method according to claim 14, wherein in the fixing step (f), the rotary heating member comprises a cylindrical heating roller enclosing therein the heat-generator.

17. The image forming method according to claim 14, wherein in the fixing step (f), the rotary heating member comprises a cylindrical heat-resistant endless film enclosing therein a fixed heating member as the heat generator and the endless film is moved together with the transfer material and relative to the fixed heating member while being pressed against the heating member so as to transfer heat from the heating member to the toner image on the transfer material, thereby fixing the toner image under heat and pressure.

18. The image forming method according to claim 14, wherein the rotary heating member in the fixing step (f) comprises a cylindrical heat-resistant endless film having a heat-generating layer as the heat generator capable of electromagnetic inductive heat generation in a magnetic field and enclosing therein a magnetic field generating means generating the magnetic field.

19. The image forming method according to claim 13, wherein the image-bearing member is an electrophotographic photosensitive member having a surface showing a universal hardness of 150–230 N/mm$^2$.

20. The image forming method according to claim 13, wherein in the developing step (c), a surface of the image-bearing member and a surface of the developer-carrying member are opposite to each other and moved in an identical direction at a speed of the former to the latter of 1:1.05 to 1:3.0 in a developing region, and a toner layer formed on the developer-carrying member by abutment of a toner layer-regulating member against the developer-carrying member is caused to contact the surface of the image-bearing member to develop the electrostatic image thereon in the developing region.

21. The image forming method according to claim 13, wherein in the transfer step (d), a transfer device is abutted against the image-bearing member or the intermediate transfer member via the transfer material.

22. The image forming method according to claim 13, wherein the cleaning step (e) is effected substantially simultaneously with the developing step.

23. The image forming method according to claim 13, wherein the transfer step (d) is effected via an intermediate transfer member in the form of an endless belt, and the endless belt has a surface roughness Ra of at most 1 $\mu$m, has a volume resistivity in a range of $1\times10^6$–$8\times10^{13}$ ohm.cm, exhibits an elasticity modulus of 500–4000 Mpa when stretched in an elongation range of from 0.5% to 0.6%, and has a breakage elongation of 5–850%.

24. The image forming method according to claim 13, wherein the transfer step (d) is effected via an intermediate transfer member, non-transferred residual toner remaining on the intermediate transfer member is electrostatically back-transferred to the image-bearing member and then removed in the cleaning step (e) for the image-bearing member, thereby cleaning the intermediate transfer member.

25. The image forming method according to claim 13, wherein the charging member is a charging roller disposed contactable to the image-bearing member, and the charging roller is characterized by (i) comprising an electroconductive support coated with at least one coating layer, (ii) having an outer diameter deviation not exceeding a roller crown and (iii) having a surface showing a static friction coefficient of at most 1.00 and a surface roughness (Rz) of at most 5.0 $\mu$m.

26. An image forming method comprising:

(a) a charging step of charging an image-bearing member by a charging member supplied with a voltage from an external voltage supply, (b) a latent image forming step of forming an electrostatic image on the charged image-bearing member, (c) a developing step of developing the electrostatic image with a toner carried on a developer-carrying member to form a toner image on the image-bearing member, (d) a transfer step of transferring the toner imager on the image-bearing member onto transfer material via or without via an intermediate transfer member, (e) a cleaning step of removing non-transferred residual toner remaining on the image-bearing member, and (f) a fixing step of fixing the toner image onto the transfer material under application of heat and pressure from heat-pressure means, wherein the toner is a toner according to any one of claims 2, 3, 4–11, or 12.

* * * * *

UNITED STATES PATENT AND TRADEMARK OFFICE

CERTIFICATE OF CORRECTION

PATENT NO. : 6,667,140 B2
DATED : December 23, 2003
INVENTOR(S) : Emi Tosaka et al.

It is certified that error appears in the above-identified patent and that said Letters Patent is hereby corrected as shown below:

Title page,
Item [56], References Cited, OTHER PUBLICATIONS, after Isganitis et al.: "Color Developer Composition," should read -- "Color Developer Composition", --.

Column 12,
Line 3, ""INERTSIL" should read -- "INTERSIL --.

Column 15,
Line 4, "puistric" should read -- pulstric --.

Column 16,
Line 56, "thereof" (second occurrence) should read -- thereof; --.

Column 20,
Line 44, "pm," should read -- μm, --.

Column 23,
Line 55, "1and" should read -- 1 and --.

Column 24,
Line 31, "1surface." should read -- 1 surface --.

Column 25,
Line 10, "equations." should read -- equation. --; and
Line 12, "[Mpa]" should read -- [MPa] --.

Column 26,
Line 56, "imager" should read -- image --.

Column 51,
Line 22, "meandering prevention" should read -- meandering-prevention --.

Column 68,
Table 5, "30ºC./80% RJ" should read -- 30ºC./80% RH --.

Column 69,
Table 5 Cont., "30ºC./80% RJ" should read -- 30ºC./80% RH --.

UNITED STATES PATENT AND TRADEMARK OFFICE

CERTIFICATE OF CORRECTION

PATENT NO. : 6,667,140 B2
DATED : December 23, 2003
INVENTOR(S) : Emi Tosaka et al.

It is certified that error appears in the above-identified patent and that said Letters Patent is hereby corrected as shown below:

Column 81,
Line 36, “step” should read -- step of charging --; and “by” should read -- by a --.

Column 84,
Line 11, “Mpa” should read -- MPa --; and
Line 38, “imager” should read -- image --.

Signed and Sealed this

Twenty-first Day of September, 2004

JON W. DUDAS
*Director of the United States Patent and Trademark Office*